US011254996B2

(12) United States Patent
Branagan et al.

(10) Patent No.: US 11,254,996 B2
(45) **Date of Patent: *Feb. 22, 2022**

(54) DELAYED CRACKING PREVENTION DURING DRAWING OF HIGH STRENGTH STEEL

(71) Applicant: United States Steel Corporation, Pittsburgh, PA (US)

(72) Inventors: Daniel James Branagan, Idaho Falls, ID (US); Andrew E. Frerichs, Idaho Falls, ID (US); Brian E. Meacham, Idaho Falls, ID (US); Grant G. Justice, Idaho Falls, ID (US); Kurtis Clark, Idaho Falls, ID (US); Logan J. Tew, Idaho Falls, ID (US); Scott T. Anderson, Idaho Falls, ID (US); Scott Larish, Idaho Falls, ID (US); Sheng Cheng, Idaho Falls, ID (US); Taylor L. Giddens, White, GA (US); Alla V. Sergueeva, Idaho Falls, ID (US); Andrew T. Ball, St. Louis, MO (US); Jason K. Walleser, Idaho Falls, ID (US)

(73) Assignee: United States Steel Corporation, Pittsburgh, PA (US)

( * ) Notice: Subject to any disclaimer, the term of this patent is extended or adjusted under 35 U.S.C. 154(b) by 241 days.

This patent is subject to a terminal disclaimer.

(21) Appl. No.: 16/449,983

(22) Filed: Jun. 24, 2019

(65) Prior Publication Data

US 2019/0309388 A1 Oct. 10, 2019

Related U.S. Application Data

(63) Continuation of application No. 15/391,237, filed on Dec. 27, 2016, now Pat. No. 10,378,078.

(Continued)

(51) Int. Cl.
*C21D 9/46* (2006.01)
*C22C 38/02* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS 5,571,343 A 11/1996 Ryoo et al.
9,074,273 B2 7/2015 Branagan et al.
(Continued)

FOREIGN PATENT DOCUMENTS

EP 2653581 10/2013
JP 2014189800 10/2014
(Continued)

OTHER PUBLICATIONS

The International Search Report of the International Searching Authority for International Application No. PCT/US2016/068711, 2 pages.

(Continued)

*Primary Examiner* — Colin W. Slifka
(74) *Attorney, Agent, or Firm* — Alan G. Towner; Leech Tishman Fuscaldo & Lampl

(57) ABSTRACT

This invention relates to prevention of delayed cracking of metal alloys during drawing which may occur from hydrogen attack. The alloys find applications in parts or components used in vehicles, such as bodies in white, vehicular frames, chassis, or panels.

13 Claims, 43 Drawing Sheets

Related U.S. Application Data

(60) Provisional application No. 62/271,512, filed on Dec. 28, 2015.

(51) Int. Cl.

| | |
|---|---|
| ***C22C 38/04*** | (2006.01) |
| ***C22C 38/06*** | (2006.01) |
| ***C22C 38/08*** | (2006.01) |
| ***C22C 38/16*** | (2006.01) |
| ***C22C 38/18*** | (2006.01) |
| ***C21D 8/02*** | (2006.01) |
| ***C21D 8/04*** | (2006.01) |
| ***C22C 38/34*** | (2006.01) |
| ***C22C 38/42*** | (2006.01) |
| ***C22C 38/54*** | (2006.01) |
| ***C22C 38/58*** | (2006.01) |
| ***C21D 6/00*** | (2006.01) |

(52) U.S. Cl.

CPC ..... *C21D 8/0263* (2013.01); *C21D 8/0273* (2013.01); *C21D 8/0426* (2013.01); *C21D 8/0436* (2013.01); *C21D 8/0473* (2013.01); *C22C 38/02* (2013.01); *C22C 38/04* (2013.01); *C22C 38/06* (2013.01); *C22C 38/08* (2013.01); *C22C 38/16* (2013.01); *C22C 38/18* (2013.01); *C22C 38/34* (2013.01); *C22C 38/42* (2013.01); *C22C 38/54* (2013.01); *C22C 38/58* (2013.01); *C21D 6/005* (2013.01); *C21D 2211/001* (2013.01)

(56) References Cited

U.S. PATENT DOCUMENTS

| | | | |
|---|---|---|---|
| 10,378,078 | B2 | 8/2019 | Branagan et al. |
| 2005/0146162 | A1 | 7/2005 | Gerick et al. |
| 2007/0163679 | A1 | 7/2007 | Fujisawa et al. |
| 2010/0132854 | A1 | 6/2010 | Cola, Jr. |
| 2013/0039802 | A1 | 2/2013 | Talonen et al. |
| 2015/0090372 | A1 | 4/2015 | Branagan et al. |
| 2015/0114587 | A1 | 4/2015 | Branagan et al. |
| 2015/0152534 | A1 | 6/2015 | Branagan et al. |

FOREIGN PATENT DOCUMENTS

| | | |
|---|---|---|
| WO | 2011154153 | 12/2011 |
| WO | 2015001177 | 8/2015 |

OTHER PUBLICATIONS

Berrahmoune et al., "Delayed Cracking in 301LN Austenitic Steel After Deep Drawing: Martensitic Transformation and Residual Stress Analysis", Materials Science and Engineering, A, 2006, vol. 438-440, pp. 262-266.

Papula et al., "Effect of Residual Stress and Strain-Induced A'-martensite on Delayed Cracking of Metastable Austenitic Stainless Steels", Metallurgical and Materials Transactions A, 2014, vol. 45, No. 3, pp. 1238-1246.

Papula et al., "Delayed Cracking of Metastable Austenitic Stainless Steels after Deep Drawing", ISIJ International, vol. 55, (2015), No. 10, pp. 2182-2188.

1.25

1.4

1.6

1.78

1.9 2.0 2.1 2.2 2.3 2.4

1.9 2.0 2.1 2.2 2.3 2.4 a)

1.9 2.0 2.1 2.2 2.3 2.4 2.5 b)

1.9 2.0 2.1 2.2 2.3 2.4 2.5

DELAYED CRACKING PREVENTION DURING DRAWING OF HIGH STRENGTH STEEL

CROSS-REFERENCE TO RELATED APPLICATIONS

This application is a continuation of U.S. application Ser. No. 15/391,237, filed Dec. 27, 2016, now issued U.S. Pat. No. 10,378,078, which claims the benefit of U.S. Provisional Application 62/271,512 filed Dec. 28, 2015, the content of both of which is incorporated herein by reference.

FIELD OF INVENTION

This invention relates to prevention of delayed cracking of metal alloys during drawing which may occur from hydrogen attack. The alloys find applications in parts or components used in vehicles, such as bodies in white, vehicular frames, chassis, or panels.

BACKGROUND

Iron alloys, including steel, make up the vast majority of the metals production around the world. Iron and steel development have driven human progress since before the Industrial Revolution forming the backbone of human technological development. In particular, steel has improved the everyday lives of humanity by allowing buildings to reach higher, bridges to span greater distances, and humans to travel farther. Accordingly, production of steel continues to increase over time with a current US production around 100 million tons per year with an estimated value of $75 billion. These steel alloys can be broken up into three classes based upon measured properties, in particular maximum tensile strain and tensile stress prior to failure. These three classes are: Low Strength Steels (LSS), High Strength Steels (HSS), and Advanced High Strength Steels (AHSS). Low Strength Steels (LSS) are generally classified as exhibiting tensile strengths less than 270 MPa and include such types as interstitial free and mild steels. High-Strength Steels (HSS) are classified as exhibiting tensile strengths from 270 to 700 MPa and include such types as high strength low alloy, high strength interstitial free and bake hardenable steels. Advanced High-Strength Steels (AHSS) steels are classified by tensile strengths greater than 700 MPa and include such types as martensitic steels (MS), dual phase (DP) steels, transformation induced plasticity (TRIP) steels, and complex phase (CP) steels. As the strength level increases the trend in maximum tensile elongation (ductility) of the steel is negative, with decreasing elongation at high tensile strengths. For example, tensile elongation of LSS, HSS and AHSS ranges from 25% to 55%, 10% to 45%, and 4% to 30%, respectively.

Steel utilization in vehicles is also high, with advanced high strength steels (AHSS) currently at 17% and forecast to grow by 300% in the coming years [American Iron and Steel Institute, (2013), Profile 2013, Washington, D.C.]. With current market trends and governmental regulations pushing towards higher efficiency in vehicles, AHSS are increasingly being pursued for their ability to provide high strength to mass ratio. The formability of steel is of unique importance for automotive applications. Forecast parts for next generation vehicles require that materials are capable of plastically deforming, sometimes severely, such that a complex geometry will be obtained. High formability steel provides benefit to a part designer by allowing for the design of more complex part geometries facilitating the desired weight reduction.

Formability may be further broken into two distinct forms: edge formability and bulk formability. Edge formability is the ability for an edge to be formed into a certain shape. Edges, being free surfaces, are dominated by defects such as cracks or structural changes in the sheet resulting from the creation of the sheet edge. These defects adversely affect the edge formability during forming operations, leading to a decrease in effective ductility at the edge. Bulk formability on the other hand is dominated by the intrinsic ductility, structure, and associated stress state of the metal during the forming operation. Bulk formability is affected primarily by available deformation mechanisms such as dislocations, twinning, and phase transformations. Bulk formability is maximized when these available deformation mechanisms are saturated within the material, with improved bulk formability resulting from an increased number and availability of these mechanisms.

Bulk formability can be measured by a variety of methods, including but not limited to tensile testing, bulge testing, bend testing, and draw testing. High strength in AHSS materials often leads to limited bulk formability. In particular, limiting draw ratio by cup drawing is lacking for a myriad of steel materials, with DP 980 material generally achieving a draw ratio less than 2, thereby limiting their potential usage in vehicular applications.

Hydrogen assisted delayed cracking is also a limiting factor for many AHSS materials. Many theories exist on the specifics of hydrogen assisted delayed cracking, although it has been confirmed that three pieces must be present for it to occur in steels; a material with tensile strength greater than 800 MPa, a high continuous stress/load, and a concentration of hydrogen ions. Only when all three parts are present will hydrogen assisted delayed cracking occur. As tensile strengths greater than 800 MPa are desirable in AHSS materials, hydrogen assisted delayed cracking will remain problematic for AHSS materials for the foreseeable future. For example, structural or non-structural parts or components used in vehicles, such as bodies in white, vehicular frames, chassis, or panels may be stamped and in the stampings there may be drawing operations to achieve certain targeted geometries. In these areas of the stamped part or component where drawing was done then delayed cracking can occur resulting in scrapping of the resulting part or component.

SUMMARY

A method for improving resistance for delayed cracking in a metallic alloy which involves:

a. supplying a metal alloy comprising at least 50 atomic % iron and at least four or more elements selected from Si, Mn, B, Cr, Ni, Cu, Al or C and melting said alloy and cooling at a rate of ≤250 K/s or solidifying to a thickness of ≥2.0 mm and forming an alloy having a $T_m$ and matrix grains of 2 to 10,000 μm;

b. processing said alloy into sheet with thickness ≤10 mm by heating said alloy to a temperature of 650° C. and below the $T_m$ of said alloy and stressing of said alloy at a strain rate of $10^{-6}$ to $10^4$ and cooling said alloy to ambient temperature;

c. stressing said alloy at a strain rate of $10^{-6}$ to $10^4$ and heating said alloy to a temperature of at least 600° C. and below $T_m$ and forming said alloy in a sheet form with thickness ≤3 mm having a tensile strength of 720 to 1490

MPa and an elongation of 10.6 to 91.6% and with a magnetic phases volume % from 0 to 10%;

wherein said alloy formed in step (c) indicates a critical draw speed ($S_{CR}$) or critical draw ratio ($D_{CR}$) wherein drawing said alloy at a speed below $S_{CR}$ or at a draw ratio greater than $D_{CR}$ results a first magnetic phase volume V1 and wherein drawing said alloy at a speed equal to or above $S_{CR}$ or at a draw ratio less than or equal to $D_{CR}$ results in a magnetic phase volume V2, where V2<V1.

In addition, the present disclosure also relates to a method for improving resistance for delayed cracking in a metallic alloy which involves:

a. supplying a metal alloy comprising at least 50 atomic % iron and at least four or more elements selected from Si, Mn, B, Cr, Ni, Cu, Al or C and melting said alloy and cooling at a rate of ≤250 K/s or solidifying to a thickness of ≥2.0 mm and forming an alloy having a $T_m$ and matrix grains of 2 to 10,000 μm;

b. processing said alloy into sheet with thickness ≤10 mm by heating said alloy to a temperature of 650° C. and below the $T_m$ of said alloy and stressing of said alloy at a strain rate of $10^{-6}$ to $10^4$ and cooling said alloy to ambient temperature;

c. stressing said alloy at a strain rate of $10^{-6}$ to $10^4$ and heating said alloy to a temperature of at least 600° C. and below $T_m$ and forming said alloy in a sheet form with thickness ≤3 mm having a tensile strength of 720 to 1490 MPa and an elongation of 10.6 to 91.6% and with a magnetic phase volume % (Fe %) from 0 to 10%;

wherein when said alloy in step (c) is subject to a draw, said alloy indicates a magnetic phase volume of 1% to 40%.

BRIEF DESCRIPTION OF THE DRAWINGS

The detailed description below may be better understood with reference to the accompanying FIGS. which are provided for illustrative purposes and are not to be considered as limiting any aspect of this invention.

DETAILED DESCRIPTION

Figure 1A:
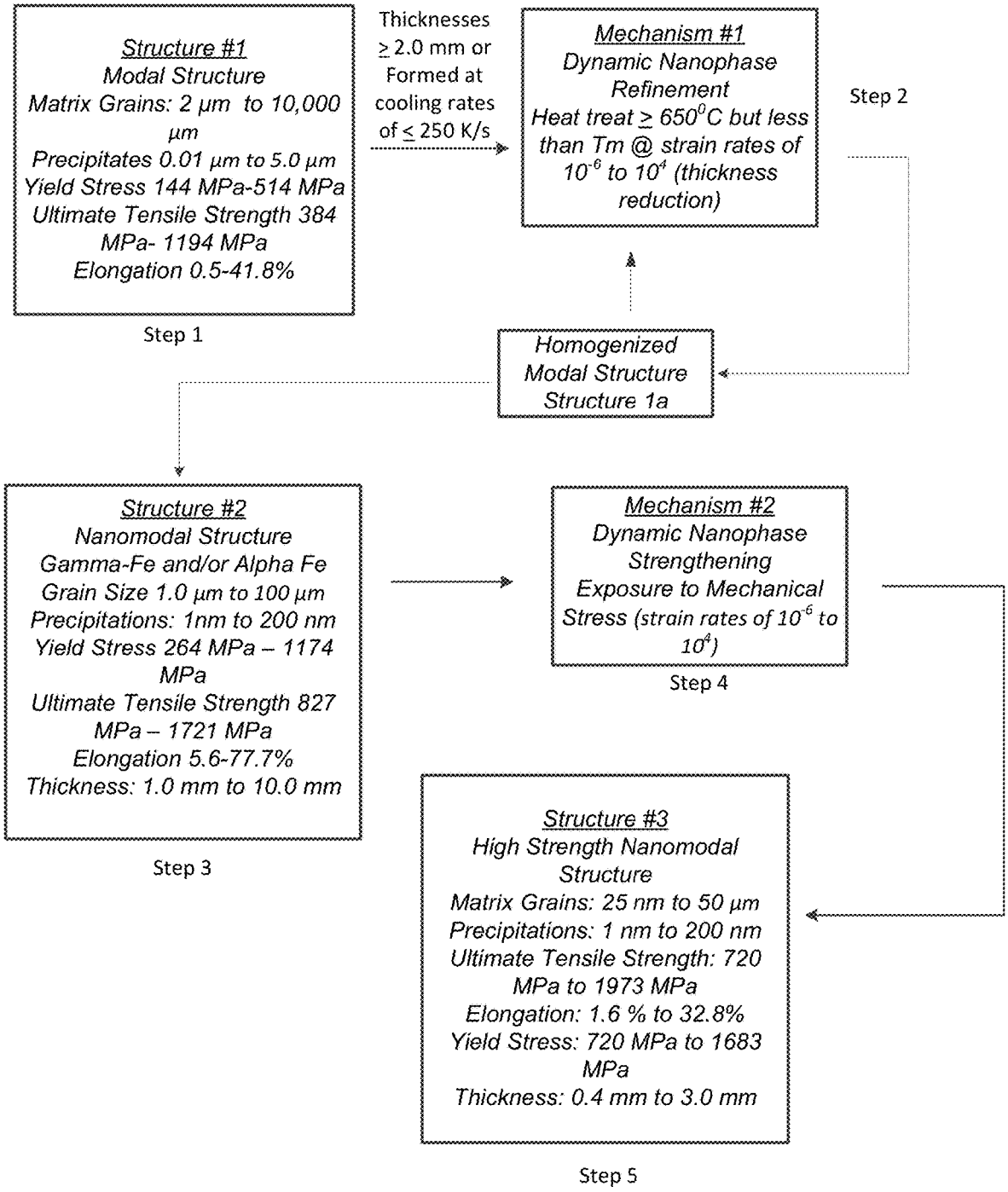
FIGS. 1A-1C Processing route for sheet production through slab casting.
Figure 1B:
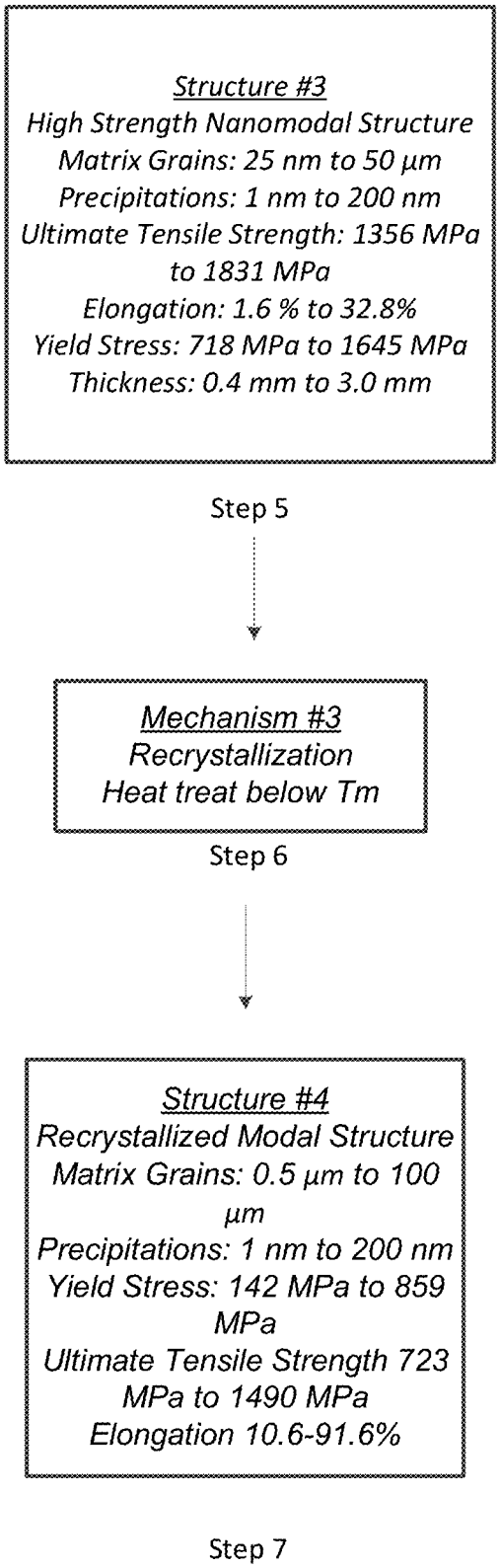

The steel alloys herein preferably undergo a unique pathway of structural formation through the mechanisms as illustrated in FIGS. 1A and 1B. Initial structure formation begins with melting the alloy and cooling and solidifying and forming an alloy with Modal Structure (Structure #1, FIG. 1A). Thicker as-cast structures (e.g. thickness of greater than or equal to 2.0 mm) result in relatively slower cooling rate (e.g. a cooling rate of less than or equal to 250 K/s) and relatively larger matrix grain size. Thickness may therefore preferably be in the range of 2.0 mm to 500 mm. The Modal Structure preferably exhibits an austenitic matrix (gamma-Fe) with grain size and/or dendrite length from 2 μm to 10,000 μm and precipitates at a size of 0.01 to 5.0 μm in laboratory casting. Steel alloys herein with the Modal Structure, depending on starting thickness size and the specific alloy chemistry typically exhibits the following tensile properties, yield stress from 144 to 514 MPa, ultimate tensile strength in a range from 384 to 1194 MPa, and total ductility from 0.5 to 41.8.

Steel alloys herein with the Modal Structure (Structure #1, FIG. 1A) can be homogenized and refined through the Nanophase Refinement (Mechanism #1, FIG. 1A) by exposing the steel alloy to one or more cycles of heat and stress (e.g. Hot Rolling) ultimately leading to formation of the Nanomodal Structure (Structure #2, FIG. 1A). More specifically, the Modal Structure, when formed at thickness of greater than or equal to 2.0 mm and/or formed at a cooling rate of less than or equal to 250 K/s, is preferably heated to a temperature of 650° C. to a temperature below the solidus temperature, and more preferably 50° C. below the solidus temperature ($T_m$) and preferably at strain rates of $10^{-6}$ to $10^4$ with a thickness reduction. Transformation to Structure #2 preferably occurs in a continuous fashion through the intermediate Homogenized Modal Structure (Structure #1a, FIG. 1A) as the steel alloy undergoes mechanical deformation during successive application of temperature and stress and thickness reduction such as what can be configured to occur during hot rolling.

The Nanomodal Structure (Structure #2, FIG. 1A) preferably has a primary austenitic matrix (gamma-Fe) and, depending on chemistry, may additionally contain ferrite grains (alpha-Fe) and/or precipitates such as borides (if boron is present) and/or carbides (if carbon is present). Depending on starting grain size, the Nanomodal Structure typically exhibits a primary austenitic matrix (gamma-Fe) with grain size of 1.0 to 100 μm and/or precipitates at a size 1.0 to 200 nm in laboratory casting. Matrix grain size and precipitate size might be larger up to a factor of 5 at commercial production depending on alloy chemistry, starting casting thickness and specific processing parameters. Steel alloys herein with the Nanomodal Structure typically exhibit the following tensile properties, yield stress from 264 to 1174 MPa, ultimate tensile strength in a range from 827 to 1721 MPa, and total ductility from 5.6 to 77.7%.

Structure #2 is therefore preferably formed by Hot Rolling and the thickness reduction preferably provides a thickness of 1.0 mm to 10.0 mm. Accordingly, it may be understood that the thickness reduction that is applied to the Modal Structure (originally in the range of 2.0 mm to 500 mm) is such that the thickness reduction leads to a reduced thickness in the range of 1.0 mm to 10.0 mm.

When steel alloys herein with the Nanomodal Structure (Structure #2, FIG. 1A) are subjected to stress at ambient/near ambient temperature (e.g. 25° C. at +/−5° C.), preferably via Cold Rolling, and preferably at strain rates of $10^{-6}$ to $10^4$ the Dynamic Nanophase Strengthening Mechanism (Mechanism #2, FIG. 1A) is activated leading to formation of the High Strength Nanomodal Structure (Structure #3, FIG. 1A). The thickness is now preferably reduced to 0.4 mm to 3.0 mm.

The High Strength Nanomodal structure typically exhibits a ferritic matrix (alpha-Fe) which, depending on alloy chemistry, may additionally contain austenite grains (gamma-Fe) and precipitate grains which may include borides (if boron is present) and/or carbides (if carbon is present). The High Strength Nanomodal Structure typically exhibits matrix grain size of 25 nm to 50 μm and precipitate grains at a size of 1.0 to 200 nm in laboratory casting.

Steel alloys herein with the High Strength Nanomodal Structure typically exhibits the following tensile properties, yield stress from 720 to 1683 MPa, ultimate tensile strength in a range from 720 to 1973 MPa, and total ductility from 1.6 to 32.8%.

The High Strength Nanomodal Structure (Structure #3, FIG. 1A and FIG. 1B) has a capability to undergo Recrystallization (Mechanism #3, FIG. 1B) when subjected to annealing such as heating below the melting point of the alloy with transformation of ferrite grains back into austenite leading to formation of Recrystallized Modal Structure (Structure #4, FIG. 1B). Partial dissolution of nanoscale precipitates also takes place. Presence of borides and/or carbides is possible in the material depending on alloy chemistry. Preferred temperature ranges for a complete transformation occur from 650° C. and below the $T_m$ of the specific alloy. When recrystallized, the Structure #4 contains few (compared to what is found before recrystallized) dislocations or twins and stacking faults can be found in some recrystallized grains. Note that at lower temperatures from 400 to 650° C., recovery mechanisms may occur. The Recrystallized Modal Structure (Structure #4, FIG. 1B) typically exhibits a primary austenitic matrix (gamma-Fe) with grain size of 0.5 to 50 μm and precipitate grains at a size of 1.0 to 200 nm in laboratory casting. Matrix grain size and precipitate size might be larger up to a factor of 2 at commercial production depending on alloy chemistry, starting casting thickness and specific processing parameters. Grain size may therefore be in the range of 0.5 μm to 100 μm. Steel alloys herein with the Recrystallized Modal Structure typically exhibit the following tensile properties: yield stress from 142 MPa to 723 MPa, ultimate tensile strength in a range from 720 to 1490 MPa, and total ductility from 10.6 to 91.6%.

Sheet Production Through Slab Casting

Figure 1C:
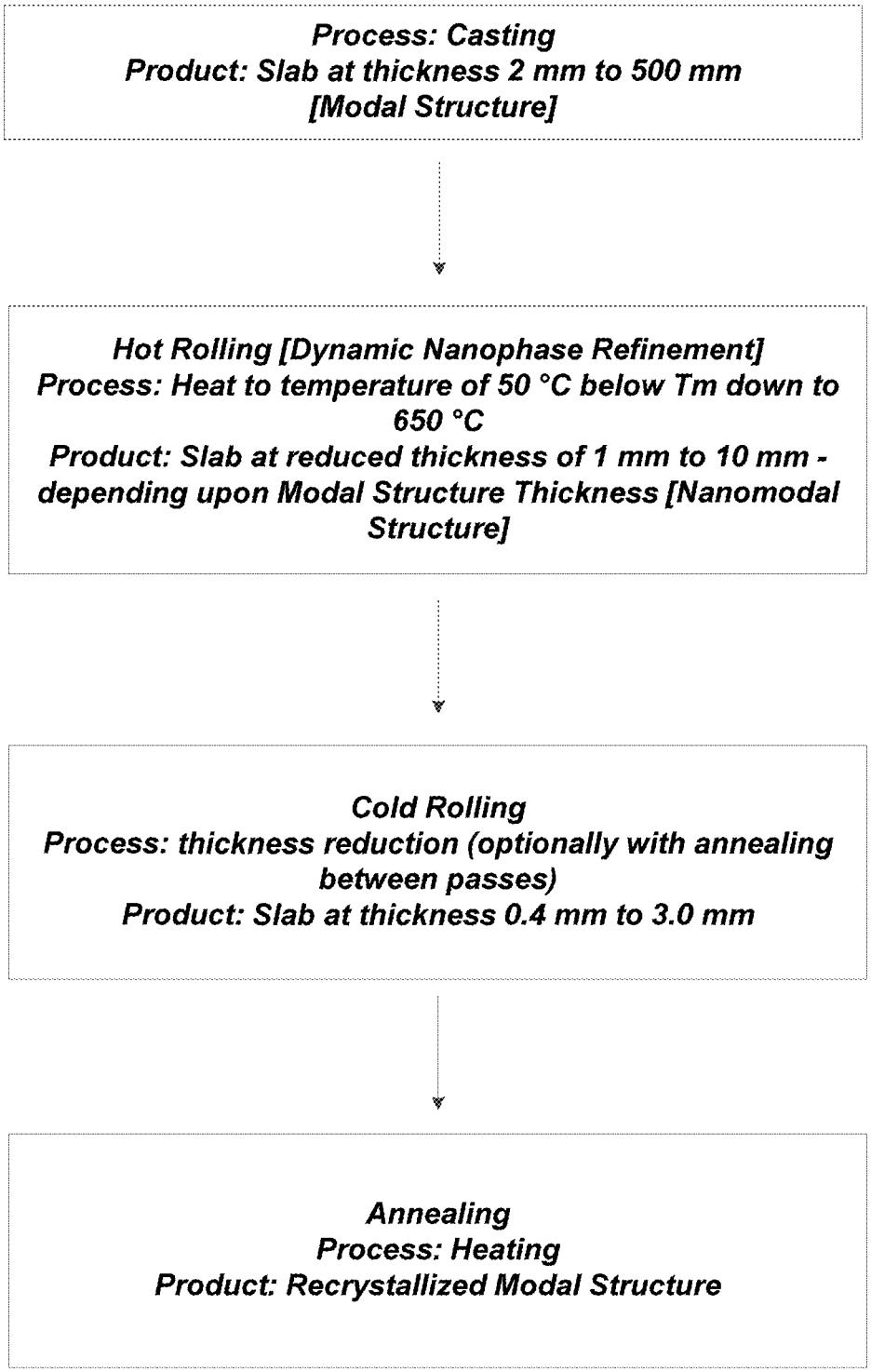

FIG. 1C now illustrates how in slab casting the mechanisms and structures in FIGS. 1A and 1B are preferably achieved. It begins with a casting procedure by melting the alloy by heating the alloys herein at temperatures in the range of above their melting point and cooling below the melting temperature of the alloy, which corresponds to preferably cooling in the range of $1\times10^3$ to $1\times10^{-3}$ K/s to form Structure 1, Modal Structure. The as-cast thickness will be dependent on the production method with Single or Dual Belt Casting typically in the range of 2 to 40 mm in thickness, Thin Slab Casting typically in the range of 20 to 150 mm in thickness and Thick Slab Casting typically in the range of greater than 150 to 500 mm in thickness. Accordingly, overall as cast thickness as previously noted may fall in the range of 2 to 500 mm, and at all values therein, in 1 mm increments. Accordingly, as cast thickness may be 2 mm, 3 mm, 4 mm, etc., up to 500 mm.

Hot rolling of solidified slabs from the Thick Slab Process, thereby providing Dynamic Nanophase Refinement, is preferably done such that the cast slabs are brought down to intermediate thickness slabs sometimes called transfer bars. The transfer bars will preferably have a thickness in the range of 50 mm to 300 mm. The transfer bars are then preferably hot rolled with a variable number of hot rolling strands, typically 1 or 2 per casting machine to produce a hot band coil, having Nanomodal Structure, which is a coil of steel, typically in the range of 1 to 10 mm in thickness. Such hot rolling is preferably applied at a temperature range of 50° C. below the solidus temperature (i.e. the melting point) down to 650° C.

In the case of Thin Slab Casting, the as-cast slabs are preferably directly hot rolled after casting to produce hot band coils typically in the range of 1 to 10 mm in thickness. Hot rolling in this situation is again preferably applied at a temperature range from 50° C. below the solidus temperature (i.e. melting point) down to 650° C. Cold rolling, corresponding to Dynamic Nanophase Strengthening, can then be used for thinner gauge sheet production that is utilized to achieve targeted thickness for particular applications. For AHSS, thinner gauges are usually targeted in the range of 0.4 mm to 3.0 mm. To achieve this gauge thicknesses, cold rolling can be applied through single or multiple passes preferably with 1 to 50% of total reduction before intermediate annealing. Cold rolling can be done in various mills including Z-mills, Z-hi mills, tandem mills, reversing mills etc. and with various numbers of rolling stands from 1 to 15. Accordingly, a gauge thickness in the range of 1 to 10 mm achieved in hot rolled coils may then be reduced to a thickness of 0.4 mm to 3.0 mm in cold rolling. Typical reduction per pass is 5 to 70% depending on the material properties and equipment capability. Preferably, the number of passes will be in the range of 1 to 8 with total reduction from 10 to 50%. After cold rolling, intermediate annealing (identified as Mechanism 3 as Recrystallization in FIG. 1B) is done and the process repeated from 1 to 9 cycles until the final gauge target is achieved. Depending on the specific process flow, especially starting thickness and the amount of hot rolling gauge reduction, annealing is preferably applied to recover the ductility of the material to allow for additional cold rolling gauge reduction. This is shown in FIG. 1*b* for example where the cold rolled High Strength Nanomodal Structure (Structure #3) is annealed below Tm to produce the Recrystallized Modal Structure (Structure #4). Intermediate coils can be annealed by utilizing conventional methods such as batch annealing or continuous annealing lines, and preferably at temperatures in the range of 600° C. up to $T_m$.

Final coils of cold rolled sheet at thicknesses herein of 0.4 mm to 3.0 mm with final targeted gauge from alloys herein can then be similarly annealed by utilizing conventional methods such as batch annealing or continuous annealing to provide Recrystallized Modal Structure. Conventional batch annealing furnaces operate in a preferred targeted range from 400 to 900° C. with long total annealing times involving a heat-up, time to a targeted temperature and a cooling rate with total times from 0.5 to 7 days. Continuous annealing preferably includes both anneal and pickle lines or continuous annealing lines and involves preferred temperatures from 600 to 1250° C. with times from 20 to 500 s of exposure. Accordingly, annealing temperatures may fall in the range of 600° C. up to Tm and for a time period of 20 s to a few days. The result of the annealing, as noted, produces what is described herein as a Recrystallized Modal Structure, or Structure #4 as illustrated in FIG. 1B.

Laboratory simulation of the above sheet production from slabs at each step of processing is described herein. Alloy property evolution through processing is demonstrated in Case Example #1.

Microstructures in the Final Sheet Product (Annealed Coils)

Alloys herein after processing into annealed sheet with thickness of 0.4 mm to 3.0 mm, and preferably at or below 2 mm, forms what is identified herein as Recrystallized Modal Structure that typically exhibits a primary austenitic matrix (gamma-Fe) with grain size of 0.5 to 100 μm and precipitate grains at a size of 1.0 nm to 200 nm in laboratory casting. Some ferrite (alpha-Fe) might be present depending on alloy chemistry and can generally range from 0 to 50%. Matrix grain size and precipitate size might be larger up to a factor of 2 at commercial production depending on alloy chemistry, starting casting thickness and specific processing parameters. The matrix grains are contemplated herein to fall in the range from 0.5 to 100 μm in size. Steel alloys herein with the Recrystallized Modal Structure typically exhibit the following tensile properties: yield stress from 142 to 723 MPa, ultimate tensile strength in a range from 720 to 1490 MPa, and total ductility from 10.6 to 91.6%.

When the steel alloys herein with Recrystallized Modal Structure (Structure #4, FIG. 2), having a magnetic phase volume of 0 to 10%, undergo a deformation due to drawing, where drawing is reference to an elongation of the alloy with an applied stress, it has been recognized herein that this may occur under either of two conditions. Specifically, the drawing may be applied at a speed of less than a critical speed ($<S_{CR}$) or at a speed that is greater than or equal to such critical speed ($\geq S_{CR}$). Or, the Recrystallized Modal Structure may be drawn under a draw ratio greater than a critical draw ratio ($D_{CR}$) or at a draw ratio that is less than or equal to a critical draw ratio ($D_{CR}$). See again, FIG. 2. Draw ratio is defined herein as the diameter of the blank divided by the diameter of the punch when a full cup is formed (i.e. without a flange).

In addition, it has been found that when one draws at a speed that is less than a critical speed ($<S_{CR}$), or at a draw ratio greater than a critical draw ratio ($>D_{CR}$), the level of magnetic phase volume originally present (0 to 10%) will increase to an amount "V1", where "V1" is in the range of greater than 10% to 60%. Alternatively, if one draws at a speed that is greater than or equal to critical speed ($\geq S_{CR}$), or at a draw ratio that is less than or equal to a critical draw ratio ($\leq D_{CR}$), the magnetic phase volume will provide an amount "V2", where V2 is in the range of 1% to 40%.

Figure 3:
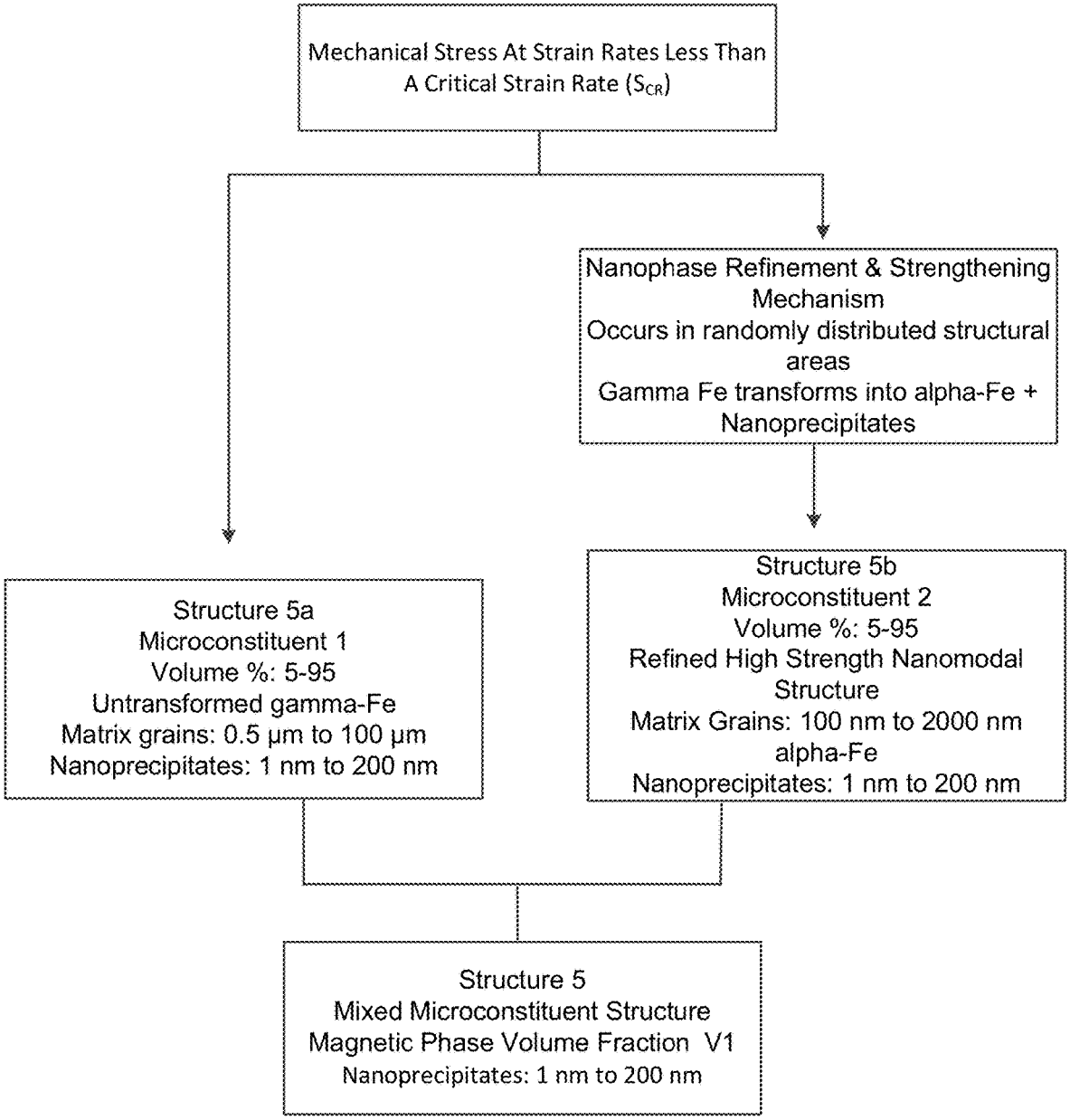
FIG. 3 Known pathway of structural development under stress in alloys herein.

FIG. 3 illustrates what occurs when alloys herein with Recrystallized Modal Structure undergo a drawing that is less than $S_{CR}$ or at a draw ratio that is greater than a critical draw ratio $D_{CR}$, and two microconstituents are formed identified as Microconstituent 1 and Microconstituent 2. Formation of these two microconstituents is dependent on the stability of the austenite and two types of mechanisms: Nanophase Refinement & Strengthening Mechanism and Dislocation Based Mechanisms.

Alloys herein with the Recrystallized Modal Structure is such that it contains areas with relatively stable austenite meaning that it is unavailable for transformation into a ferrite phase during deformation and areas with relatively unstable austenite, meaning that it is available for transformation into ferrite upon plastic deformation. Upon deformation at a draw speed that is less than $S_{CR}$, or at a draw ratio that is greater than a critical draw ratio ($D_{CR}$), areas with relatively stable austenite retain the austenitic nature and described as Structure #5a (FIG. 3) that represents Microconstituent 1 in the final Mixed Microconstituent Structure (Structure #5, FIG. 3). The untransformed part of the microstructure (FIG. 3, Structure #5a) is represented by austenitic grains (gamma-Fe) which are not refined and typically with a size from 0.5 to 100 μm. It should be noted that untransformed austenite in Structure #5a is contemplated to deform through plastic deformation through the formation of three dimensional arrays of dislocations. Dislocations are understood as a metallurgical term which is a crystallographic defect or irregularity within a crystal structure which aids the deformation process while allowing the material to break small numbers of metallurgical bonds rather than the entire bonds in a crystal. These highly deformed austenitic grains contain a relatively large density of dislocations which can form dense tangles of dislocations arranged in cells due to existing known dislocation processes occurring during deformation resulting in high fraction of dislocations.

The areas with relatively unstable austenite undergo transformation into ferrite upon deformation at a speed that is less than $S_{CR}$ or at a draw ratio greater than $D_{CR}$ forming Structure #5b (FIG. 3) that represents Microconstituent 2 in the final Mixed Microconstituent Structure (Structure #5, FIG. 3). Nanophase Refinement takes place in these areas leading to the formation of the Refined High Strength Nanomodal Structure (Structure #5b, FIG. 3). Thus, the transformed part of the microstructure (FIG. 3, Structure #5b) is represented by refined ferrite grains (alpha-Fe) with additional precipitates formed through Nanophase Refinement & Strengthening (Mechanism #1, FIG. 2). The size of refined grains of ferrite (alpha-Fe) varies from 100 to 2000 nm and size of precipitates is in a range from 1.0 to 200 nm in laboratory casting. The overall size of the matrix grains in Structure 5a and Structure 5b therefore typically varies from 0.1 μm to 100 μm. Preferably, the stress to initiate this transformation is in the range of >142 MPa to 723 MPa. Nanophase Refinement & Strengthening mechanism (FIG. 3) leading to Structure #5b formation is therefore a dynamic process during which the metastable austenitic phase transforms into ferrite with precipitate resulting generally in grain refinement (i.e. reduction in grain size) of the matrix phase. It occurs in the randomly distributed structural areas where austenite is relatively unstable as described earlier. Note that after phase transformation, the newly formed ferrite grains deform through dislocation mechanisms as well and contribute to the total ductility measured.

Figure 2:
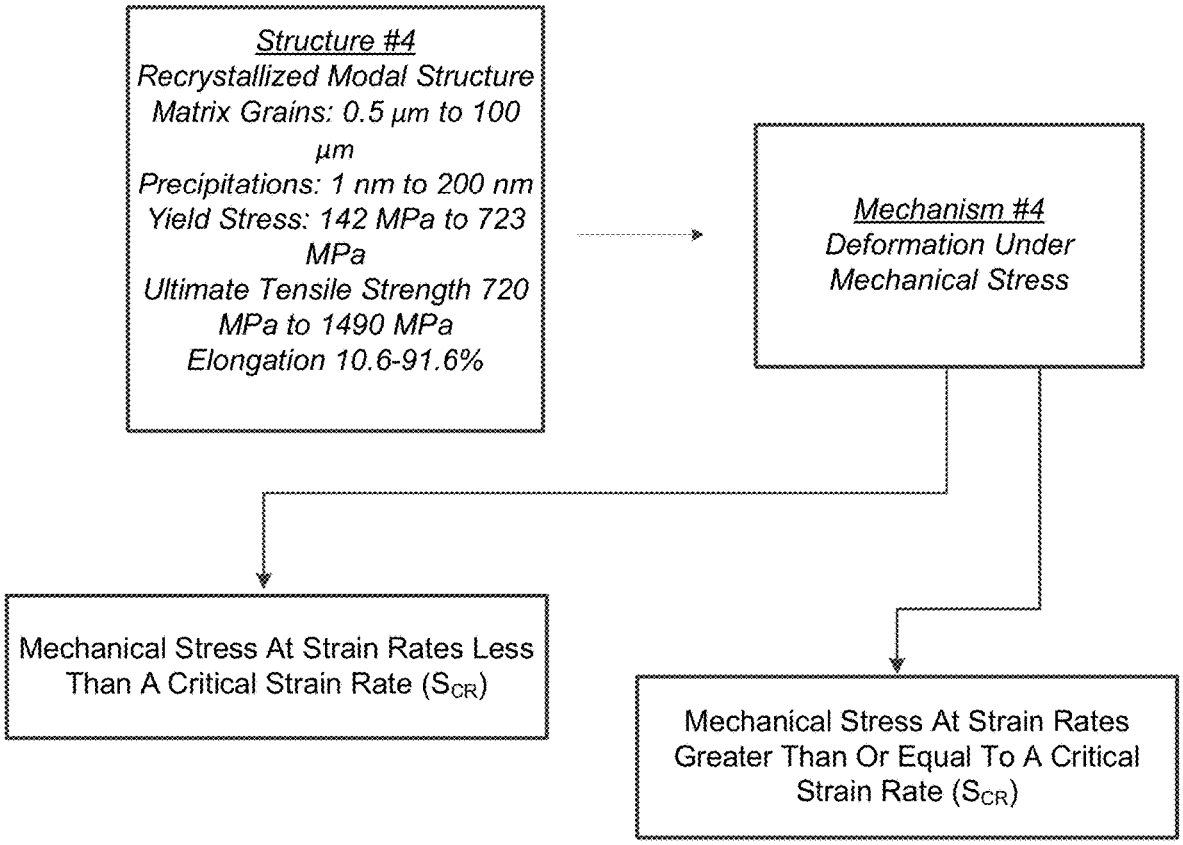
FIG. 2 Two pathways of structural development under stress in alloys herein at speed below $S_{CR}$ and equal or above $S_{CR}$.

The resulting volume fraction of each microconstituent (Structure #5a vs Structure #5b) in the Mixed Microconstituent Structure (Structure #5, FIG. 3) depends on alloy chemistry and processing parameter toward initial Recrystallized Modal Structure formation. Typically, as low as 5 volume percent and as high as 75 volume percent of the alloy structure will transform in the distributed structural areas forming Microconstituent 2 with the remainder remaining untransformed representing Microconstituent 1. Thus, Microconstituent 2 can be in all individual volume percent values from 5 to 75 in 0.1% increments (i.e. 5.0%, 5.1%, 5.2%, . . . up to 75.0%) while Microconstituent 1 can be in volume percent values from 75 to 5 in 0.1% increments (i.e. 75.0%, 74.9%, 74.8% . . . down to 5.0%). The presence of borides (if boron is present) and/or carbides (if carbon is present) is possible in the material depending on alloy chemistry. The volume percent of precipitations indicated in Structure #4 of FIG. 2 is anticipated to be 0.1 to 15%. While the magnetic properties of these precipitates are difficult to individually measure, it is contemplated that they are non-magnetic and thus do not contribute to the measured magnetic phase volume % (Fe %).

As alluded to above, for a given alloy, one may control the volume fraction of the transformed (Structure #5b) vs untransformed (Structure #5a) areas by selecting and adjusting the alloy chemistry towards different levels of austenite stability. The general trend is that with the addition of more austenite stabilizing elements, the resulting volume fraction of Microconstituent 1 will increase. Examples of austenite stabilizing elements would include nickel, manganese, copper, aluminum and/or nitrogen. Note that nitrogen may be found as an impurity element from the atmosphere during processing.

In addition, it is noted that as ferrite is magnetic, and austenite is non-magnetic, the volume fraction of the magnetic phase present provides a convenient method to evaluate the relative presence of Structure #5a or Structure #5b. As therefore noted in FIG. 3, Structure #5 is indicated to have a magnetic phase volume $V_1$ corresponding to content of Microconstituent 2 and falls in the range from >10 to 60%. The magnetic phase volume is sometimes abbreviated herein as Fe %, which should be understood as a reference to the presence of ferrite and any other components in the alloy that identifies a magnetic response. Magnetic phase volume herein is conveniently measured by a feritscope. The feritscope uses the magnetic induction method with a probe placed directly on the sheet sample and provides a direct reading of the total magnetic phases volume % (Fe %).

Microstructure in fully processed and annealed sheet corresponding to a condition of the sheet in annealed coils at commercial production and microstructural development through deformation are demonstrated in Case Examples #2 & #3 for selected alloys herein.

Delayed Fracture

Steel alloys herein have shown to undergo hydrogen assisted delayed fracture after drawing whereby steel blanks are drawn into a forming die through the action of a punch. Unique structural formation during deformation in steel alloys contained herein undergoes a pathway that includes formation of the Mixed Microconstituent Structure with the structural formation pathway provided in FIG. 3. What has been found is that when the volume fraction of Microconstituent 2 reaches a certain value, measured by the magnetic phase volume, delayed cracking occurs. The amount of magnetic phase volume percent for delayed cracking contains >10% by volume or more, or typically from greater than 10% to 60% volume fraction of magnetic phases. By increasing speed to at or over the critical speed ($S_{CR}$), the amount of magnetic phase volume percent is reduced to 1% to 40% and delayed cracking is reduced or avoided. Reference to delayed cracking herein is reference to the feature that the alloys are such that they will not crack after exposure at ambient temperature to air for 24 hours at and/or after exposure to 100% hydrogen for 45 minutes.

It is contemplated that the delayed cracking occurs through a distinctive mechanism known as transgranular cleavage whereby certain metallurgical planes in the transformed ferrite grains are weakened to the point where they separate causing crack initiation and then propagation through the grains. It is contemplated that this weakening of specific planes within the grains is assisted by hydrogen diffusion into these planes. The volume fraction of Microconstituent 2 resulting in delayed cracking depends on the alloy chemistry, the drawing conditions, and the surrounding environment such as normal air or a pure hydrogen environment, as disclosed herein. The volume fraction of Microconstituent 2 can be determined by the magnetic phase volume since the starting grains are austenitic and are thus non-magnetic and the transformed grains are mostly ferritic (magnetic) (although it is contemplated that there could be some alpha-martensite or epsilon martensite). As the transformed matrix phases including alpha-iron and any martensite are all magnetic, this volume fraction can thus be monitored through the resulting Magnetic Phase Volume ($V_1$).

Delayed fracture in steel alloys herein in a case of cup drawing at conditions currently utilized by the steel industry is shown for selected alloys in Case Example #4 with hydrogen content analysis in the drawn cups as described in Case Example #5 and fracture analysis presented in Case Example #6. Structural transformation in drawn cups was analyzed by SEM and TEM and described in Case Example #7.

Drawing is a unique type of deformation process since unique stress states are formed during deformation. During a drawing operation, a blank of sheet metal is restrained at the edges, and an internal section is forced by a punch into a die to stretch the metal into a drawn part which can be various shapes including circular, square rectangular, or just about any cross-section dependent on the die design. The drawing process can be either shallow or deep depending on the amount of deformation applied and what is desired on a complex stamped part. Shallow drawing is used to describe the process where the depth of draw is less than the internal diameter of the draw. Drawing to a depth greater than the internal diameter is called deep drawing.

Drawing herein of the identified alloys may preferably be achieved as part of a progressive die stamping operation. Progressive die stamping is reference to a metalworking method which pushed a strip of metal through the one or more stations of a stamping die. Each station may perform one or more operations until a finished part is produced. Accordingly, the progressive die stamping operation may include a single step operation or involve a plurality of steps.

Figure 4A:
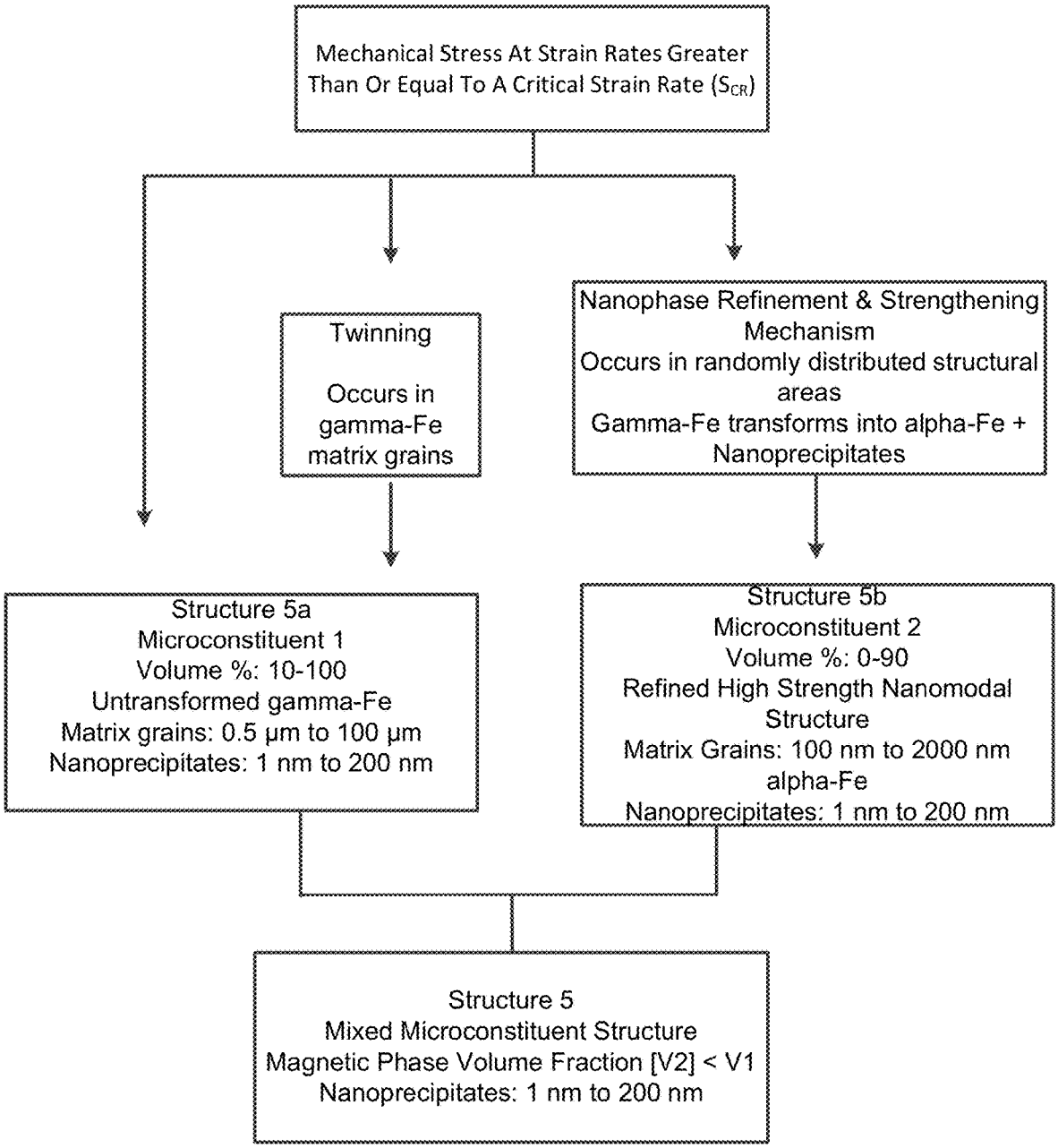
FIG. 4A New pathway of structural development at high speed deformation.
Figure 4B:
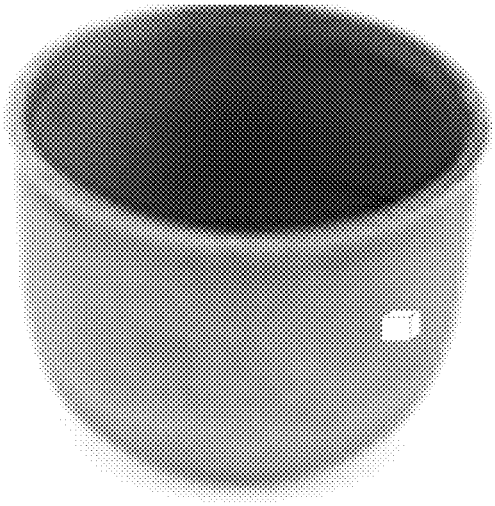
FIGS. 4B-4C Illustrates in (4B) a drawn cup and in (4C) representative stresses in the cup due to drawing.
Figure 4C:
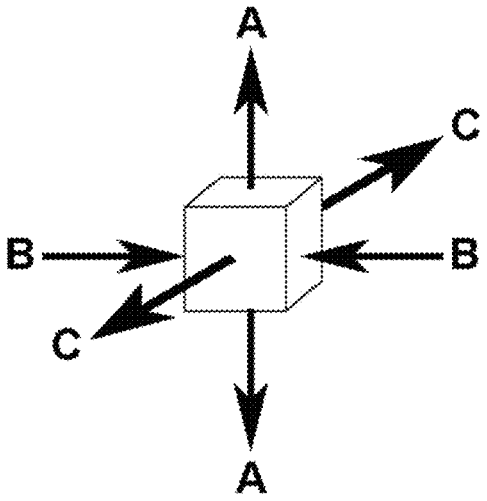

The draw ratio during drawing can be defined as the diameter of the blank divided by the diameter of the punch when a full cup is formed (i.e. without a flange). During the draw process, the metal of the blank needs to bend with the impinging die and then flow down the die wall. This creates, unique stress states especially in the sidewall area of the drawn piece which can results in triaxial stress state including longitudinal tensile, hoop tensile, and transverse compressive stresses. See FIG. 4A which in (a) provides an image of drawn cup with an example of a block of material existing in the sidewall (small cube) and in (b) illustrates stresses found in the sidewall of the drawn material (blown up cube) which include longitudinal tensile (A), transverse compressive (B), and hoop tensile stresses (C).

These stress conditions can then lead to favorable sites for hydrogen diffusion and accumulation potentially leading to cracking which can occur immediately during forming or afterward (i.e. delayed cracking) due to hydrogen diffusion at ambient temperature. Thus, the drawing process may have a substantial effect on delayed fracture in steel alloys herein for example in Case Examples #8 and #9.

Susceptibility to delayed cracking in the alloys herein decreases (i.e. probability to exhibit cracking) with increasing drawing speed or reductions in drawing ratio due to a shift of deformation pathway as described in FIG. 4. A decrease in the total magnetic phase volume (i.e. the total volume fraction of magnetic phases which may include ferrite, epsilon martensite, alpha martensite or any combination of these phases) with increasing speed to or above $S_{CR}$ is shown in Case Example #10. Conventional steel grades, such as DP980, do not show draw speed dependence on structure or performance as shown in Case Example #11.

New Pathway of Structural Development to Prevent Delayed Cracking

A new phenomenon that is a subject of the current disclosure is the change in the amount of Microconstituent 1 and 2 present and the resulting magnetic phase volume percent (Fe %) as described in FIG. 3 and FIG. 4. Under certain conditions of drawing which are both speed and draw ratio dependent, the transformation from Structure #4 (Recrystallized Modal Structure) into Structure #5 (Mixed Microconstituent Structure) can occur in one of two ways as provided in the overview of FIG. 2. A feature of this is that the identified drawing conditions result in a total magnetic phases volume % (Fe %) provided in Structure #5 of FIG. 4 which is less than the magnetic phases volume % (Fe %) in Structure #5 of FIG. 3.

As provided in FIG. 4, it is contemplated for the alloys herein that under the drawing conditions provided in FIG. 4, twinning occurs in austenitic matrix grains. Note that twinning is a metallurgical mode of deformation whereby new crystals with different orientation are created out of a parent phase separated by a mirror plane called a twin boundary. These twinned regions in Microconstituent 1 do not then undergo transformation which means that the volume fraction of Microconstituent 1 is increased and the volume fraction of Microconstituent 2 is correspondingly decreased. The resulting total magnetic phase volume percent (Fe %) for the preferred method of drawing as provided in FIG. 4 is 1 to 40 Fe %. Thus, through increasing draw speed, delayed cracking in alloys herein can be reduced or avoided but nevertheless they can be deformed and exhibit improved cold formability (Case Example #9).

Commercial steel grades, such as DP980 do not show draw speed dependence of neither structure nor performance as shown in Case Example #11.

Figure 25:
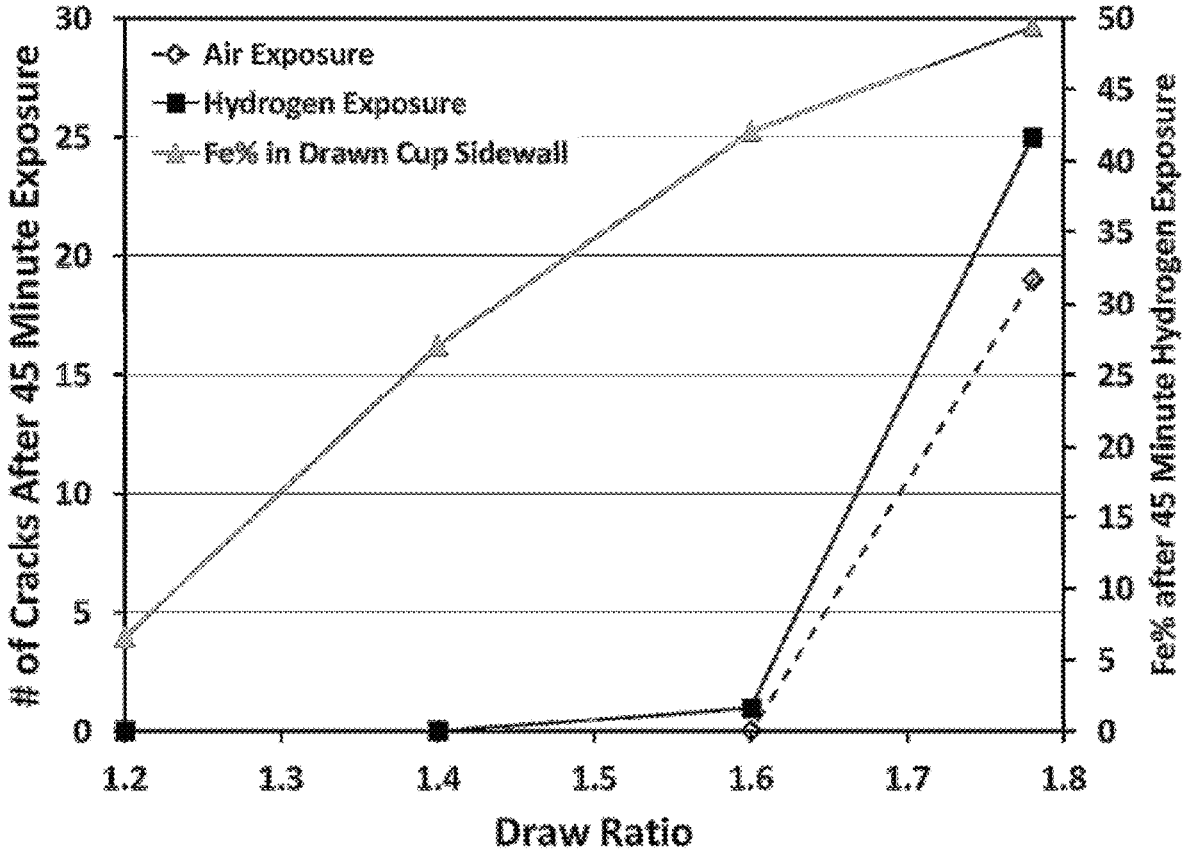
FIG. 25 Draw ratio dependence of delayed cracking in drawn cups from Alloy 1 in hydrogen. Note that at 1.4 draw ratio, no delayed cracking occurs, and at 1.6 draw ratio, only very minimal delayed cracking occurs.

In addition, in the broad context of the present invention, it has also been observed that one should preferably achieve a final magnetic phase volume that is 1% to 40% Accordingly, regardless of whether one draws at a speed that is below the critical draw speed, $S_{CR}$, or at a draw ratio greater than the critical draw ratio, $D_{CR}$, or at or above $S_{CR}$ or less than or equal to $D_{CR}$, the alloy should be one that limits the final magnetic phase volume to 1% to 40% In this situation, again, delayed cracking herein is reduced and/or eliminated. This is provided for example in Case Example #8 with Alloy 14 and shown in FIG. 29, where delayed cracking was not observed even at low draw speeds (0.8 mm/s). Additional examples are for Alloy 42 in FIG. 28 and Alloy 9 in FIG. 27 at draw ratios 1.4 and below and Alloy 1 in FIG. 25 at draw ratios 1.2 and below.

Sheet Alloys: Chemistry & Properties

The chemical composition of the alloys herein is shown in Table 1, which provides the preferred atomic ratios utilized.

TABLE 1

Alloy Chemical Composition

| Alloy | Fe | Cr | Ni | Mn | Cu | B | Si | C | Al |
|---|---|---|---|---|---|---|---|---|---|
| Alloy 1 | 75.75 | 2.63 | 1.19 | 13.86 | 0.65 | 0.00 | 5.13 | 0.79 | 0.00 |
| Alloy 2 | 73.99 | 2.63 | 1.19 | 13.18 | 1.55 | 1.54 | 5.13 | 0.79 | 0.00 |
| Alloy 3 | 77.03 | 2.63 | 3.79 | 9.98 | 0.65 | 0.00 | 5.13 | 0.79 | 0.00 |
| Alloy 4 | 78.03 | 2.63 | 5.79 | 6.98 | 0.65 | 0.00 | 5.13 | 0.79 | 0.00 |
| Alloy 5 | 78.53 | 2.63 | 3.79 | 8.48 | 0.65 | 0.00 | 5.13 | 0.79 | 0.00 |
| Alloy 6 | 74.75 | 2.63 | 1.19 | 14.86 | 0.65 | 0.00 | 5.13 | 0.79 | 0.00 |
| Alloy 7 | 75.25 | 2.63 | 1.69 | 13.86 | 0.65 | 0.00 | 5.13 | 0.79 | 0.00 |
| Alloy 8 | 74.25 | 2.63 | 1.69 | 14.86 | 0.65 | 0.00 | 5.13 | 0.79 | 0.00 |
| Alloy 9 | 73.75 | 2.63 | 1.19 | 15.86 | 0.65 | 0.00 | 5.13 | 0.79 | 0.00 |
| Alloy 10 | 77.75 | 2.63 | 1.19 | 11.86 | 0.65 | 0.00 | 5.13 | 0.79 | 0.00 |
| Alloy 11 | 74.75 | 2.63 | 2.19 | 13.86 | 0.65 | 0.00 | 5.13 | 0.79 | 0.00 |
| Alloy 12 | 73.75 | 2.63 | 3.19 | 13.86 | 0.65 | 0.00 | 5.13 | 0.79 | 0.00 |
| Alloy 13 | 74.11 | 2.63 | 2.19 | 13.86 | 1.29 | 0.00 | 5.13 | 0.79 | 0.00 |
| Alloy 14 | 72.11 | 2.63 | 2.19 | 15.86 | 1.29 | 0.00 | 5.13 | 0.79 | 0.00 |
| Alloy 15 | 78.25 | 2.63 | 0.69 | 11.86 | 0.65 | 0.00 | 5.13 | 0.79 | 0.00 |
| Alloy 16 | 74.25 | 2.63 | 1.19 | 14.86 | 1.15 | 0.00 | 5.13 | 0.79 | 0.00 |
| Alloy 17 | 74.82 | 2.63 | 1.50 | 14.17 | 0.96 | 0.00 | 5.13 | 0.79 | 0.00 |
| Alloy 18 | 75.75 | 1.63 | 1.19 | 14.86 | 0.65 | 0.00 | 5.13 | 0.79 | 0.00 |
| Alloy 19 | 77.75 | 2.63 | 1.19 | 13.86 | 0.65 | 0.00 | 3.13 | 0.79 | 0.00 |
| Alloy 20 | 76.54 | 2.63 | 1.19 | 13.86 | 0.65 | 0.00 | 5.13 | 0.00 | 0.00 |
| Alloy 21 | 67.36 | 10.70 | 1.25 | 10.56 | 1.00 | 5.00 | 4.13 | 0.00 | 0.00 |
| Alloy 22 | 71.92 | 5.45 | 2.10 | 8.92 | 1.50 | 6.09 | 4.02 | 0.00 | 0.00 |
| Alloy 23 | 61.30 | 18.90 | 6.80 | 0.90 | 0.00 | 5.50 | 6.60 | 0.00 | 0.00 |
| Alloy 24 | 71.62 | 4.95 | 4.10 | 6.55 | 2.00 | 3.76 | 7.02 | 0.00 | 0.00 |
| Alloy 25 | 62.88 | 16.00 | 3.19 | 11.36 | 0.65 | 0.00 | 5.13 | 0.79 | 0.00 |
| Alloy 26 | 72.50 | 2.63 | 0.00 | 15.86 | 1.55 | 1.54 | 5.13 | 0.79 | 0.00 |
| Alloy 27 | 80.19 | 0.00 | 0.95 | 13.28 | 1.66 | 2.25 | 0.88 | 0.79 | 0.00 |
| Alloy 28 | 77.65 | 0.67 | 0.08 | 13.09 | 1.09 | 0.97 | 2.73 | 3.72 | 0.00 |
| Alloy 29 | 78.54 | 2.63 | 1.19 | 13.86 | 0.65 | 0.00 | 3.13 | 0.00 | 0.00 |
| Alloy 30 | 75.30 | 2.63 | 1.34 | 14.01 | 0.80 | 0.00 | 5.13 | 0.79 | 0.00 |
| Alloy 31 | 74.85 | 2.63 | 1.49 | 14.16 | 0.95 | 0.00 | 5.13 | 0.79 | 0.00 |
| Alloy 32 | 78.38 | 0.00 | 1.19 | 13.86 | 0.65 | 0.00 | 5.13 | 0.79 | 0.00 |
| Alloy 33 | 75.73 | 2.63 | 1.19 | 13.86 | 0.65 | 0.02 | 5.13 | 0.79 | 0.00 |
| Alloy 34 | 76.41 | 1.97 | 1.19 | 13.86 | 0.65 | 0.00 | 5.13 | 0.79 | 0.00 |
| Alloy 35 | 77.06 | 1.32 | 1.19 | 13.86 | 0.65 | 0.00 | 5.13 | 0.79 | 0.00 |
| Alloy 36 | 77.06 | 2.63 | 1.19 | 13.86 | 0.65 | 0.00 | 3.82 | 0.79 | 0.00 |
| Alloy 37 | 77.46 | 2.63 | 1.19 | 13.86 | 0.65 | 0.00 | 3.42 | 0.79 | 0.00 |
| Alloy 38 | 77.39 | 2.30 | 1.19 | 13.86 | 0.65 | 0.00 | 3.82 | 0.79 | 0.00 |
| Alloy 39 | 77.79 | 2.30 | 1.19 | 13.86 | 0.65 | 0.00 | 3.42 | 0.79 | 0.00 |
| Alloy 40 | 77.72 | 1.97 | 1.19 | 13.86 | 0.65 | 0.00 | 3.82 | 0.79 | 0.00 |
| Alloy 41 | 78.12 | 1.97 | 1.19 | 13.86 | 0.65 | 0.00 | 3.42 | 0.79 | 0.00 |
| Alloy 42 | 74.73 | 2.63 | 1.19 | 14.86 | 0.65 | 0.02 | 5.13 | 0.79 | 0.00 |
| Alloy 43 | 73.05 | 0.58 | 1.19 | 13.86 | 0.00 | 4.66 | 0.65 | 0.89 | 5.12 |
| Alloy 44 | 75.48 | 1.55 | 2.69 | 12.35 | 0.00 | 3.46 | 0.88 | 0.38 | 3.21 |
| Alloy 45 | 72.05 | 2.98 | 1.19 | 13.86 | 3.66 | 4.23 | 0.20 | 0.00 | 1.83 |

As can be seen from the Table 1, the alloys herein are iron based metal alloys, having greater than 50 at. % Fe, more preferably greater than 60 at. % Fe. Most preferably, the alloys herein can be described as comprising, consisting essentially of, or consisting of the following elements at the indicated atomic percents: Fe (61.30 to 80.19 at. %); Si (0.2 to 7.02 at. %); Mn (0 to 15.86 at. %); B (0 to 6.09 at. %); Cr (0 to 18.90 at. %); Ni (0 to 6.80 at. %); Cu (0 to 3.66 at. %); C (0 to 3.72 at. %); Al (0 to 5.12 at. %). In addition, it can be appreciated that the alloys herein are such that they comprise Fe and at least four or more, or five or more, or six or more elements selected from Si, Mn, B, Cr, Ni, Cu, Al or C. Most preferably, the alloys herein are such that they comprise, consist essentially of, or consist of Fe at a level of 60 at. % or greater along with Si, Mn, B, Cr, Ni, Cu, Al and C.

Laboratory processing of the alloys herein was done to model each step of industrial production but on a much smaller scale. Key steps in this process include the following: casting, tunnel furnace heating, hot rolling, cold rolling, and annealing.

Casting

Figure 5A:
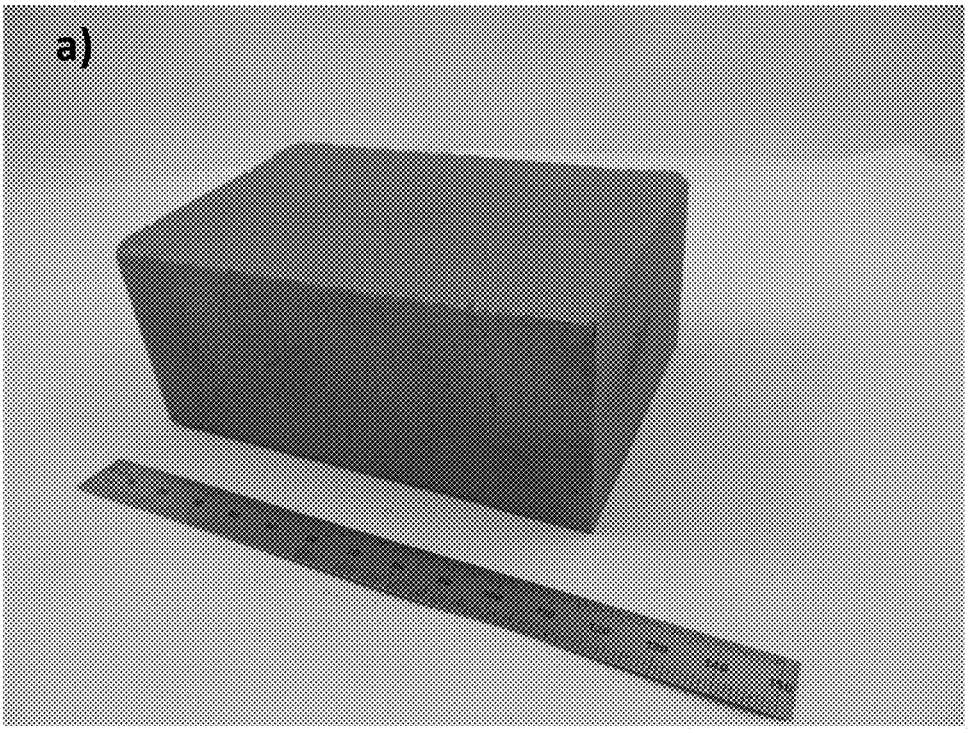
FIGS. 5A and 5B Images of laboratory cast 50 mm slabs from a) Alloy 6 and b) Alloy 9.
Figure 5B:
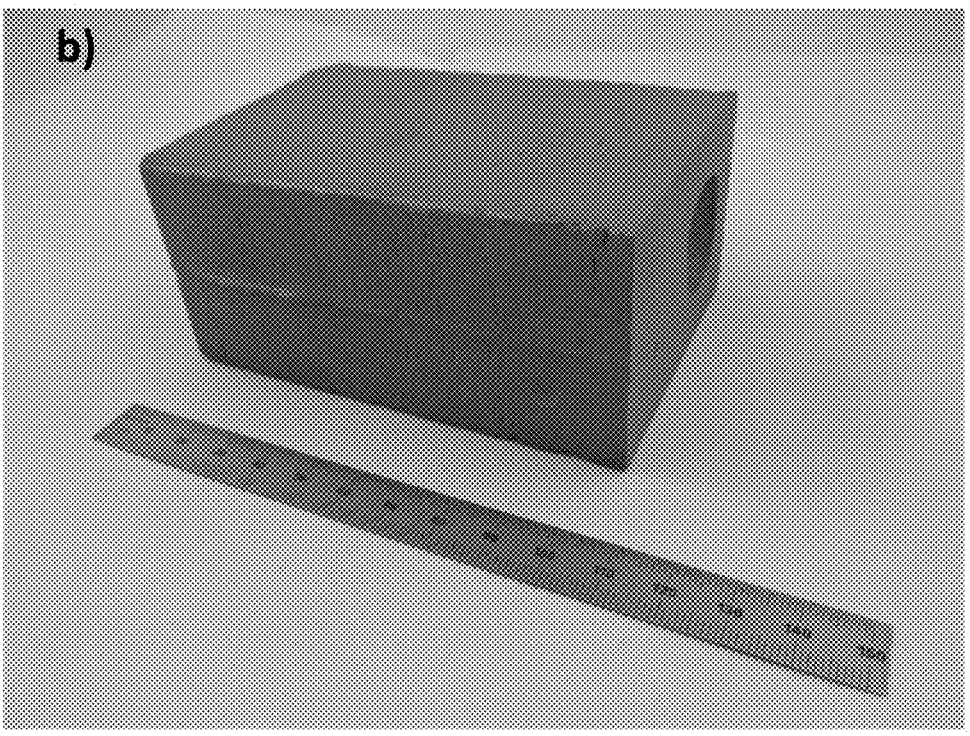

Alloys were weighed out into charges ranging from 3,000 to 3,400 grams using commercially available ferroadditive powders with known chemistry and impurity content according to corresponding atomic ratios in Table 1. Charges were loaded into zirconia coated silica crucibles which was placed into an Indutherm VTC800V vacuum tilt casting machine. The machine then evacuated the casting and melting chambers and then backfilled with argon to atmospheric pressure several times prior to casting to prevent oxidation of the melt. The melt was heated with a 14 kHz RF induction coil until fully molten, approximately 5.25 to 6.5 minutes depending on the alloy composition and charge mass. After the last solids were observed to melt it was kept at temperature for an additional 30 to 45 seconds to provide superheat and ensure melt homogeneity. The casting machine then evacuated the melting and casting chambers, tilted the crucible and poured the melt into a 50 mm thick, 75 to 80 mm wide, and 125 mm cup channel in a water cooled copper die. The melt was allowed to cool under vacuum for 200 seconds before the chamber was filled with argon to atmospheric pressure. Example pictures of laboratory cast slabs from two different alloys are shown in FIG. 5.

Thermal Properties

Thermal analysis of the alloys herein was performed on as-solidified cast slabs using a Netzsch Pegasus 404 Differential Scanning calorimeter (DSC). Samples of alloys were loaded into alumina crucibles which were then loaded into the DSC. The DSC then evacuated the chamber and backfilled with argon to atmospheric pressure. A constant purge of argon was then started, and a zirconium getter was installed in the gas flow path to further reduce the amount of oxygen in the system. The samples were heated until completely molten, cooled until completely solidified, then reheated at 10° C./min through melting. Measurements of the solidus, liquidus, and peak temperatures were taken from the second melting in order to ensure a representative measurement of the material in an equilibrium state. In the alloys listed in Table 1, melting occurs in one or multiple stages with initial melting from ~1111° C. depending on alloy chemistry and final melting temperature up to 1440° C. (Table 2). Variations in melting behavior reflect phase formation at solidification of the alloys depending on their chemistry.

TABLE 2

Differential Thermal Analysis Data for Melting Behavior

| Alloy | Solidus Temperature (° C.) | Liquidus Temperature (° C.) | Melting Peak #1 (° C.) | Melting Peak #2 (° C.) | Melting Peak #3 (° C.) | Gap (° C.) |
|---|---|---|---|---|---|---|
| Alloy 1 | 1390 | 1448 | 1439 | — | — | 58 |
| Alloy 2 | 1157 | 1410 | 1177 | 1401 | — | 253 |
| Alloy 3 | 1411 | 1454 | 1451 | — | — | 43 |
| Alloy 4 | 1400 | 1460 | 1455 | — | — | 59 |
| Alloy 5 | 1416 | 1462 | 1458 | — | — | 46 |
| Alloy 6 | 1385 | 1446 | 1441 | — | — | 61 |
| Alloy 7 | 1383 | 1442 | 1437 | — | — | 60 |
| Alloy 8 | 1384 | 1445 | 1442 | — | — | 62 |
| Alloy 9 | 1385 | 1443 | 1435 | — | — | 58 |
| Alloy 10 | 1401 | 1459 | 1451 | — | — | 58 |
| Alloy 11 | 1385 | 1445 | 1442 | — | — | 61 |
| Alloy 12 | 1386 | 1448 | 1441 | — | — | 62 |
| Alloy 13 | 1384 | 1439 | 1435 | — | — | 55 |
| Alloy 14 | 1376 | 1442 | 1435 | — | — | 66 |
| Alloy 15 | 1395 | 1456 | 1431 | 1449 | 1453 | 61 |
| Alloy 16 | 1385 | 1437 | 1432 | — | — | 52 |
| Alloy 17 | 1374 | 1439 | 1436 | — | — | 65 |
| Alloy 18 | 1391 | 1442 | 1438 | — | — | 51 |
| Alloy 19 | 1408 | 1461 | 1458 | — | — | 54 |
| Alloy 20 | 1403 | 1452 | 1434 | 1448 | — | 49 |
| Alloy 21 | 1219 | 1349 | 1246 | 1314 | 1336 | 131 |
| Alloy 22 | 1186 | 1335 | 1212 | 1319 | — | 149 |
| Alloy 23 | 1246 | 1327 | 1268 | 1317 | — | 81 |
| Alloy 24 | 1179 | 1355 | 1202 | 1344 | — | 176 |
| Alloy 25 | 1336 | 1434 | 1353 | 1431 | — | 98 |
| Alloy 26 | 1158 | 1402 | 1176 | 1396 | — | 244 |
| Alloy 27 | 1159 | 1448 | 1168 | 1439 | — | 289 |
| Alloy 28 | 1111 | 1403 | 1120 | 1397 | — | 293 |
| Alloy 29 | 1436 | 1476 | 1464 | — | — | 40 |
| Alloy 30 | 1397 | 1448 | 1445 | — | — | 51 |
| Alloy 31 | 1394 | 1444 | 1441 | — | — | 51 |
| Alloy 32 | 1392 | 1448 | 1443 | — | — | 56 |
| Alloy 33 | 1395 | 1441 | 1438 | — | — | 46 |
| Alloy 34 | 1393 | 1446 | 1440 | — | — | 52 |
| Alloy 35 | 1391 | 1445 | 1441 | — | — | 54 |
| Alloy 36 | 1440 | 1453 | 1449 | — | — | 13 |
| Alloy 37 | 1403 | 1459 | 1455 | — | — | 56 |
| Alloy 38 | 1398 | 1455 | 1450 | — | — | 57 |
| Alloy 39 | 1402 | 1459 | 1454 | — | — | 56 |
| Alloy 40 | 1398 | 1455 | 1452 | — | — | 57 |
| Alloy 41 | 1400 | 1458 | 1455 | — | — | 58 |
| Alloy 42 | 1398 | 1439 | 1435 | — | — | 41 |
| Alloy 43 | 1355 | 1436 | 1373 | 1429 | — | 81 |
| Alloy 44 | 1398 | >1450 | 1414 | — | — | N/A |
| Alloy 45 | 1163 | 1372 | 1191 | 1359 | — | 209 |

Hot Rolling

Prior to hot rolling, laboratory slabs were loaded into a Lucifer EHS3GT-B18 furnace to heat. The furnace set point varies between 1100° C. to 1250° C. depending on alloy melting point $T_m$ with furnace temperature set at −50° C. below $T_m$. The slabs were allowed to soak for 40 minutes prior to hot rolling to ensure that they reach the target temperature. Between hot rolling passes the slabs are returned to the furnace for 4 minutes to allow the slabs to reheat.

Figure 6A:
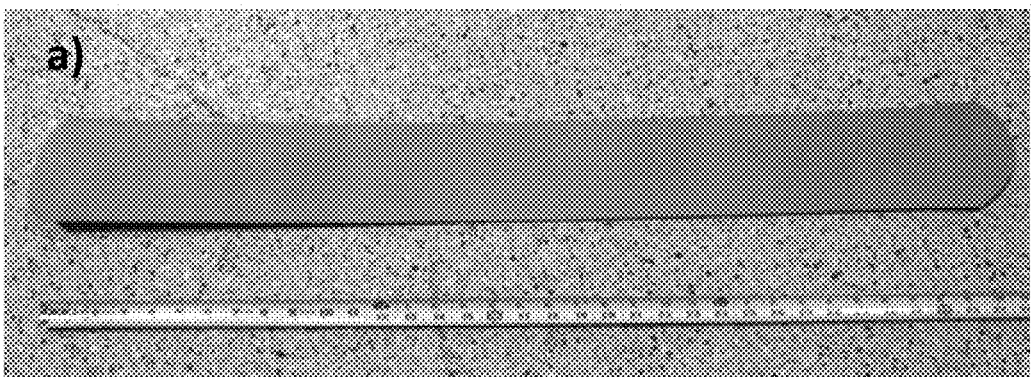
FIGS. 6A and 6B Images of hot rolled sheet after laboratory casting from a) Alloy 6 and b) Alloy 9.
Figure 6B:
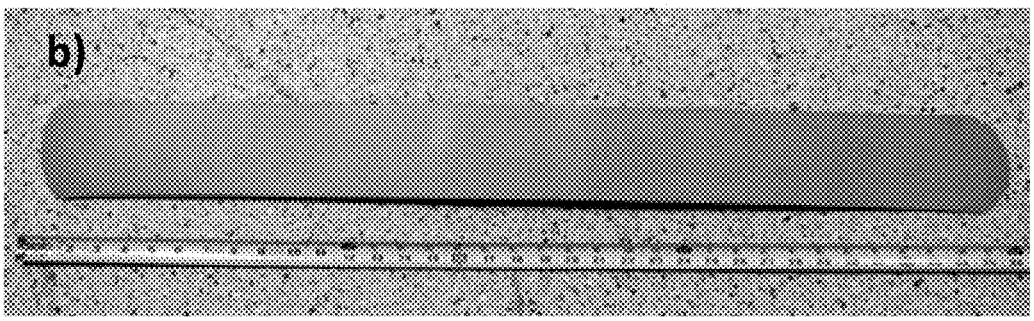

Pre-heated slabs were pushed out of the tunnel furnace into a Fenn Model 061 2 high rolling mill. The 50 mm thick slabs were hot rolled for 5 to 8 passes through the mill before being allowed to air cool. After the initial passes each slab had been reduced between 80 to 85% to a final thickness of between 7.5 and 10 mm. After cooling each resultant sheet was sectioned and the bottom 190 mm was hot rolled for an additional 3 to 4 passes through the mill, further reducing the plate between 72 to 84% to a final thickness of between 1.6 and 2.1 mm. Example pictures of laboratory cast slabs from two different alloys after hot rolling are shown in FIG. 6.

Density

The density of the alloys was measured on samples from hot rolled material using the Archimedes method in a specially constructed balance allowing weighing in both air and distilled water. The density of each alloy is tabulated in Table 3 and was found to be in the range from 7.51 to 7.89 g/cm$^3$. The accuracy of this technique is ±0.01 g/cm$^3$.

TABLE 3

Density of Alloys

| Alloy | Density [g/cm$^3$] |
|---|---|
| Alloy 1 | 7.78 |
| Alloy 2 | 7.74 |
| Alloy 3 | 7.82 |
| Alloy 4 | 7.84 |
| Alloy 5 | 7.83 |
| Alloy 6 | 7.77 |
| Alloy 7 | 7.78 |
| Alloy 8 | 7.77 |
| Alloy 9 | 7.77 |
| Alloy 10 | 7.80 |
| Alloy 11 | 7.78 |
| Alloy 12 | 7.79 |
| Alloy 13 | 7.79 |
| Alloy 14 | 7.77 |
| Alloy 15 | 7.79 |
| Alloy 16 | 7.77 |
| Alloy 17 | 7.78 |
| Alloy 18 | 7.78 |
| Alloy 19 | 7.87 |
| Alloy 20 | 7.81 |
| Alloy 21 | 7.67 |
| Alloy 22 | 7.71 |
| Alloy 23 | 7.57 |
| Alloy 24 | 7.67 |
| Alloy 25 | 7.67 |
| Alloy 26 | 7.74 |
| Alloy 27 | 7.89 |
| Alloy 28 | 7.78 |
| Alloy 29 | 7.89 |
| Alloy 30 | 7.77 |
| Alloy 31 | 7.78 |
| Alloy 32 | 7.82 |
| Alloy 33 | 7.77 |

TABLE 3-continued

Density of Alloys

| Alloy | Density [g/cm$^3$] |
|---|---|
| Alloy 34 | 7.78 |
| Alloy 35 | 7.79 |
| Alloy 36 | 7.83 |
| Alloy 37 | 7.85 |
| Alloy 38 | 7.83 |
| Alloy 39 | 7.84 |
| Alloy 40 | 7.83 |
| Alloy 41 | 7.85 |
| Alloy 42 | 7.77 |
| Alloy 43 | 7.51 |
| Alloy 44 | 7.70 |
| Alloy 45 | 7.65 |

Cold Rolling

Figure 7A:
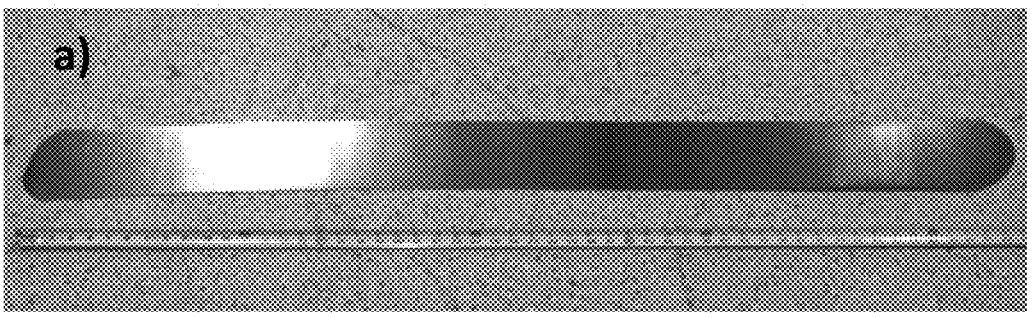
FIGS. 7A and 7B Images of cold rolled sheet after laboratory casting and hot rolling from a) Alloy 6 and b) Alloy 9.
Figure 7B:
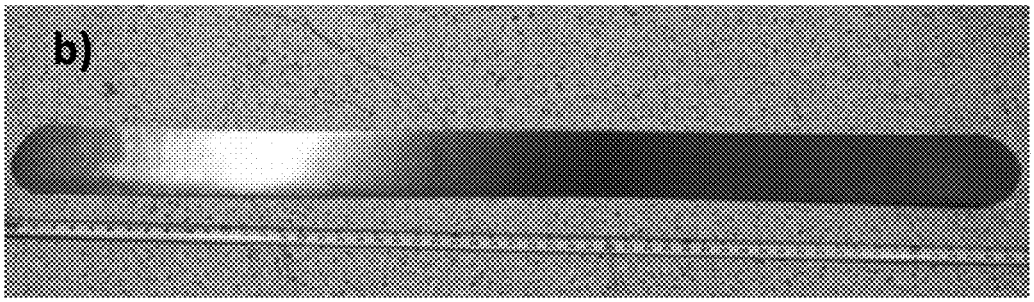

After hot rolling, resultant sheets were media blasted with aluminum oxide to remove the mill scale and were then cold rolled on a Fenn Model 061 2 high rolling mill. Cold rolling takes multiple passes to reduce the thickness of the sheet to a targeted thickness of typically 1.2 mm. Hot rolled sheets were fed into the mill at steadily decreasing roll gaps until the minimum gap was reached. If the material did not yet hit the gauge target, additional passes at the minimum gap were used until 1.2 mm thickness was achieved. A large number of passes were applied due to limitations of laboratory mill capability. Example pictures of cold rolled sheets from two different alloys are shown in FIG. 7.

Annealing

After cold rolling, tensile specimens were cut from the cold rolled sheet via wire EDM. These specimens were then annealed with different parameters listed in Table 4. Annealing 1a and 1b were conducted in a Lucifer 7HT-K12 box furnace. Annealing 2 and 3 were conducted in a Camco Model G-ATM-12FL furnace. Specimens, which were air normalized, were removed from the furnace at the end of the cycle and allowed to cool to room temperature in air. For the furnace cooled specimens, at the end of the annealing the furnace was shut off to allow the sample to cool with the furnace. Note that the heat treatments were selected for demonstration but were not intended to be limiting in scope. High temperature treatments up to just below the melting points for each alloy can be anticipated.

TABLE 4

Annealing Parameters

| Annealing | Heating | Temperature (° C.) | Dwell | Cooling | Atmosphere |
|---|---|---|---|---|---|
| 1a | Preheated Furnace | 850° C. | 5 min | Air Normalized | Air + Argon |
| 1b | Preheated Furnace | 850° C. | 10 min | Air Normalized | Air + Argon |
| 2 | 20° C./min | 850° C. | 360 min | 45° C./hr to 500° C. then Furnace Cool | Hydrogen + Argon |
| 3 | 20° C./min | 1200° C. | 120 min | Furnace Cool | Hydrogen + Argon |

Tensile Properties

Tensile properties were measured on sheet alloys herein after cold rolling and annealing with parameters listed in Table 4. Sheet thickness was '1.2 mm. Tensile testing was done on an Instron 3369 mechanical testing frame using Instron's Bluehill control software. All tests were conducted at room temperature, with the bottom grip fixed and the top grip set to travel upwards at a rate of 0.012 mm/s. Strain data was collected using Instron's Advanced Video Extensometer. Tensile properties of the alloys listed in Table 1 in cold rolled and annealed state are shown below in Table 5 through Table 8. The ultimate tensile strength values may vary from 720 to 1490 MPa with tensile elongation from 10.6 to 91.6%. The yield stress is in a range from 142 to 723 MPa. The mechanical characteristic values in the steel alloys herein will depend on alloy chemistry and processing conditions. Feritscope measurement were done on sheet from the alloys herein after heat treatment 1b that varies from 0.3 to 3.4 Fe % depending on alloy chemistry (Table 6A).

TABLE 5

Tensile Data for Selected Alloys after Heat Treatment 1a

| Alloy | Yield Stress (MPa) | Ultimate Tensile Strength (MPa) | Tensile Elongation (%) |
|---|---|---|---|
| Alloy 1 | 443 | 1212 | 51.1 |
| | 458 | 1231 | 57.9 |
| | 422 | 1200 | 51.9 |
| Alloy 2 | 484 | 1278 | 48.3 |
| | 485 | 1264 | 45.5 |
| | 479 | 1261 | 48.7 |
| Alloy 3 | 458 | 1359 | 43.9 |
| | 428 | 1358 | 43.7 |
| | 462 | 1373 | 44.0 |
| Alloy 4 | 367 | 1389 | 36.4 |
| | 374 | 1403 | 39.1 |
| | 364 | 1396 | 32.1 |
| Alloy 5 | 418 | 1486 | 34.3 |
| | 419 | 1475 | 35.2 |
| | 430 | 1490 | 37.3 |
| Alloy 6 | 490 | 1184 | 58.0 |
| | 496 | 1166 | 59.1 |
| | 493 | 1144 | 56.6 |
| Alloy 7 | 472 | 1216 | 60.5 |
| | 481 | 1242 | 58.7 |
| | 470 | 1203 | 55.9 |
| Alloy 8 | 496 | 1158 | 65.7 |
| | 498 | 1155 | 58.2 |
| | 509 | 1154 | 68.3 |
| Alloy 9 | 504 | 1084 | 48.3 |
| | 515 | 1105 | 70.8 |
| | 518 | 1106 | 66.9 |
| Alloy 10 | 478 | 1440 | 41.4 |
| | 486 | 1441 | 40.7 |
| | 455 | 1424 | 42.0 |
| Alloy 19 | 455 | 1239 | 48.1 |
| | 466 | 1227 | 55.4 |
| | 460 | 1237 | 57.9 |
| Alloy 20 | 419 | 1019 | 48.4 |
| | 434 | 1071 | 48.7 |
| | 439 | 1084 | 47.5 |
| Alloy 25 | 583 | 932 | 61.5 |
| | 594 | 937 | 60.8 |
| | 577 | 930 | 61.0 |
| Alloy 26 | 481 | 1116 | 60.0 |
| | 481 | 1132 | 55.4 |
| | 486 | 1122 | 56.8 |
| Alloy 27 | 349 | 1271 | 42.7 |
| | 346 | 1240 | 36.2 |
| | 340 | 1246 | 42.6 |
| Alloy 28 | 467 | 1003 | 36.0 |
| | 473 | 996 | 29.9 |
| | 459 | 988 | 29.5 |

TABLE 5-continued

Tensile Data for Selected Alloys after Heat Treatment 1a

| Alloy | Yield Stress (MPa) | Ultimate Tensile Strength (MPa) | Tensile Elongation (%) |
|---|---|---|---|
| Alloy 29 | 402 | 1087 | 44.2 |
| | 409 | 1061 | 46.1 |
| | 420 | 1101 | 44.1 |

TABLE 6

Tensile Data for Selected Alloys after Heat Treatment 1b

| Alloy | Yield Stress (MPa) | Ultimate Tensile Strength (MPa) | Tensile Elongation (%) |
|---|---|---|---|
| Alloy 1 | 487 | 1239 | 57.5 |
| | 466 | 1269 | 52.5 |
| | 488 | 1260 | 55.8 |
| Alloy 2 | 438 | 1232 | 49.7 |
| | 431 | 1228 | 49.8 |
| | 431 | 1231 | 49.4 |
| Alloy 6 | 522 | 1172 | 62.6 |
| | 466 | 1170 | 61.9 |
| | 462 | 1168 | 61.3 |
| Alloy 9 | 471 | 1115 | 63.3 |
| | 458 | 1102 | 69.3 |
| | 454 | 1118 | 69.1 |
| Alloy 10 | 452 | 1408 | 40.5 |
| | 435 | 1416 | 42.5 |
| | 432 | 1396 | 46.0 |
| Alloy 11 | 448 | 1132 | 64.4 |
| | 443 | 1151 | 60.7 |
| | 436 | 1180 | 54.3 |
| Alloy 12 | 444 | 1077 | 66.9 |
| | 438 | 1072 | 65.3 |
| | 423 | 1075 | 70.5 |
| Alloy 13 | 433 | 1084 | 67.5 |
| | 432 | 1072 | 66.8 |
| | 423 | 1071 | 67.8 |
| Alloy 14 | 420 | 946 | 74.6 |
| | 421 | 939 | 77.0 |
| | 425 | 961 | 74.9 |
| Alloy 15 | 413 | 1476 | 39.6 |
| | 388 | 1457 | 40.0 |
| | 406 | 1469 | 37.6 |
| Alloy 16 | 496 | 1124 | 67.4 |
| | 434 | 1118 | 64.8 |
| | 435 | 1117 | 67.4 |
| Alloy 17 | 434 | 1154 | 58.3 |
| | 457 | 1188 | 54.9 |
| | 448 | 1187 | 60.5 |
| Alloy 18 | 421 | 1201 | 54.3 |
| | 427 | 1185 | 59.9 |
| | 431 | 1191 | 47.8 |
| Alloy 21 | 554 | 1151 | 23.5 |
| | 538 | 1142 | 24.3 |
| | 562 | 1151 | 24.3 |
| Alloy 22 | 500 | 1274 | 16.0 |
| | 502 | 1271 | 15.8 |
| | 483 | 1280 | 16.3 |
| Alloy 23 | 697 | 1215 | 20.6 |
| | 723 | 1187 | 21.3 |
| | 719 | 1197 | 21.5 |
| Alloy 24 | 538 | 1385 | 20.6 |
| | 574 | 1397 | 20.9 |
| | 544 | 1388 | 21.8 |
| Alloy 30 | 467 | 1227 | 56.7 |
| | 476 | 1232 | 52.7 |
| | 462 | 1217 | 51.6 |
| Alloy 31 | 439 | 1166 | 56.3 |
| | 438 | 1166 | 59.0 |
| | 440 | 1177 | 58.3 |
| Alloy 32 | 416 | 902 | 17.2 |
| | 435 | 900 | 17.6 |
| | 390 | 919 | 21.1 |

TABLE 6-continued

Tensile Data for Selected Alloys after Heat Treatment 1b

| Alloy | Yield Stress (MPa) | Ultimate Tensile Strength (MPa) | Tensile Elongation (%) |
|---|---|---|---|
| Alloy 33 | 477 | 1254 | 45.0 |
| | 462 | 1287 | 48.1 |
| | 470 | 1267 | 48.8 |
| Alloy 34 | 446 | 1262 | 48.8 |
| | 450 | 1253 | 42.1 |
| | 474 | 1263 | 46.4 |
| Alloy 35 | 482 | 1236 | 39.2 |
| | 486 | 1209 | 33.7 |
| | 500 | 1144 | 30.7 |
| Alloy 36 | 474 | 1225 | 44.7 |
| | 491 | 1279 | 51.4 |
| | 440 | 1223 | 45.4 |
| Alloy 37 | 425 | 1190 | 42.4 |
| | 437 | 1211 | 40.3 |
| | 430 | 1220 | 48.3 |
| Alloy 38 | 424 | 1113 | 31.0 |
| | 410 | 1233 | 41.1 |
| | 420 | 1163 | 34.7 |
| Alloy 39 | 431 | 1168 | 37.7 |
| | 447 | 1157 | 36.7 |
| | 465 | 1157 | 34.4 |
| Alloy 40 | 413 | 1101 | 31.1 |
| | 413 | 1121 | 32.1 |
| | 411 | 1077 | 29.1 |
| Alloy 41 | 410 | 1063 | 28.8 |
| | 399 | 1104 | 30.6 |
| | 381 | 1031 | 25.9 |
| Alloy 42 | 444 | 1195 | 59.55 |
| | 438 | 1152 | 64.33 |
| | 466 | 1165 | 64.28 |
| Alloy 43 | 387 | 828 | 66.25 |
| | 403 | 855 | 83.61 |
| | 382 | 834 | 78.67 |
| Alloy 44 | 353 | 947 | 53.7 |
| | 352 | 946 | 55.0 |
| | 334 | 937 | 53.7 |
| Alloy 45 | 518 | 1157 | 31.5 |
| | 512 | 1145 | 32.8 |

TABLE 6A

Fe % In The Alloys After Heat Treatment 1b

| Alloy | Fe % (average) |
|---|---|
| Alloy 1 | 1.1 |
| Alloy 2 | 1.1 |
| Alloy 3 | 0.6 |
| Alloy 4 | 2.5 |
| Alloy 5 | 1.1 |
| Alloy 6 | 1.0 |
| Alloy 7 | 0.6 |
| Alloy 8 | 0.5 |
| Alloy 9 | 1.0 |
| Alloy 10 | 1.0 |
| Alloy 11 | 0.6 |
| Alloy 12 | 0.6 |
| Alloy 13 | 0.4 |
| Alloy 14 | 0.7 |
| Alloy 15 | 1.4 |
| Alloy 16 | 0.4 |
| Alloy 17 | 0.4 |
| Alloy 18 | 0.6 |
| Alloy 19 | 0.7 |
| Alloy 20 | 0.8 |
| Alloy 21 | 0.4 |
| Alloy 22 | 1.7 |
| Alloy 23 | 1.4 |
| Alloy 24 | 3.4 |
| Alloy 25 | 0.3 |
| Alloy 26 | 1.7 |
| Alloy 27 | 2.3 |

TABLE 6A-continued

Fe % In The Alloys After Heat Treatment 1b

| Alloy | Fe % (average) |
|---|---|
| Alloy 28 | 2.3 |
| Alloy 29 | 1.4 |
| Alloy 30 | 0.4 |
| Alloy 31 | 0.5 |
| Alloy 32 | 1.5 |
| Alloy 33 | 1.0 |
| Alloy 34 | 1.4 |
| Alloy 35 | 1.6 |
| Alloy 36 | 1.2 |
| Alloy 37 | 1.0 |
| Alloy 38 | 1.2 |
| Alloy 39 | 1.2 |
| Alloy 40 | 1.4 |
| Alloy 41 | 1.0 |
| Alloy 42 | 1.0 |
| Alloy 43 | 0.4 |
| Alloy 44 | 1.3 |
| Alloy 45 | 1.6 |

TABLE 7

Tensile Data for Selected Alloys after Heat Treatment 2

| Alloy | Yield Stress (MPa) | Ultimate Tensile Strength (MPa) | Tensile Elongation (%) |
|---|---|---|---|
| Alloy 1 | 396 | 1093 | 31.2 |
| | 383 | 1070 | 30.4 |
| | 393 | 1145 | 34.7 |
| Alloy 2 | 378 | 1233 | 49.4 |
| | 381 | 1227 | 48.3 |
| | 366 | 1242 | 47.7 |
| Alloy 3 | 388 | 1371 | 41.3 |
| | 389 | 1388 | 42.6 |
| Alloy 4 | 335 | 1338 | 21.7 |
| | 342 | 1432 | 30.1 |
| | 342 | 1150 | 17.3 |
| Alloy 5 | 399 | 1283 | 17.5 |
| | 355 | 1483 | 24.8 |
| | 386 | 1471 | 23.8 |
| Alloy 6 | 381 | 1125 | 53.3 |
| | 430 | 1111 | 44.8 |
| | 369 | 1144 | 51.1 |
| Alloy 7 | 362 | 1104 | 37.8 |
| | 369 | 1156 | 43.5 |
| Alloy 8 | 397 | 1103 | 52.4 |
| | 390 | 1086 | 50.9 |
| | 402 | 1115 | 50.4 |
| Alloy 9 | 358 | 1055 | 64.7 |
| | 360 | 1067 | 64.4 |
| | 354 | 1060 | 62.9 |
| Alloy 10 | 362 | 982 | 17.3 |
| | 368 | 961 | 16.3 |
| | 370 | 989 | 17.0 |
| Alloy 11 | 385 | 1165 | 59.0 |
| | 396 | 1156 | 55.5 |
| | 437 | 1155 | 57.9 |
| Alloy 12 | 357 | 1056 | 70.3 |
| | 354 | 1046 | 68.2 |
| | 358 | 1060 | 70.7 |
| Alloy 13 | 375 | 1094 | 67.6 |
| | 384 | 1080 | 63.4 |
| | 326 | 1054 | 65.2 |
| Alloy 14 | 368 | 960 | 77.2 |
| | 370 | 955 | 77.9 |
| | 358 | 951 | 75.9 |
| Alloy 15 | 326 | 1136 | 17.3 |
| | 338 | 1192 | 19.1 |
| | 327 | 1202 | 18.5 |
| Alloy 16 | 386 | 1134 | 64.5 |
| | 378 | 1100 | 60.5 |
| | 438 | 1093 | 52.5 |

TABLE 7-continued

Tensile Data for Selected Alloys after Heat Treatment 2

| Alloy | Yield Stress (MPa) | Ultimate Tensile Strength (MPa) | Tensile Elongation (%) |
|---|---|---|---|
| Alloy 17 | 386 | 1172 | 56.2 |
| | 392 | 1129 | 42.0 |
| | 397 | 1186 | 57.8 |
| Alloy 18 | 363 | 1141 | 49.0 |
| Alloy 19 | 335 | 1191 | 45.7 |
| | 322 | 1189 | 41.5 |
| | 348 | 1168 | 34.5 |
| Alloy 20 | 398 | 1077 | 44.3 |
| | 367 | 1068 | 44.8 |
| Alloy 21 | 476 | 1149 | 28.0 |
| | 482 | 1154 | 25.9 |
| | 495 | 1145 | 26.2 |
| Alloy 22 | 452 | 1299 | 16.0 |
| | 454 | 1287 | 15.8 |
| | 441 | 1278 | 15.1 |
| Alloy 23 | 619 | 1196 | 26.6 |
| | 615 | 1189 | 26.2 |
| | 647 | 1193 | 26.1 |
| Alloy 24 | 459 | 1417 | 17.3 |
| | 461 | 1410 | 16.8 |
| | 457 | 1410 | 17.1 |
| Alloy 25 | 507 | 879 | 52.3 |
| | 498 | 874 | 42.5 |
| | 493 | 880 | 44.7 |
| Alloy 29 | 256 | 1035 | 42.3 |
| | 257 | 1004 | 42.1 |
| | 257 | 1049 | 34.8 |
| Alloy 30 | 388 | 1178 | 59.8 |
| | 384 | 1197 | 57.7 |
| | 370 | 1177 | 59.1 |
| Alloy 31 | 367 | 1167 | 58.5 |
| | 369 | 1167 | 58.4 |
| | 375 | 1161 | 59.7 |
| Alloy 32 | 309 | 735 | 11.9 |
| | 310 | 749 | 12.9 |
| | 309 | 720 | 12.3 |
| Alloy 33 | 400 | 1212 | 40.5 |
| | 403 | 1039 | 26.4 |
| | 393 | 1183 | 36.5 |
| Alloy 34 | 381 | 1092 | 29.4 |
| | 385 | 962 | 22.9 |
| | 408 | 1085 | 23.5 |
| Alloy 35 | 386 | 1052 | 26.8 |
| | 388 | 1177 | 32.4 |
| | 398 | 1106 | 29.2 |
| Alloy 36 | 358 | 1197 | 39.5 |
| | 361 | 1250 | 46.2 |
| | 358 | 1189 | 37.1 |
| Alloy 37 | 340 | 1164 | 38.9 |
| | 337 | 1124 | 34.0 |
| | 324 | 1175 | 39.0 |
| Alloy 38 | 373 | 1176 | 36.7 |
| | 361 | 1097 | 30.0 |
| | 360 | 1139 | 34.5 |
| Alloy 39 | 326 | 967 | 25.1 |
| | 323 | 1120 | 34.2 |
| | 357 | 1024 | 25.7 |
| Alloy 40 | 357 | 1139 | 31.9 |
| | 363 | 1102 | 30.3 |
| | 365 | 1086 | 29.3 |
| Alloy 41 | 333 | 1113 | 30.6 |
| | 349 | 1076 | 27.7 |
| | 341 | 1107 | 29.7 |
| Alloy 42 | 354 | 1143 | 64.8 |
| | 367 | 1136 | 48.0 |
| | 370 | 1151 | 52.3 |
| Alloy 43 | 353 | 872 | 91.6 |
| | 352 | 853 | 88.8 |
| | 350 | 850 | 82.2 |
| Alloy 44 | 271 | 950 | 52.1 |
| | 273 | 952 | 52.5 |
| | 274 | 949 | 51.0 |
| Alloy 45 | 483 | 1151 | 29.0 |
| | 456 | 1156 | 32.0 |

TABLE 8

Tensile Data for Selected Alloys after Heat Treatment 3

| Alloy | Yield Stress (MPa) | Ultimate Tensile Strength (MPa) | Tensile Elongation (%) |
|---|---|---|---|
| Alloy 1 | 238 | 1142 | 47.6 |
| | 233 | 1117 | 46.3 |
| | 239 | 1145 | 53.0 |
| Alloy 4 | 142 | 1353 | 27.7 |
| | 163 | 1337 | 26.1 |
| | 197 | 1369 | 29.0 |
| Alloy 5 | 311 | 1465 | 24.6 |
| | 308 | 1467 | 21.8 |
| | 308 | 1460 | 25.0 |
| Alloy 6 | 234 | 1087 | 55.0 |
| | 240 | 1070 | 56.4 |
| | 242 | 1049 | 58.3 |
| Alloy 7 | 229 | 1073 | 50.6 |
| | 228 | 1082 | 56.5 |
| | 229 | 1077 | 54.2 |
| Alloy 8 | 232 | 1038 | 63.8 |
| | 232 | 1009 | 62.4 |
| | 228 | 999 | 66.1 |
| Alloy 9 | 229 | 979 | 65.6 |
| | 228 | 992 | 57.5 |
| | 222 | 963 | 66.2 |
| Alloy 10 | 277 | 1338 | 37.3 |
| | 261 | 1352 | 35.9 |
| | 272 | 1353 | 34.9 |
| Alloy 11 | 228 | 1074 | 58.5 |
| | 239 | 1077 | 54.1 |
| | 230 | 1068 | 49.1 |
| Alloy 12 | 206 | 991 | 60.9 |
| | 208 | 1024 | 58.9 |
| Alloy 13 | 242 | 987 | 53.4 |
| | 208 | 995 | 57.0 |
| Alloy 14 | 222 | 844 | 72.6 |
| | 213 | 869 | 66.5 |
| Alloy 15 | 288 | 1415 | 32.6 |
| | 300 | 1415 | 32.1 |
| | 297 | 1421 | 29.6 |
| Alloy 16 | 225 | 1032 | 58.5 |
| | 213 | 1019 | 61.1 |
| | 214 | 1017 | 58.4 |
| Alloy 17 | 233 | 1111 | 57.3 |
| | 227 | 1071 | 53.0 |
| | 230 | 1091 | 49.4 |
| Alloy 18 | 238 | 1073 | 50.6 |
| | 228 | 1069 | 56.5 |
| | 246 | 1110 | 52.0 |
| Alloy 19 | 217 | 1157 | 47.0 |
| | 236 | 1154 | 46.8 |
| | 218 | 1154 | 47.7 |
| Alloy 20 | 208 | 979 | 45.4 |
| | 204 | 984 | 43.4 |
| | 204 | 972 | 38.9 |
| Alloy 25 | 277 | 811 | 86.7 |
| | 279 | 802 | 86.0 |
| | 277 | 799 | 82.0 |
| Alloy 29 | 203 | 958 | 33.3 |
| | 206 | 966 | 39.5 |
| | 210 | 979 | 36.3 |
| Alloy 30 | 216 | 1109 | 52.8 |
| | 230 | 1144 | 55.9 |
| | 231 | 1123 | 52.3 |
| Alloy 31 | 230 | 1104 | 51.7 |
| | 231 | 1087 | 59.0 |
| | 220 | 1084 | 54.4 |
| Alloy 32 | 250 | 1206 | 46.2 |
| | 247 | 1174 | 40.9 |
| | 247 | 1208 | 46.0 |
| Alloy 33 | 220 | 1021 | 29.9 |
| | 238 | 1143 | 44.8 |
| Alloy 24 | 248 | 1180 | 47.2 |
| | 255 | 1179 | 45.1 |
| | 245 | 1171 | 47.5 |
| Alloy 35 | 254 | 1219 | 45.1 |
| | 247 | 1189 | 39.5 |
| | 242 | 1189 | 42.1 |

TABLE 8-continued

| Tensile Data for Selected Alloys after Heat Treatment 3 | | | |
|---|---|---|---|
| Alloy | Yield Stress (MPa) | Ultimate Tensile Strength (MPa) | Tensile Elongation (%) |
| Alloy 36 | 225 | 1173 | 49.8 |
| | 222 | 1155 | 46.6 |
| Alloy 37 | 219 | 1134 | 39.8 |
| | 219 | 1133 | 39.4 |
| | 218 | 1166 | 44.8 |
| Alloy 38 | 243 | 1164 | 46.1 |
| | 221 | 1133 | 47.3 |
| Alloy 39 | 219 | 1132 | 38.1 |
| | 238 | 1164 | 39.8 |
| | 234 | 1176 | 49.8 |
| Alloy 40 | 239 | 1171 | 46.3 |
| | 242 | 1195 | 49.0 |
| | 241 | 1185 | 45.4 |
| Alloy 41 | 241 | 1189 | 47.5 |
| | 210 | 1070 | 33.6 |
| | 237 | 1160 | 47.7 |
| Alloy 42 | 216 | 1009 | 56.02 |
| | 219 | 984 | 53.36 |
| | 221 | 998 | 53.26 |
| Alloy 43 | 286 | 666 | 50.29 |
| | 270 | 680 | 64.74 |
| | 273 | 692 | 57.84 |
| Alloy 44 | 207 | 917 | 48.82 |
| | 206 | 907 | 51.63 |
| | 198 | 889 | 50.75 |

CASE EXAMPLES

Case Example #1: Property Range of Alloy 1 and Alloy 6 at Different Steps of Processing Laboratory slab with thickness of 50 mm was cast from Alloy 1 and Alloy 6. Alloys were weighed out into charges ranging from 3,000 to 3,400 grams using commercially available ferroadditive powders with known chemistry and impurity content according to the atomic ratios in Table 1. Charges were loaded into zirconia coated silica crucibles which were placed into an Indutherm VTC800V vacuum tilt casting machine. The machine then evacuated the casting and melting chambers and backfilled with argon to atmospheric pressure several times prior to casting to prevent oxidation of the melt. The melt was heated with a 14 kHz RF induction coil until fully molten, approximately 5.25 to 6.5 minutes depending on the alloy composition and charge mass. After the last solids were observed to melt it was allowed to heat for an additional 30 to 45 seconds to provide superheat and ensure melt homogeneity. The casting machine then evacuated the melting and casting chambers and tilted the crucible and poured the melt into a 50 mm thick, 75 to 80 mm wide, and 125 mm deep channel in a water cooled copper die. The melt was allowed to cool under vacuum for 200 seconds before the chamber was filled with argon to atmospheric pressure. Tensile specimens were cut from as-cast slabs by wire EDM and tested in tension. Tensile properties were measured on an Instron 3369 mechanical testing frame using Instron's Bluehill control software. All tests were conducted at room temperature, with the bottom grip fixed and the top grip set to travel upwards at a rate of 0.012 mm/s. Strain data was collected using Instron's Advanced Video Extensometer. Results of tensile testing are shown in Table 9. As it can be seen, alloys herein in as-cast condition show yield stress from 168 to 181 MPa, ultimate strength from 494 to 554 MPa and ductility from 8.4 to 18.9%.

TABLE 9

| Tensile Properties of Selected Alloys in As-Cast State | | | |
|---|---|---|---|
| Alloy | Yield Stress (MPa) | Ultimate Tensile Strength (MPa) | Tensile Elongation (%) |
| Alloy 1 | 168 | 527 | 10.4 |
| | 176 | 548 | 9.3 |
| | 169 | 494 | 8.4 |
| Alloy 6 | 180 | 552 | 17.6 |
| | 171 | 554 | 18.9 |
| | 181 | 506 | 15.9 |

Laboratory cast slabs were hot rolled with different reduction. Prior to hot rolling, laboratory cast slabs were loaded into a Lucifer EHS3GT-B18 furnace to heat. The furnace set point varies between 1000° C. to 1250° C. depending on alloy melting point. The slabs were allowed to soak for 40 minutes prior to hot rolling to ensure they reach the target temperature. Between hot rolling passes the slabs are returned to the furnace for 4 minutes to allow the slabs to reheat. Pre-heated slabs were pushed out of the tunnel furnace into a Fenn Model 061 2 high rolling mill. Number of passes depends on targeted rolling reduction. After hot rolling, resultant sheet was loaded directly from the hot rolling mill while it is still hot into a furnace preheated to 550° C. to simulate coiling conditions at commercial production. Once loaded into the furnace, the furnace was set to cool at a controlled rate of 20° C./hr. Samples were removed when the temperature was below 150° C. Hot rolled sheet had a final thickness ranging from 6 mm to 1.5 mm depending on the hot rolling reduction settings. Samples with thickness less than 2 mm were surface ground to ensure uniformity and tensile samples were cut using wire-EDM. For material from 2 mm to 6 mm thick, tension sample were first cut and then media blasted to remove mill scale. Results of tensile testing are shown in Table 10. As it can be seen, both alloys do not show dependence of properties on hot rolling reduction with ductility in the range from 41.3 to 68.4%, ultimate strength from 1126 to 1247 MPa and yield stress from 272 to 350 MPa.

TABLE 10

| Tensile Properties of Selected Alloys after Hot Rolling | | | | | |
|---|---|---|---|---|---|
| | Hot | | Tensile Properties | | |
| Alloy | Rolling Reduction (%) | Sheet Tickness (mm) | Yield Stress (MPa) | Ultimate Strength (MPa) | Tensile elongation (%) |
| Alloy 1 | 96% | 1.8 | 299 | 1213 | 52.4 |
| | 97% | 1.7 | 306 | 1247 | 47.8 |
| | 97% | 1.7 | 302 | 1210 | 53.3 |
| | 93% | 3.6 | 312 | 1144 | 41.3 |
| | 93% | 3.6 | 312 | 1204 | 49.7 |
| | 91% | 4.3 | 309 | 1202 | 59.0 |
| | 91% | 4.4 | 347 | 1206 | 60.0 |
| | 91% | 4.4 | 322 | 1226 | 57.9 |
| Alloy 6 | 96% | 1.8 | 350 | 1152 | 65.5 |
| | 97% | 1.6 | 288 | 1202 | 53.2 |
| | 97% | 1.6 | 324 | 1162 | 59.8 |
| | 93% | 3.6 | 273 | 1126 | 52.6 |
| | 93% | 3.6 | 272 | 1130 | 62.0 |
| | 93% | 3.7 | 284 | 1133 | 53.1 |
| | 91% | 4.4 | 314 | 1131 | 60.2 |
| | 91% | 4.4 | 311 | 1132 | 68.1 |
| | 88% | 5.9 | 302 | 1147 | 65.1 |
| | 88% | 5.9 | 299 | 1146 | 68.4 |

Hot rolled sheets with final thickness of 1.6 to 1.8 mm were media blasted with aluminum oxide to remove the mill scale and were then cold rolled on a Fenn Model 061 2 high rolling mill. Cold rolling takes multiple passes to reduce the thickness of the sheet to targeted thickness, down to 1 mm. Hot rolled sheets were fed into the mill at steadily decreasing roll gaps until the minimum gap is reached. If the material has not yet hit the gauge target, additional passes at the minimum gap were used until the targeted thickness was reached. Cold rolling conditions with the number of passes for each alloy herein are listed in Table 11. Tensile specimens were cut from cold rolled sheets by wire EDM and tested in tension. Results of tensile testing are shown in Table 11. Cold rolling leads to significant strengthening with ultimate tensile strength in the range from 1404 to 1712 MPa. The tensile elongation of the alloys herein in cold rolled state varies from 20.4 to 35.4%. Yield stress is measured in a range from 793 to 1135 MPa. It is anticipated that higher ultimate tensile strength and yield stress can be achieved in alloys herein by larger cold rolling reduction (>40%) that in our case is limited by laboratory mill capability.

TABLE 11

Tensile Properties of Selected Alloys after Cold Rolling

| Alloy | Condition | Yield Stress (MPa) | Ultimate Tensile Strength (MPa) | Tensile Elongation (%) |
|---|---|---|---|---|
| Alloy 1 | Cold Rolled | 798 | 1492 | 28.5 |
| | 20.3%, | 793 | 1482 | 32.1 |
| | 4 Passes | | | |
| | Cold Rolled | 1114 | 1712 | 20.5 |
| | 37.1%, | 1131 | 1712 | 20.4 |
| | 14 Passes | | | |
| Alloy 6 | Cold Rolled | 811 | 1404 | 33.5 |
| | 23.2%, | 818 | 1448 | 28.6 |
| | 5 Passes | 869 | 1415 | 35.4 |
| | Cold Rolled | 1135 | 1603 | 21.8 |
| | 37.9%, | 1111 | 1612 | 23.2 |
| | 9 Passes | 1120 | 1589 | 25.7 |

Tensile specimens were cut from cold rolled sheet samples by wire EDM and annealed at 850° C. for 10 min in a Lucifer 7HT-K12 box furnace. Samples were removed from the furnace at the end of the cycle and allowed to cool to room temperature in air. Results of tensile testing are shown in Table 12. As it can be seen, recrystallization during annealing of the alloys herein after cold rolling results in property combinations with ultimate tensile strength in the range from 1168 to 1269 MPa and tensile elongation from 52.5 to 62.6%. Yield stress is measured in a range from 462 to 522 MPa. This sheet state with Recrystallized Modal Structure (Structure #4, FIG. 2) corresponds to final sheet condition utilized for drawing tests herein.

TABLE 12

Tensile Data for Selected Alloys after Heat Treatment

| Alloy | Yield Stress (MPa) | Ultimate Tensile Strength (MPa) | Tensile Elongation (%) |
|---|---|---|---|
| Alloy 1 | 487 | 1239 | 57.5 |
| | 466 | 1269 | 52.5 |
| | 488 | 1260 | 55.8 |
| Alloy 6 | 522 | 1172 | 62.6 |
| | 466 | 1170 | 61.9 |
| | 462 | 1168 | 61.3 |

This Case Example demonstrates processing steps simulating sheet production at commercial scale and corresponding alloy property range at each step of processing towards final condition of cold rolled and annealed sheet with Recrystallized Modal Structure (Structure #4, FIG. 1B) utilized for drawing tests herein.

Case Example #2: Recrystallized Modal Structure in Annealed Sheet

Laboratory slabs with thickness of 50 mm were cast from Alloy 1 and Alloy 6 according to the atomic ratios in Table 1 that were then laboratory processed by hot rolling, cold rolling and annealing at 850° C. for 10 min as described in the Main Body section of the current application. Microstructure of the alloys in a form of processed sheet with 1.2 mm thickness after annealing corresponding to a condition of the sheet in annealed coils at commercial production was examined by SEM and TEM.

To prepare TEM specimens, the samples were first cut with EDM, and then thinned by grinding with pads of reduced grit size every time. Further thinning to make foils of 60 to 70 μm thickness was done by polishing with 9 μm, 3 μm and 1 μm diamond suspension solution, respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens may be ion-milled using a Gatan Precision Ion Polishing System (PIPS). The ion-milling usually is done at 4.5 keV, and the inclination angle is reduced from 4° to 2° to open up the thin area. The TEM studies were done using a JEOL 2100 high-resolution microscope operated at 200 kV. The TEM specimens were studied by SEM. Microstructures were examined by SEM using an EVO-MA10 scanning electron microscope manufactured by Carl Zeiss SMT Inc.

Figure 8A:
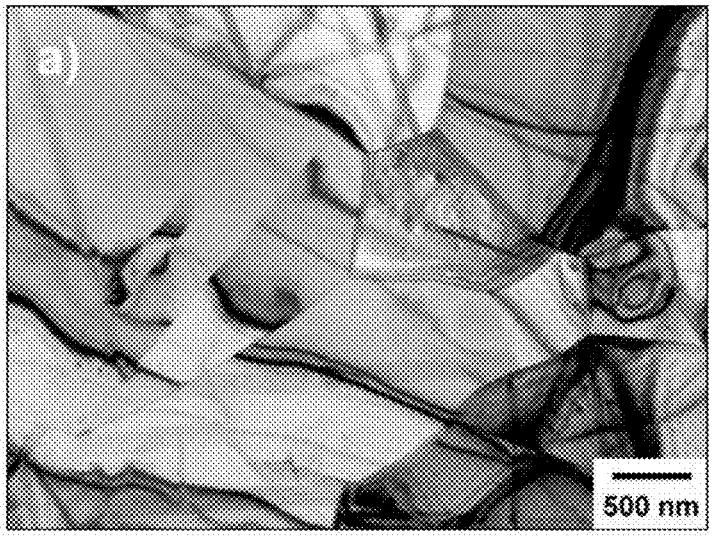
FIGS. 8A and 8B Bright-field TEM micrographs of microstructure in fully processed and annealed 1.2 mm thick sheet from Alloy 1: a) Low magnification image; b) High magnification image.
Figure 8B:
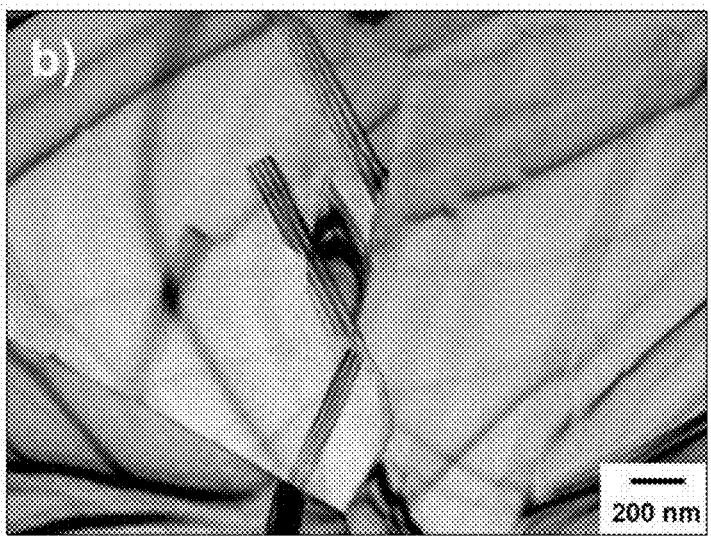
Figure 9A:
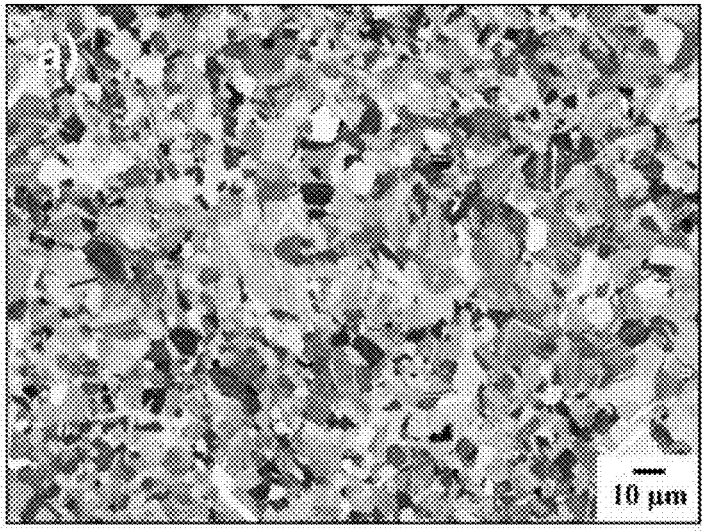
FIGS. 9A and 9B Backscattered SEM micrograph of microstructure in fully processed and annealed 1.2 mm thick sheet from Alloy 1: a) Low magnification image; b) High magnification image.
Figure 9B:
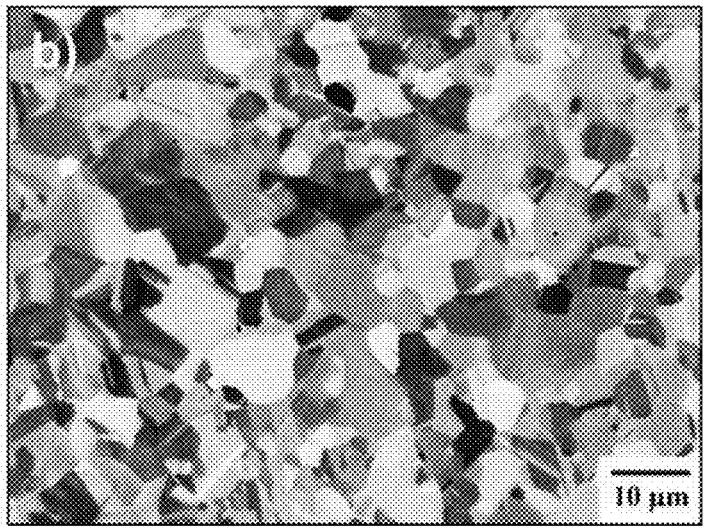

Recrystallized Modal Structure in the annealed sheet from Alloy 1 is shown in FIG. 8. As it can be seen, equiaxed grains with sharp and straight boundaries are present in the structure and the grains are free of dislocations, which is typical for the Recrystallized Modal Structure. Annealing twins are sometimes found in the grains, but stacking faults are commonly seen. The formation of stacking faults shown in the TEM image is typical for face-centered-cubic crystal structure of the austenite phase. FIG. 9 shows the backscattered SEM images of the Recrystallized Modal Structure in the Alloy 1 that was taken from the TEM specimens. In the case of Alloy 1, the size of recrystallized grains ranges from 2 μm to 20 μm. The different contrast of grains (dark or bright) seen on SEM images suggests that the crystal orientation of the grains is random, since the contrast in this case is mainly originating from the grain orientation.

Figure 10A:
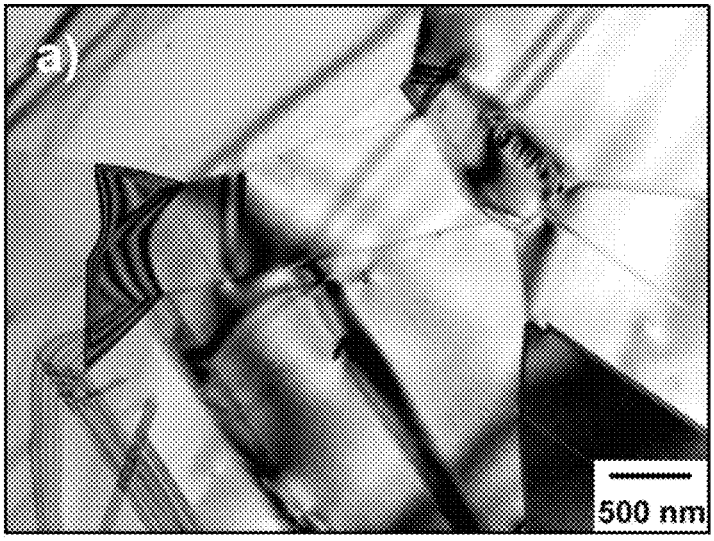
FIGS. 10A and 10B Bright-field TEM micrographs of microstructure in fully processed and annealed 1.2 mm thick sheet from Alloy 6: a) Low magnification image; b) High magnification image.
Figure 10B:
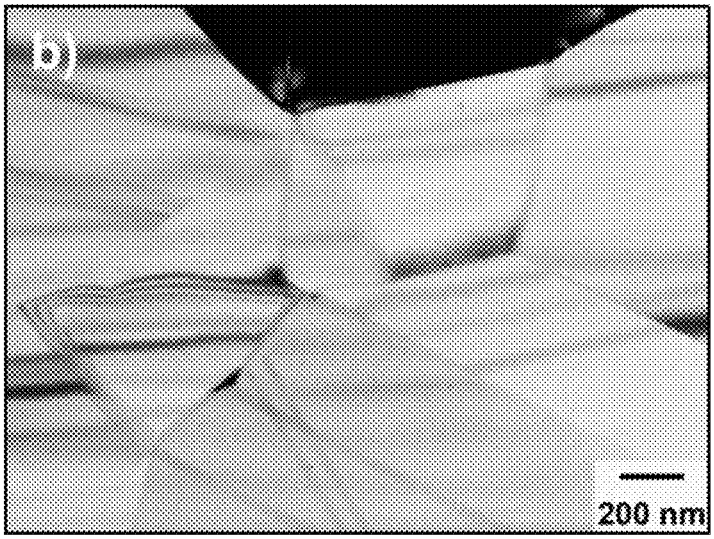
Figure 11A:
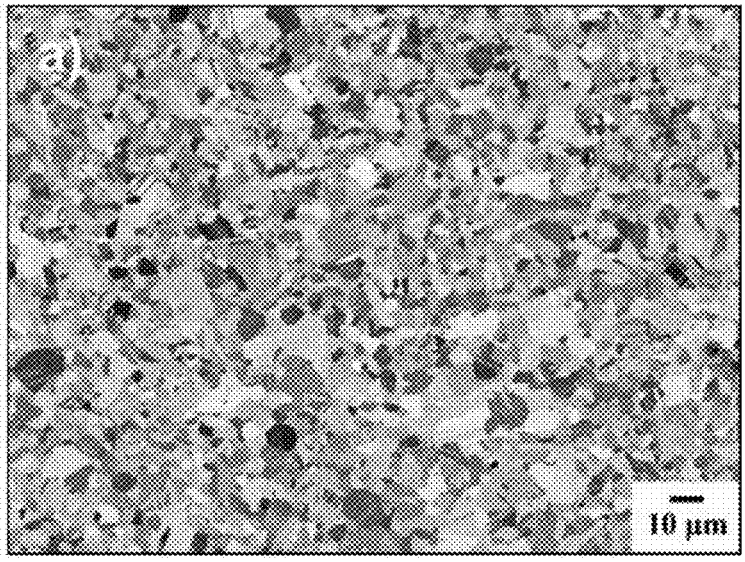
FIGS. 11A and 11B Backscattered SEM micrograph of microstructure in fully processed and annealed 1.2 mm thick sheet from Alloy 6: a) Low magnification image; b) High magnification image.
Figure 11B:
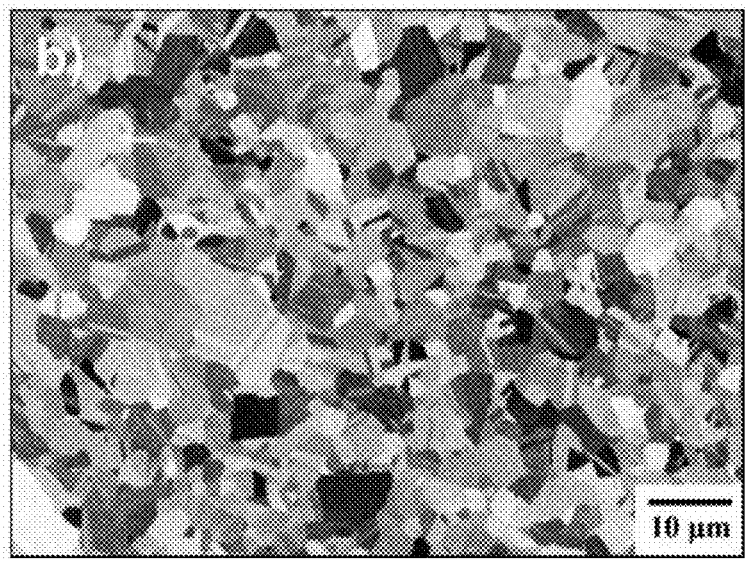

Similar to Alloy 1, Recrystallized Modal Structure was formed in Alloy 6 sheet after annealing. FIG. 10 shows the bright-field TEM images of the microstructure in Alloy 6 after cold rolling and annealing at 850° C. for 10 min. As in Alloy 1, the equiaxed grains have sharp and straight boundaries, and stacking faults are present in the grains. It suggests that the structure is well recrystallized. SEM images from the TEM specimens show the Recrystallized Modal Structure as well. As shown in FIG. 11, the recrystallized grains are equiaxed, and show random orientation. The grain size ranges from 2 to 20 μm, similar to that in Alloy 1.

This Case Example demonstrates that steel alloys herein form Recrystallized Modal Structure in the processed sheet with 1.2 mm thickness after annealing which additionally corresponds to a condition of a sheet in for example annealed coils at commercial production.

Case Example #3: Transformation into Refined High Strength Nanomodal Structure

Recrystallized Modal Structure transforms into the Mixed Microconstituent Structure under quasi-static deformation, in this case, tensile deformation. TEM analysis was conducted to show the formation of the Mixed Microconstituent Structure after tensile deformation in Alloy 1 and Alloy 6 sheet samples.

To prepare TEM specimens, the samples were first cut from the tensile gauge by EDM, and then thinned by grinding with pads of reduced grit size every time. Further thinning to make foils of 60 to 70 μm thickness was done by polishing with 9 μm, 3 μm and down to 1 μm diamond suspension solutions. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens may be ion-milled using a Gatan Precision Ion Polishing System (PIPS). The ion-milling usually is done at 4.5 keV, and the inclination angle is reduced from 4° to 2° to open up the thin area. The TEM studies were done using a JEOL 2100 high-resolution microscope operated at 200 kV.

Figure 12A:
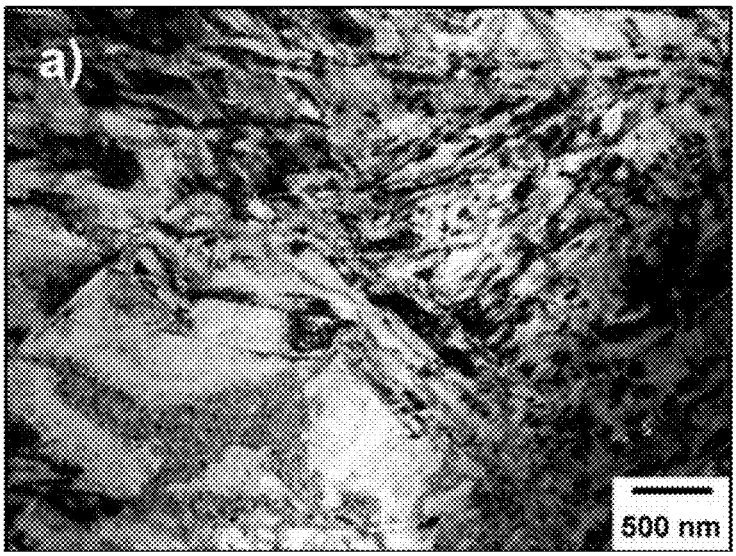
FIGS. 12A and 12B Bright-field TEM micrographs of microstructure in Alloy 1 sheet after deformation: a) Low magnification image; b) High magnification image.
Figure 12B:
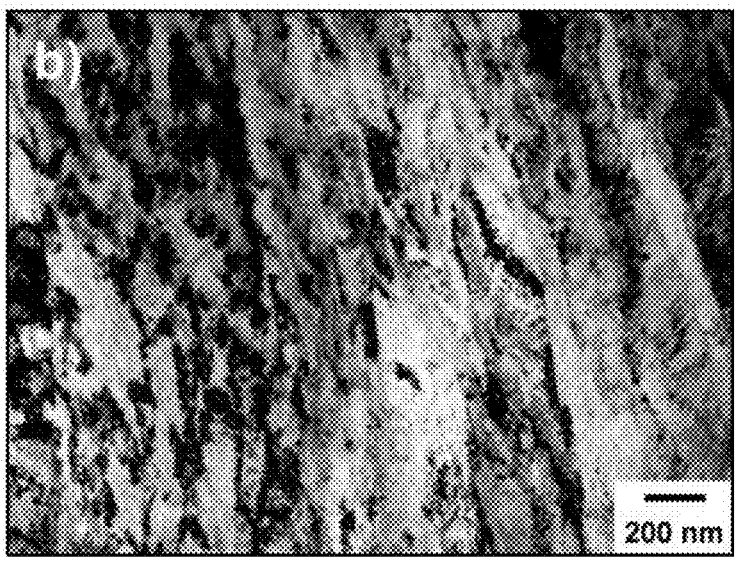
Figure 13A:
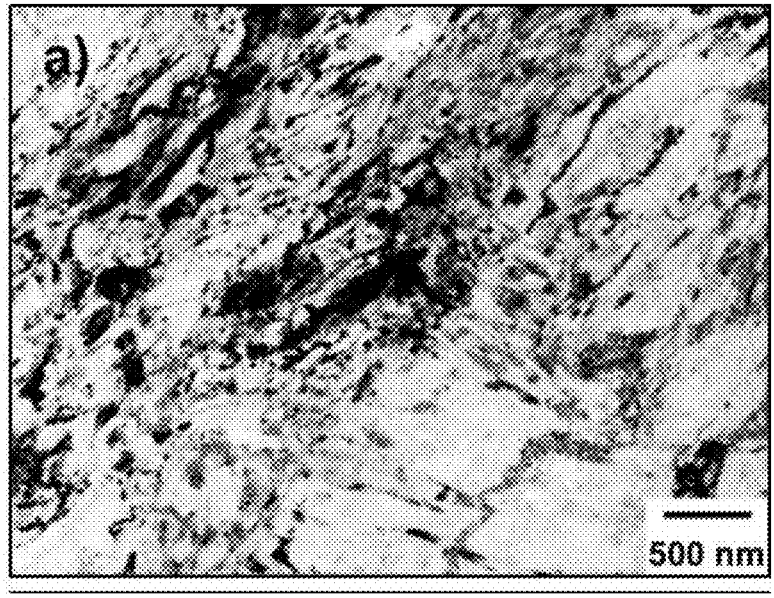
FIGS. 13A and 13B Bright-field TEM micrographs of microstructure in Alloy 6 sheet after deformation: a) Low magnification image; b) High magnification image.
Figure 13B:
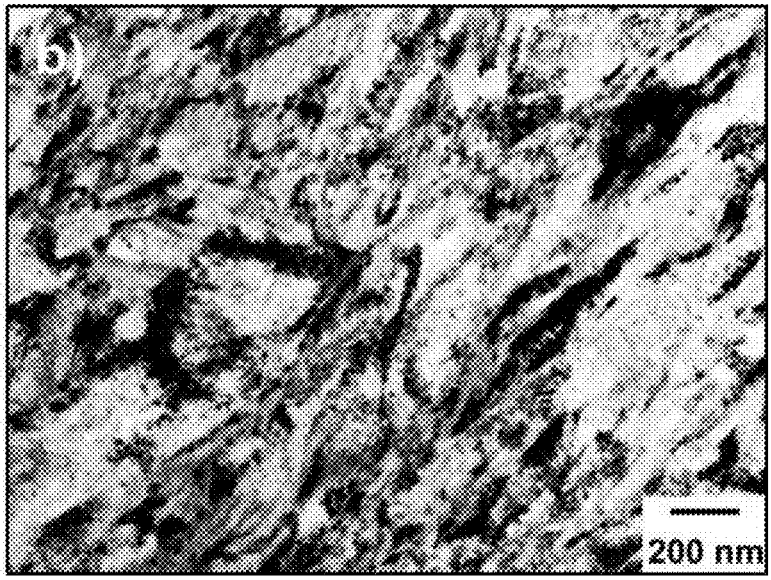
Figure 14:
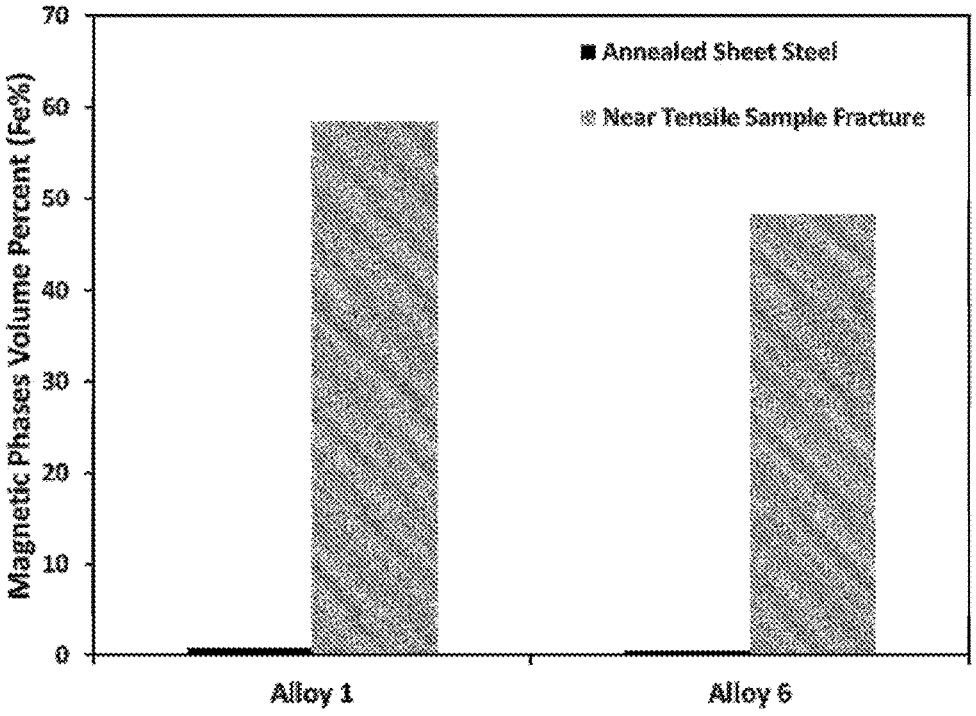
FIG. 14 Volumetric comparison of magnetic phases before and after tensile deformation in Alloy 1 and Alloy 6 suggesting that the Recrystallized Modal Structure in the sheet before deformation is predominantly austenite and non-magnetic but the material undergo substantial transformation during deformation leading to high volume fraction of magnetic phases.
Figure 15A:
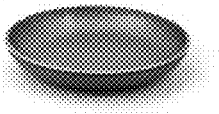
FIG. 15A-15D A view of the cups from Alloy 1 after drawing at 0.8 mm/s with draw ratio of 1.78 and exposure to hydrogen for 45 min.
Figure 15B:
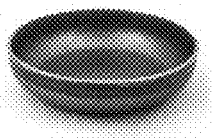
Figure 15C:
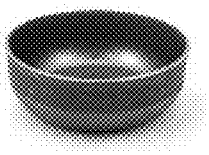
Figure 15D:
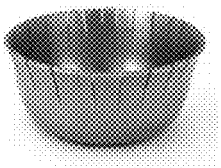

As described in Case Example #2, the Recrystallized Modal Structure formed in processed sheet from alloys herein, composed mainly of austenite phase with equiaxed grains of random orientation and sharp boundaries. Upon tensile deformation, the microstructure is dramatically changing with phase transformation in randomly distributed arears of microstructure from austenite into ferrite with nanoprecipitates. FIG. 12 shows the bright-field TEM images of the microstructure in the Alloy 1 sample gauge after tensile deformation. Compared to the matrix grains that were initially almost dislocation-free in the Recrystallized Modal Structure after annealing, the application of tensile stress generates a high density of dislocations within the matrix austenitic grains (for example the area at the lower part of the FIG. 12*a*). The upper part in the FIG. 12*a* and FIG. 12*b* shows structural areas of significantly refined microstructure due to structural transformation into the Refined High Strength Nanomodal Structure through the Nanophase Refinement & Strengthening Mechanism. A higher magnification TEM image in FIG. 12*b* shows the refined grains of 100 to 300 nm with fine precipitates in some grains. Similarly, the Refined High Strength Nanomodal Structure is also formed in Alloy 6 sheet after tensile deformation. FIG. 13 shows the bright-field TEM images of Alloy 6 sheet microstructure in the tensile gauge after testing. As in Alloy 1, dislocations of high density are generated in the untransformed matrix grains, and substantial refinement in randomly distributed structural areas is attained as a result of phase transformation during deformation. The phase transformation is verified using a Fischer Feritscope (Model FMP30) measurement from the sheet samples before and after deformation. Note that the Feritscope measures the induction of all magnetic phases in the sample tested and thus the measurements can include one or more magnetic phases. As shown in FIG. 14, sheet samples in the annealed state with the Recrystallized Modal Structure from both Alloy 1 and Alloy 6 contain only 1 to 2% of magnetic phases, suggesting that the microstructure is predominantly austenite and is non-magnetic. After deformation, in the tensile gauge of tested samples, the amount of magnetic phases increases to more than 50% in both alloys. The increase of magnetic phase volume in the tensile sample gauge corresponds mostly to austenite transformation into ferrite in structural areas depicted by TEM and leading to formation of the Mixed Microconstituent Structure.

This Case Example demonstrates that the Recrystallized Modal Structure in the processed sheet from alloys herein transforms into the Mixed Microconstituent Structure during cold deformation with high dislocation density in untransformed austenitic grains representing one microconstituent and randomly distributed areas of transformed Refined High Strength Nanomodal Structure representing another microconstituent. Size and volume fraction of transformed areas depends on alloy chemistry and deformation conditions.

Case Example #4 Delayed Fracture after Cup Drawing

Laboratory slabs with thickness of 50 mm were cast from Alloy 1, Alloy 6 and Alloy 9 according to the atomic ratios provided in Table 1 and laboratory processed by hot rolling and cold rolling as described in the Main Body section of the current application. Blanks of the diameter listed in Table 13 were cut from the cold rolled sheet by wire EDM. After cutting, the edges of the blanks were lightly ground using 240 grit silicon carbide polishing paper to remove any large asperities and then polished using a nylon belt. The blanks were then annealed for 10 minutes at 850° C. as described herein. Resultant blanks from each alloy with final thickness of 1.0 mm and the Recrystallized Modal Structure were used for drawing tests. Drawing occurred by pushing the blanks up into the die and the ram was moved continually upward into the die until a full cup was drawn (i.e. no flanging material). Cups were drawn at a ram speed of 0.8 mm/s which is representative of a quasistatic speed (i.e. very slow\nearly static).

TABLE 13

Starting Blank Size and Resulting Full Cup Draw Ratio

| Blank Size (mm) | Draw Ratio |
|---|---|
| 85.85 | 1.78 |

After drawing, cups were inspected and allowed to sit in room air for 45 minutes. The cups were inspected following air exposure and the numbers of delayed cracks, if any, were recorded. Drawn cups were additionally exposed to 100% hydrogen for 45 minutes. Exposure to 100% hydrogen for 45 minutes was chosen to simulate the maximum hydrogen exposure for the lifetime of a drawn piece. The drawn cups were placed in an atmosphere controlled enclosure and flushed with nitrogen before being switched to 100% hydrogen gas. After 45 minutes in hydrogen, the chamber was purged for 10 minutes in nitrogen. The drawn cups were removed from the enclosure and the number of delayed cracks that had occurred was recorded. An example picture of the cup from Alloy 1 after drawing at 0.8 mm/s with draw ratio of 1.78 and exposure to hydrogen for 45 min is shown in FIG. 15.

The numbers of cracks after air and hydrogen exposure are shown in Table 14. Note that Alloy 1 and Alloy 6 had hydrogen assisted delayed cracking after air and hydrogen exposure while the cup from Alloy 9 did not crack after air exposure.

TABLE 14

Number of Cracks in Cups after Air and Hydrogen Exposure

| Alloy | Number of Cracks After 45 Minutes | |
|---|---|---|
| | Air Exposure | Hydrogen Exposure |
| Alloy 1 | 19 | 25 |
| Alloy 6 | 1 | 13 |
| Alloy 9 | 0 | 2 |

This Case Example demonstrates that hydrogen assisted delayed cracking occurs in the alloys herein after cup drawing at slow speed of 0.8 mm/s at the draw ratio used. Number of cracks depends on alloy chemistry.

Case Example 5: Analysis of Hydrogen in Exposed Cups After Drawing

Slabs with thickness of 50 mm were laboratory cast from Alloy 1, Alloy 6 and Alloy 14 according to the atomic ratios provided in Table 1 and laboratory processed by hot rolling and cold rolling as described herein. Blanks of 85.85 mm in diameter were cut from the cold rolled sheet by wire EDM. After cutting, the edges of the blanks were lightly ground using 240 grit silicon carbide polishing papers to remove any large asperities and then polished using a nylon belt. The blanks were then annealed for 10 minutes at 850° C. as described in the Main Body section of this application. Resultant sheet from each alloy with final thickness of 1.0 mm and the Recrystallized Modal Structure (Structure #4, FIG. 2) were used for cup drawing.

Drawing occurred by pushing the blanks up into the die and the ram was moved continually upward into the die until a full cup was drawn (i.e. no flanging material). Cups were drawn at a ram speed of 0.8 mm/s that is typically used for this type of testing. The resultant draw ratio for the blanks tested was 1.78.

Drawn cups were exposed to 100% hydrogen for 45 minutes. Exposure to 100% hydrogen for 45 minutes was chosen to simulate the maximum hydrogen exposure for the lifetime of a drawn piece. The drawn cups were placed in an atmosphere controlled enclosure and flushed with nitrogen before being switched to 100% hydrogen gas. After 45 minutes in hydrogen, the chamber was purged for 10 minutes with nitrogen.

The drawn cups were removed from the enclosure and rapidly sealed in a plastic bag. The plastic bags, each now containing a drawn cup, were quickly placed inside an insulated box packaged with dry ice. The drawn cups were removed from the sealed plastic bags in dry ice briefly for a sample to be taken for hydrogen analysis from both the cup bottom and cup wall. Both the cup and analysis samples were again sealed in plastic bag and kept at dry ice temperature. The hydrogen analysis samples were kept at dry ice temperature until just before testing, at which time each sample was removed from the dry ice and plastic bag and analyzed for hydrogen content by inert gas fusion (IGF). The hydrogen content in the cup bottoms and walls for each alloy is provided in Table 15. The detection limit for hydrogen for this IGF analysis is 0.0003 wt. % hydrogen.

TABLE 15

Hydrogen Content in Cup Bottoms and Walls after Hydrogen Exposure

| Alloy | Hydrogen content (wt. %) | |
|---|---|---|
| | Cup Bottom | Cup Wall |
| Alloy 1 | <0.0003 | 0.0027 |
| Alloy 6 | 0.0003 | 0.0029 |
| Alloy 14 | <0.0003 | 0.0017 |

Note that the cup bottoms, which experienced minimal deformation during the cup drawing process, had minimal hydrogen content after 45 minutes exposure to 100% hydrogen. However, the cup walls, which did have extensive deformation during the cup drawing process, had considerably elevated hydrogen content after 45 minutes exposure to 100% hydrogen.

This Case Example demonstrates that hydrogen is entering the material only when specific stress states are achieved. Additionally, a key component of this is that the hydrogen absorption is only occurs in the extensively deformed areas of the drawn cups.

Case Example #6: Fractography Analysis of Hydrogen Exposed Cups

NanoSteel alloys herein undergo delayed cracking after cup drawing at drawing speed of 0.8 mm/s as demonstrated in Case Example #4. The fracture surfaces of cracks in the cups from Alloy 1, Alloy 6 and Alloy 9 were analyzed by scanning electron microscopy (SEM) in secondary electron detection mode.

Figure 16:
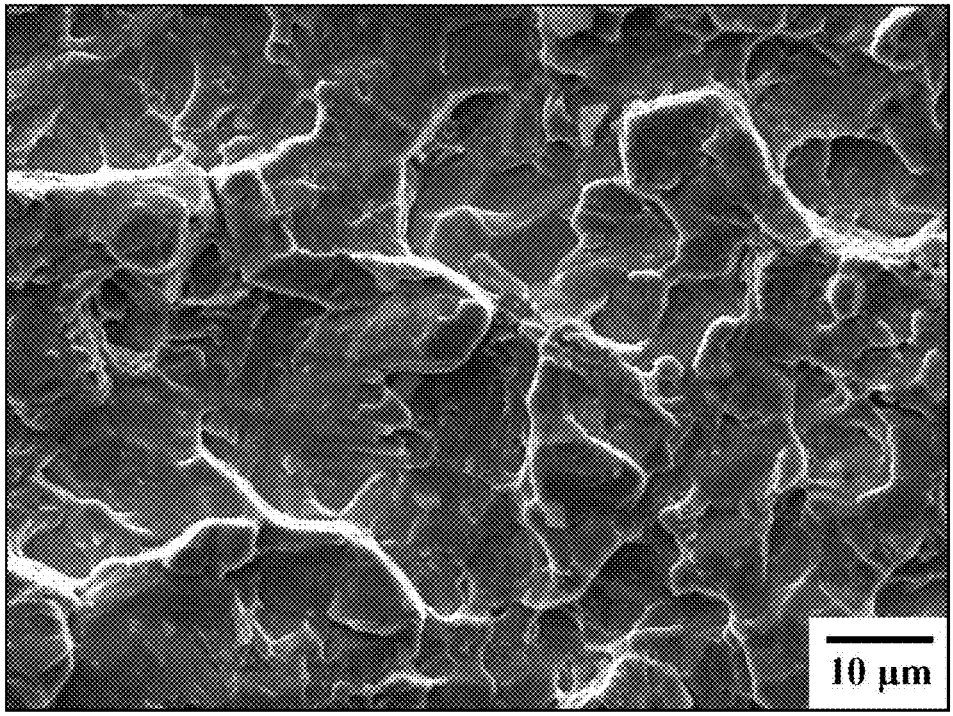
FIG. 16 Fracture surface of Alloy 1 by delayed cracking after exposure to 100% hydrogen for 45 minutes. Note the brittle (faceted) fracture surface with the lack of visible grain boundaries.
Figure 17:
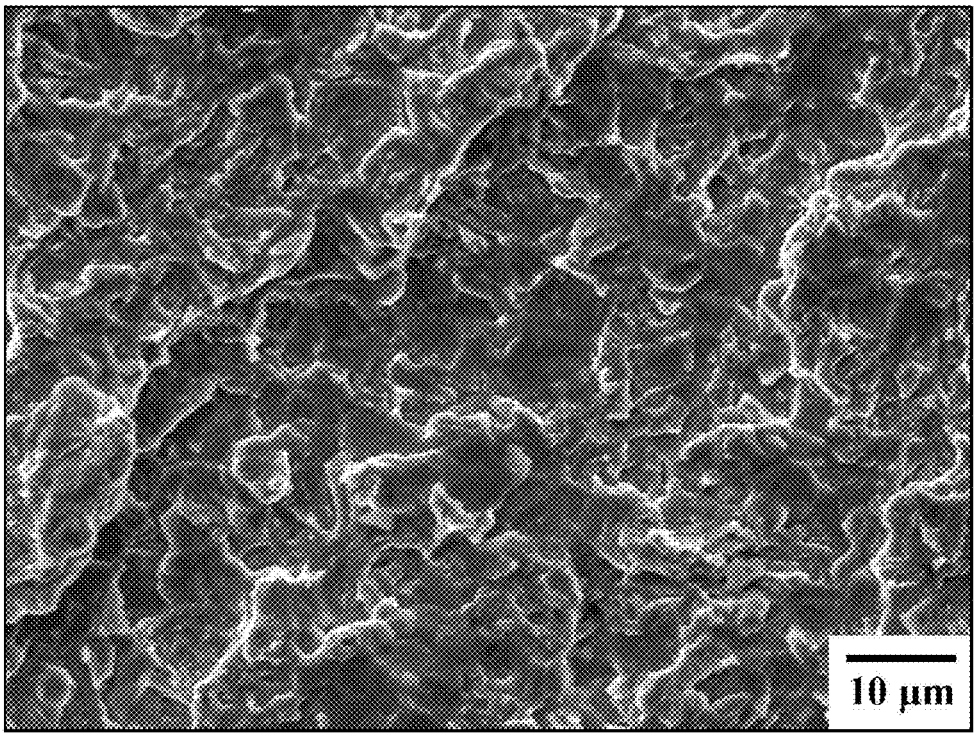
FIG. 17 Fracture surface of Alloy 6 by delayed cracking after exposure to 100% hydrogen for 45 minutes. Note the brittle (faceted) fracture surface with the lack of visible grain boundaries.
Figure 18:
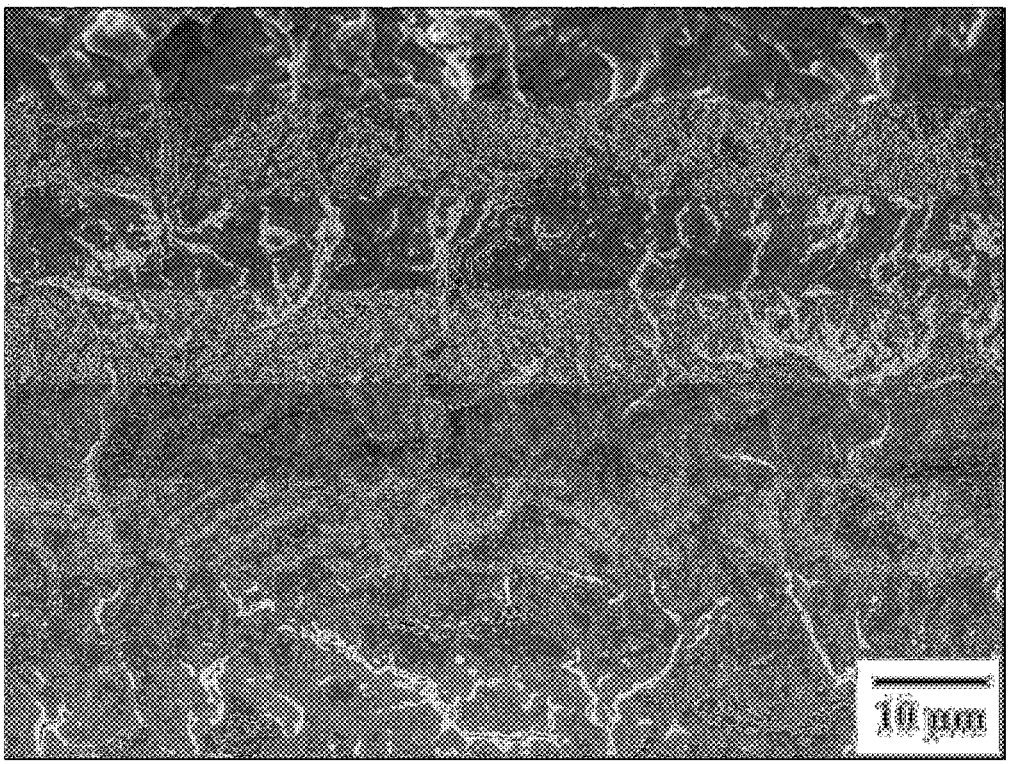
FIG. 18 Fracture surface of Alloy 9 by delayed cracking after exposure to 100% hydrogen for 45 minutes. Note the brittle (faceted) fracture surface with the lack of visible grain boundaries.

FIG. 16 through FIG. 18 show the fracture surfaces of Alloy 1, Alloy 6 and Alloy 9, respectively. In all images, a lack of clear grain boundaries on the fracture surface is observed, however large flat transgranular facets are found, indicating that fracture occurs via transgranular cleavage in the alloys during hydrogen assisted delayed cracking.

This Case Example demonstrates that hydrogen is attacking the transformed areas of the cup in complex triaxial stress states. Specific planes of the transformed areas (i.e. ferrite) are being attacked by hydrogen leading to transgranular cleavage failure.

Case Example #7: Structural Transformations During Cup Drawing at Low Speed

Figure 19:
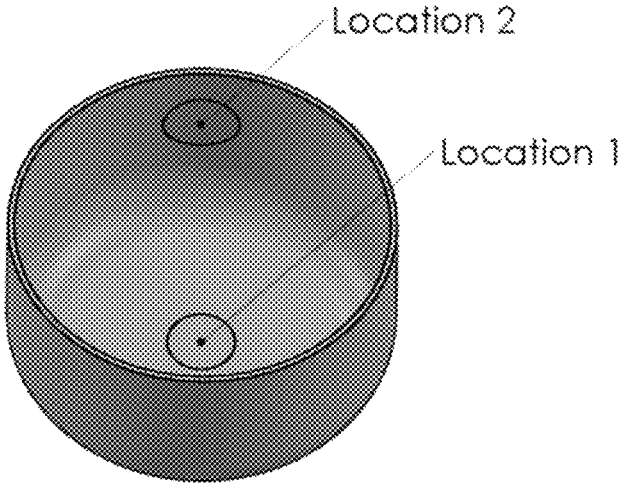
FIG. 19 Location of the samples for structural analysis; Location 1 bottom of cup, Location 2 middle of cup sidewall.

As a form of cold plastic deformation, cup drawing causes microstructural changes in steel alloys herein. In this Case Example, the structural transformation is demonstrated in Alloy 1 and Alloy 6 cups when they were drawn at relatively slow drawing speed of 0.8 mm/s that is commonly used in industry for cup drawing testing. The steel sheet from Alloy 1 and Alloy 6 in annealed state with Recrystallized Modal Structure and 1 mm thickness was used for cup drawing at 1.78 draw ratio. SEM and TEM analysis was used to study the structure transformation in drawn cups from Alloy 1 and Alloy 6. For the purpose of comparison, the wall of cups and the bottom of cups were studied as shown in FIG. 19.

To prepare TEM specimens, the wall and bottom of cup were cut out with EDM, and then thinned by grinding with pads of reduced grit size every time. Further thinning to make foils of 60 to 70 μm thickness was done by polishing with 9 μm, 3 μm and down to 1 μm diamond suspension solutions. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens may be ion-milled using a Gatan Precision Ion Polishing System (PIPS). The ion-milling usually is done at 4.5 keV, and the inclination angle is reduced from 4° to 2° to open up the thin area. The TEM studies were done using a JEOL 2100 high-resolution microscope operated at 200 kV.

Figure 20A:
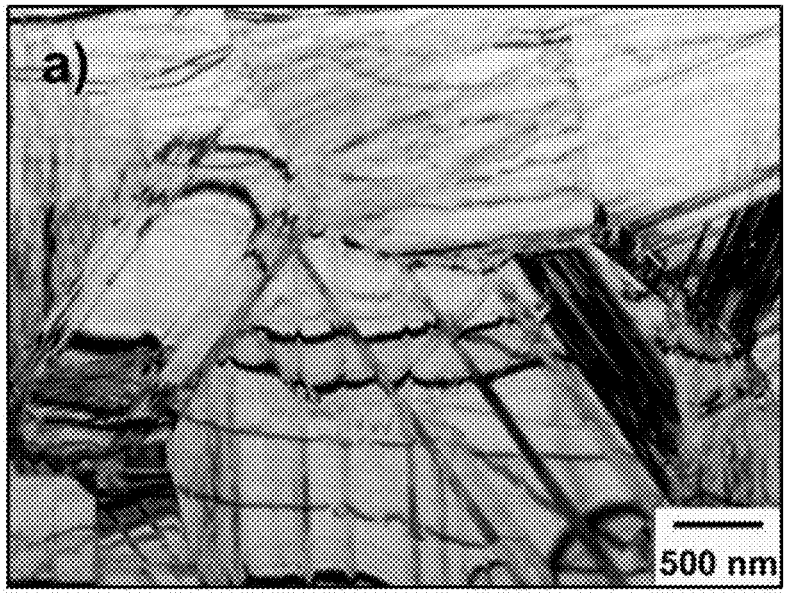
FIGS. 20A and 20B Bright-field TEM micrographs of microstructure in the bottom of the cup drawn at 0.8 mm/s from Alloy 1: a) Low magnification image; b) High magnification image.
Figure 20B:
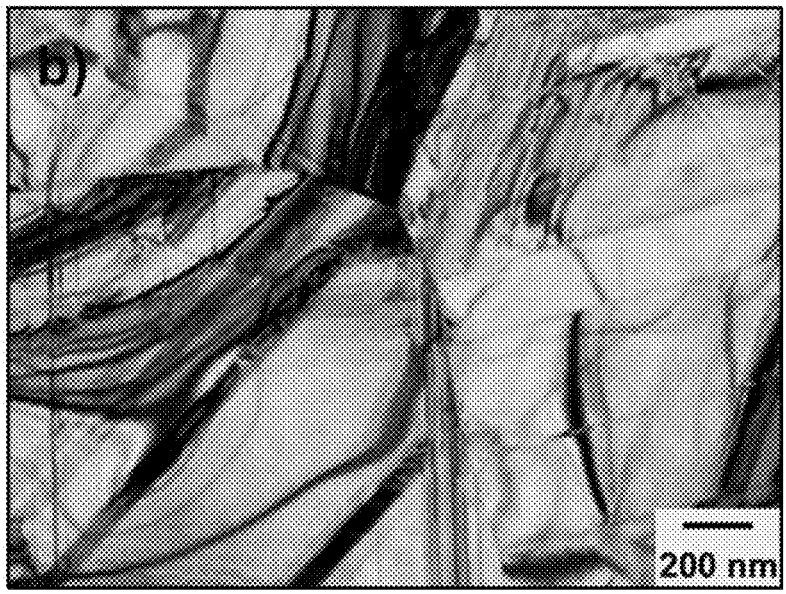
Figure 21A:
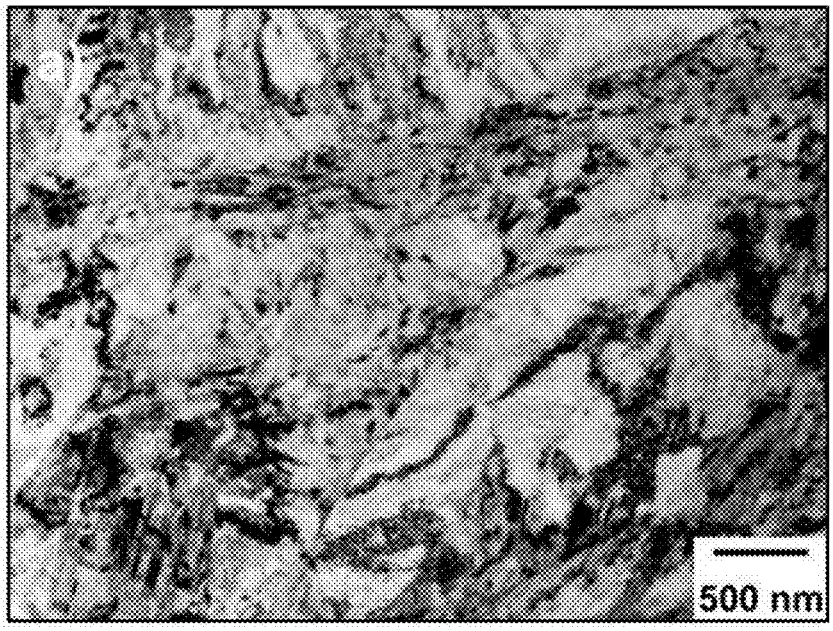
FIGS. 21A and 21B Bright-field TEM micrographs of microstructure in the wall of the cup drawn at 0.8 mm/s from Alloy 1: a) Low magnification image; b) High magnification image.
Figure 21B:
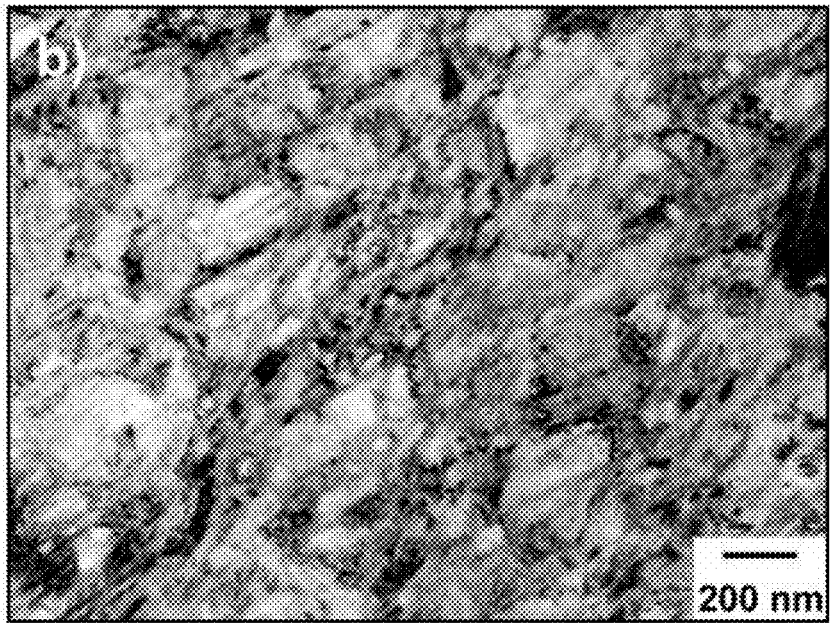

In Alloy 1, the bottom of cup does not display dramatic structural change compared to the initial Recrystallized Modal Structure in the annealed sheet. As shown in FIG. 20, the grains with straight boundaries are revealed by TEM, and stacking faults are a visible, typical characteristic of austenite phase. Namely, the bottom of cup maintains the Recrystallized Modal Structure. The microstructure in the cup wall, however, shows a significant transformation during the drawing process. As shown in FIG. 21, the sample contains high density of dislocations, and the straight grain boundaries are no longer visible as in the recrystallized structure. The dramatic microstructural change during the deformation is largely associated with a transformation of the austenite phase (gamma-Fe) into ferrite (alpha-Fe) with nanoprecipitates achieving a microstructure that is very similar to the Mixed Microconstituent Structure after quasi-static tensile testing but with significantly higher volume fraction of transformed Refined High Strength Nanomodal Structure.

Figure 22A:
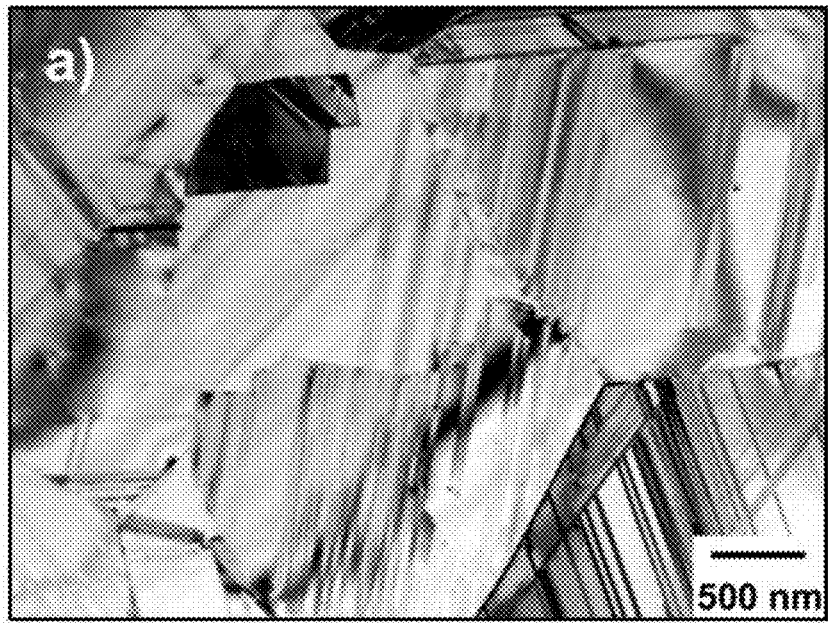
FIGS. 22A and 22B Bright-field TEM micrographs of microstructure in the bottom of the cup drawn at 0.8 mm/s from Alloy 6: a) Low magnification image; b) High magnification image.
Figure 22B:
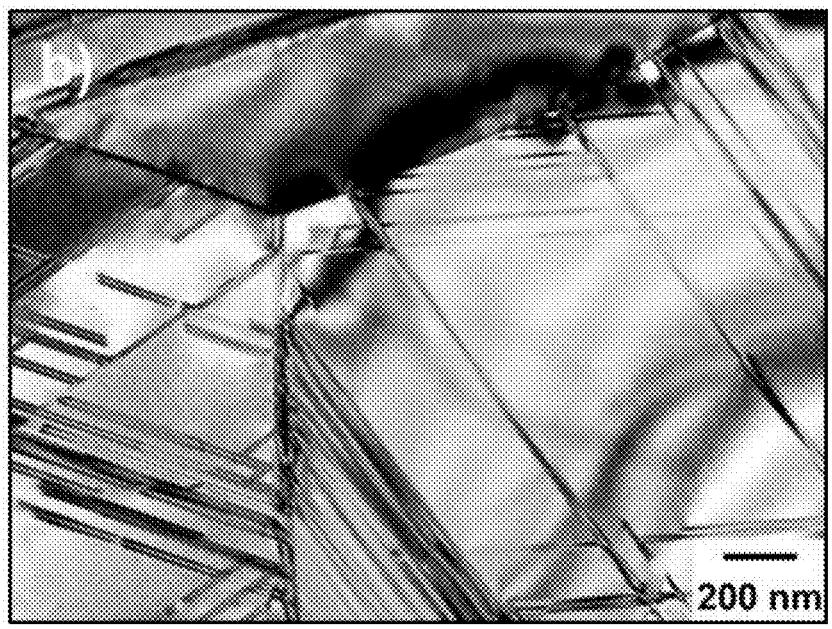
Figure 23A:
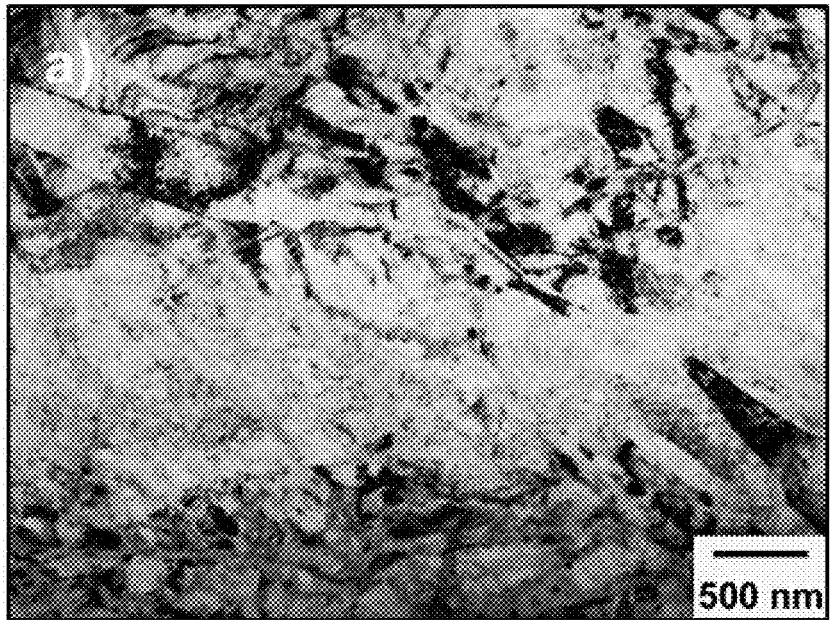
FIGS. 23A and 23B Bright-field TEM micrographs of microstructure in the wall of the cup drawn at 0.8 mm/s from Alloy 6: a) Low magnification image; b) High magnification image.
Figure 23B:
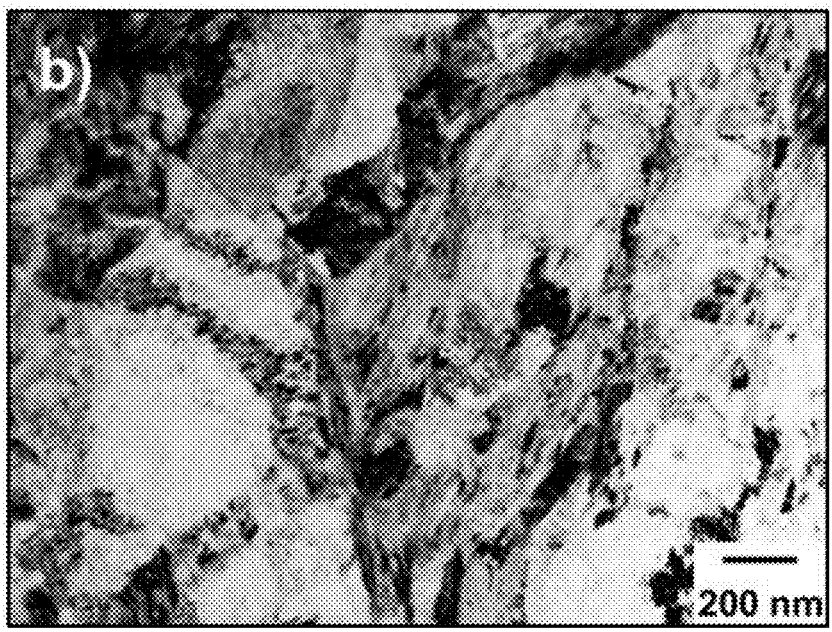

Similarly in Alloy 6, the bottom of the cup experienced little plastic deformation and the Recrystallized Modal Structure is present, as shown in FIG. 22. The wall of the cup from Alloy 6 is severely deformed showing a high density of dislocations in the grains, as shown in FIG. 23. In general, the deformed structure can be categorized as the Mixed Microconstituent Structure. But compared to Alloy 1, the austenite appears more stable in Alloy 6 resulting in smaller fraction of the Refined High Strength Nanomodal Structure after drawing. Although dislocations are abundant in both alloys, refinement caused by phase transformation in Alloy 6 appears less prominent as compared to Alloy 1.

Figure 24:
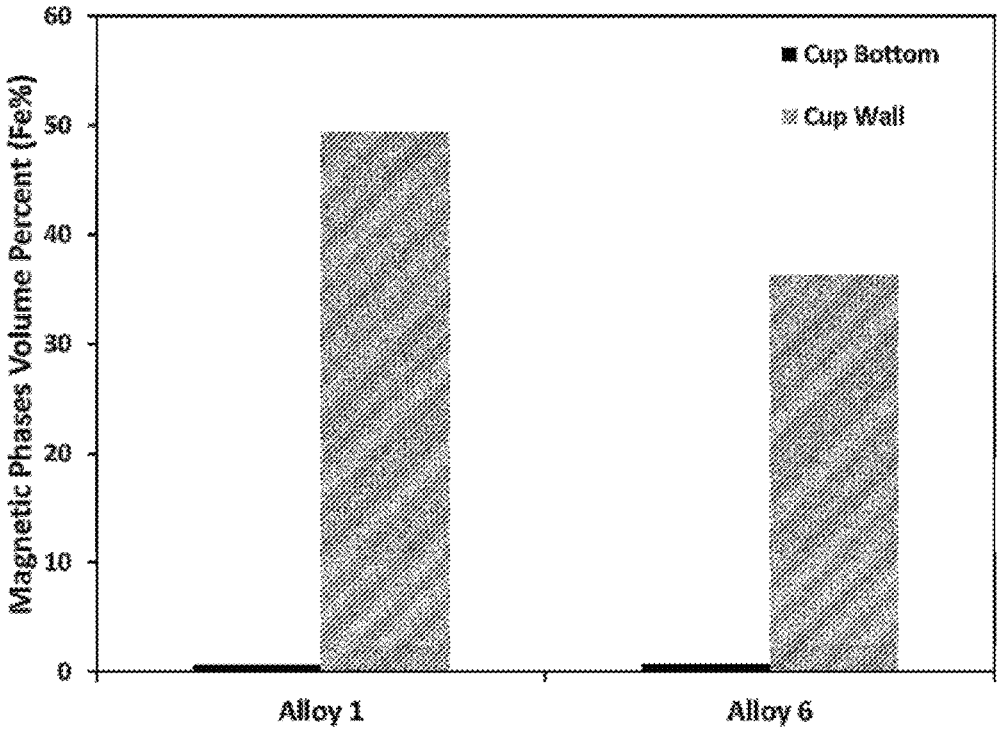
FIG. 24 Volumetric comparison of magnetic phases in cup walls and bottoms from Alloy 1 and Alloy 6 after cup drawing at 0.8 mm/s.

The microstructural changes are consistent with Feritscope measurements from walls and bottoms of the cups. As shown in FIG. 24, the bottom of cups contains a small amount of magnetic phases (1 to 2%), suggesting that the Recrystallized Modal Structure with austenitic matrix is predominant. In the wall of cups, the magnetic phases (mostly ferrite) rise up to 50% and 38% in Alloy 1 and Alloy 6 cups, respectively. The increase in magnetic phases corresponds to the phase transformation and the formation of the Refined High Strength Nanomodal Structure. The smaller transformation in Alloy 6 hints a more stable austenite, in agreement with the TEM observations.

This Case Example demonstrates that significant phase transformation into the Refined High Strength Nanomodal Structure occurs in the cup walls during cup drawing at slow speed of 0.8 mm/s. The volume fraction of transformed phase depends on alloy chemistry.

Case Example #8 Drawing Ratio Effect on Delayed Fracture after Cup Drawing

Laboratory slabs with thickness of 50 mm were cast from Alloy 1, Alloy 6, Alloy 9, Alloy 14 and Alloy 42 according to the atomic ratios provided in Table 1. Cast slabs were laboratory processed by hot rolling and cold rolling as described in the Main Body section of the current application. Blanks with the diameters listed in Table 12 were cut from the cold rolled sheet by wire EDM. After cutting, the edges of the blanks were lightly ground using 240 grit silicon carbide polishing papers to remove any large asperities and then polished using a nylon belt. The blanks were then annealed for 10 minutes at 850° C. as described herein. Resultant sheet blanks from each alloy with final thickness of 1.0 mm and the Recrystallized Modal Structure were used for cup drawing at ratios specified in Table 16.

TABLE 16

Starting Blank Sizes and Resulting Full Cup Draw Ratios

| Blank Diameter (mm) | Draw Ratio |
|---|---|
| 60.45 | 1.25 |
| 67.56 | 1.40 |
| 77.22 | 1.60 |
| 85.85 | 1.78 |

Resultant blanks from each alloy with final thickness of 1.0 mm and the Recrystallized Modal Structure were used for drawing tests. Drawing occurred by pushing the blanks up into the die and the ram was moved continually upward into the die until a full cup was drawn (i.e. no flanging material). Cups were drawn at a ram speed of 0.8 mm/s that is typically used for this type of testing. Blanks of different sizes were drawn with identical drawing parameters.

After drawing, cups were inspected and allowed to sit in room air for 45 minutes. The cups were inspected following air exposure and the numbers of delayed cracks, if any, were recorded. Drawn cups were additionally exposed to 100% hydrogen for 45 minutes. Exposure to 100% hydrogen for 45 minutes was chosen to simulate the maximum hydrogen exposure for the lifetime of a drawn piece. The drawn cups were placed in an atmosphere controlled enclosure and flushed with nitrogen before being switched to 100% hydrogen gas. After 45 minutes in hydrogen, the chamber was purged for 10 minutes in nitrogen. The drawn cups were removed from the enclosure and the number of delayed cracks that had occurred was recorded. The number of cracks that occurred during air and hydrogen exposure of drawn cups is shown in Table 17 and Table 18, respectively.

TABLE 17

Number of Cracks in Drawn Cups after Air Exposure

| | Draw Ratio | | | |
|---|---|---|---|---|
| Alloy | 1.78 | 1.60 | 1.40 | 1.25 |
| Alloy 1 | 19 | 0 | 0 | 0 |
| Alloy 6 | 1 | 0 | 0 | 0 |
| Alloy 9 | 0 | 0 | 0 | 0 |
| Alloy 14 | 0 | 0 | 0 | 0 |
| Alloy 42 | 0 | 0 | 0 | 0 |

TABLE 18

Number of Cracks in Drawn Cups after Hydrogen Exposure

| | Draw Ratio | | | |
|---|---|---|---|---|
| Alloy | 1.78 | 1.60 | 1.40 | 1.25 |
| Alloy 1 | 25 | 1 | 0 | 0 |
| Alloy 6 | 13 | 0 | 0 | 0 |
| Alloy 9 | 2 | 0 | 0 | 0 |

TABLE 18-continued

| Number of Cracks in Drawn Cups after Hydrogen Exposure | | | | |
|---|---|---|---|---|
| | Draw Ratio | | | |
| Alloy | 1.78 | 1.60 | 1.40 | 1.25 |
| Alloy 14 | 0 | 0 | 0 | 0 |
| Alloy 42 | 15 | 0 | 0 | 0 |

Figure 26:
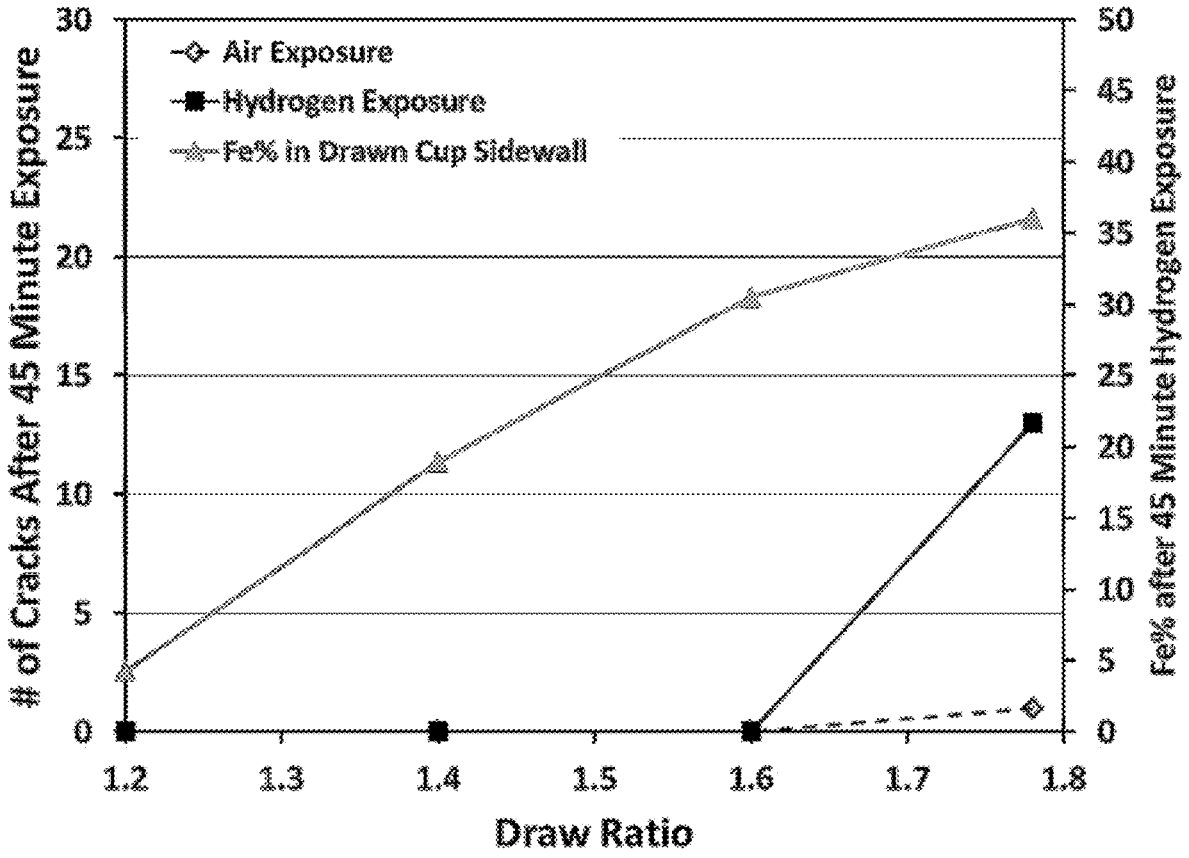
FIG. 26 Draw ratio dependence of delayed cracking in drawn cups from Alloy 6 in hydrogen. Note that at 1.6 draw ratio, no delayed cracking occurs.
Figure 27:
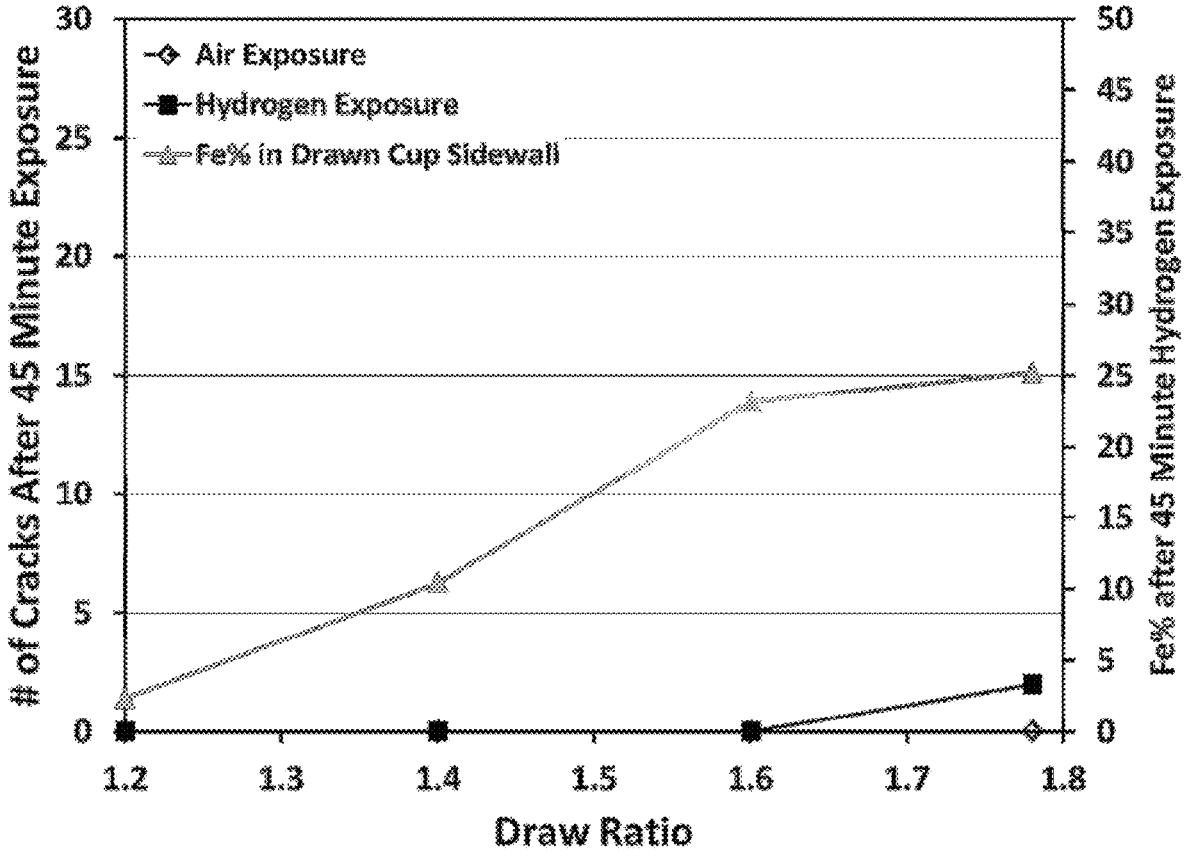
FIG. 27 Draw ratio dependence of delayed cracking in drawn cups from Alloy 9 in hydrogen. Note that at 1.6 draw ratio, no delayed cracking occurs.
Figure 28:
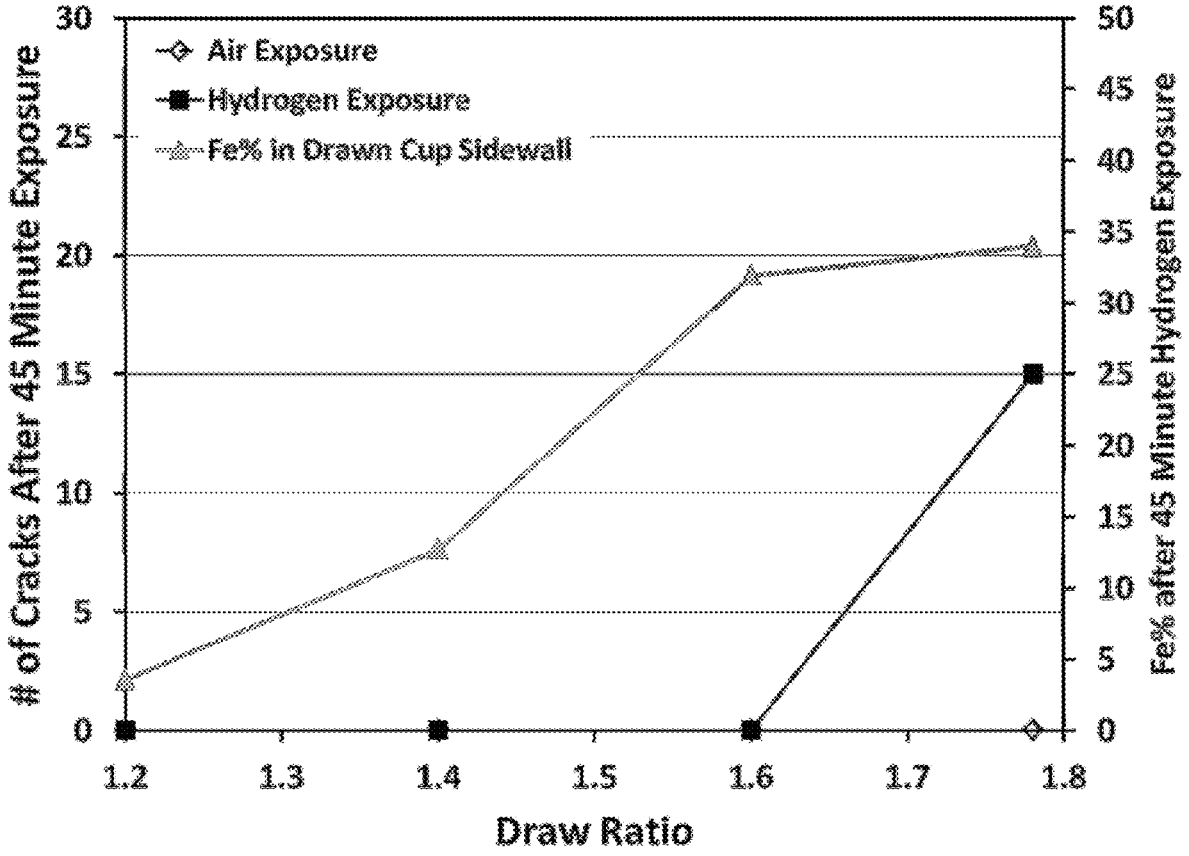
FIG. 28 Draw ratio dependence of delayed cracking in drawn cups from Alloy 42 in hydrogen. Note that at 1.6 draw ratio, no delayed cracking occurs.
Figure 29:
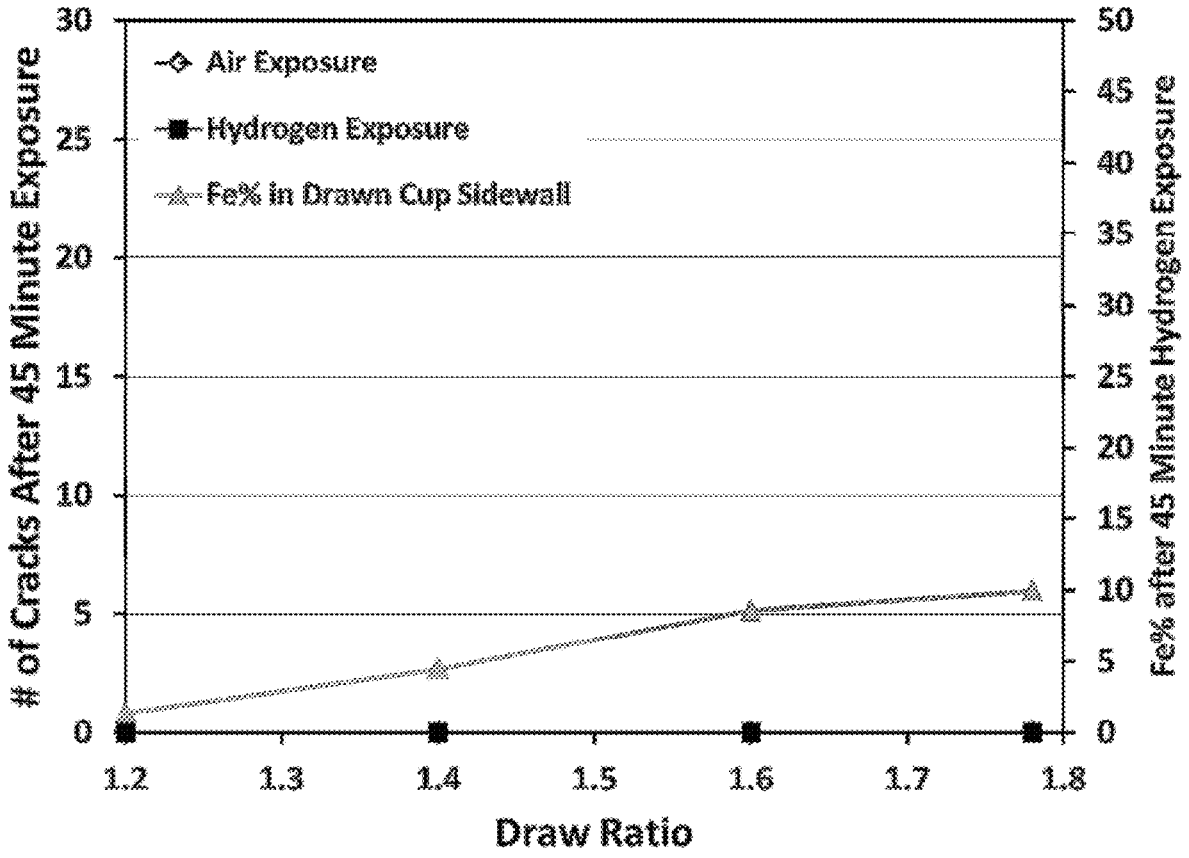
FIG. 29 Draw ratio dependence of delayed cracking in drawn cups from Alloy 14 in hydrogen. Note that no delayed cracking occurs at any draw ratio tested either in air or 100% hydrogen for 45 minutes.

As it can be seen, for Alloy 1, considerable cracking is observed at 1.78 draw ratio in the cups after exposure to both air and hydrogen, whereas that number rapidly decreases to zero at 1.4 draw ratio and below. Feritscope measurements show that the microstructure of the alloy undergoes a significant transformation in the cup walls increasing with higher draw ratios. The results for Alloy 1 are presented in FIG. 25. Alloy 6, Alloy 9 and Alloy 42 show similar behavior with no delayed cracking measured at or below 1.6 draw ratio demonstrating higher resistance to delayed cracking due to alloy chemistry changes. Feritscope measurements also show that the microstructures of the alloys undergo a transformation in the cup walls increasing with higher draw ratios but at smaller degree as compared to Alloy 1. The results for Alloy 6, Alloy 9 and Alloy 42 are also presented in FIG. 26, FIG. 27 and FIG. 28, respectively. Alloy 14 demonstrates no delayed cracking at all testing conditions herein. The results for Alloy 14 with Feritscope measurements are also presented in FIG. 29. As it can be seen, no delayed cracking occur in the cups when amount of transformed phases are below critical value that depends on alloy chemistry. For example, for Alloy 6 the critical value is at about 30 Fe % (FIG. 25) while for Alloy 9 it is about 23 Fe % (FIG. 27). The total amount of the transformation also depends on the alloy chemistry. At the same draw ratio of 1.78, volume fraction of transformed magnetic phases is measured at almost 50 Fe % for Alloy 1 (FIG. 25) while in Alloy 14 it is only about 10 Fe % (FIG. 29). Obviously, the critical value of the transformation is not reached in the cup wall from Alloy 14 and no delayed cracking was observed after hydrogen exposure.

This Case Example demonstrates that for the alloys herein, there is a clear dependence of delayed cracking on drawing ratio. The value of draw ratio above which the cracking occurs corresponding to threshold for delayed cracking depends on alloy chemistry.

Case Example #9 Drawing Speed Effect on Delayed Fracture after Cup Drawing

Laboratory slabs with thickness of 50 mm were cast from Alloy 1 and Alloy 6 according to the atomic ratios provided in Table 1 and laboratory processed by hot rolling and cold rolling as described in the Main Body section of the current application. Blanks of 85.85 mm in diameter were cut from the cold rolled sheet by wire EDM. After cutting, the edges of the blanks were lightly ground using 240 grit silicon carbide polishing papers to remove any large asperities and then polished using a nylon belt. The blanks were then annealed for 10 minutes at 850° C. as described herein. Resultant sheet blanks from each alloy with final thickness of 1.0 mm and the Recrystallized Modal Structure were used for cup drawing at 8 different speeds specified in Table 19. Drawing occurred by pushing the blanks up into the die and the ram was moved continually upward into the die until a full cup was drawn (i.e. no flanging material). Cups were drawn at a variety of drawing speeds as indicated in Table 19. The resultant draw ratio for the blanks tested was 1.78.

TABLE 19

| Drawing Speeds Utilized | |
|---|---|
| # | Draw Speed (mm/s) |
| 1 | 0.8 |
| 2 | 2.5 |
| 3 | 5 |
| 4 | 9 |
| 5 | 19.5 |
| 6 | 38 |
| 7 | 76 |
| 8 | 203 |

Figures 30A, 30B, 30C, 30D, 30E:
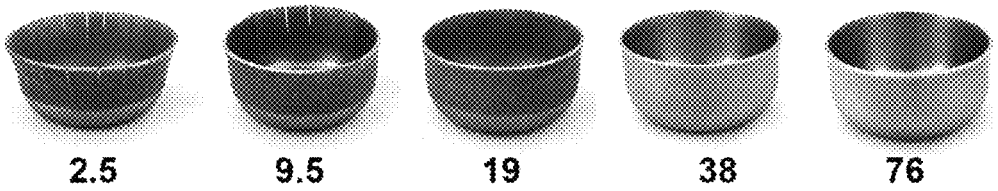
FIGS. 30A-30E A view of the cups from Alloy 1 after drawing with draw ratio of 1.78 at different drawing speed and exposure to hydrogen for 45 min.

After drawing, cups were inspected and allowed to sit in room air for 45 minutes. The cups were inspected following air exposure and the numbers of delayed cracks, if any, were recorded. Drawn cups were additionally exposed to 100% hydrogen for 45 minutes. Exposure to 100% hydrogen for 45 minutes was chosen to simulate the maximum hydrogen exposure for the lifetime of a drawn piece. The drawn cups were placed in an atmosphere controlled enclosure and flushed with nitrogen before being switched to 100% hydrogen gas. After 45 minutes in hydrogen, the chamber was purged for 10 minutes in nitrogen. The drawn cups were removed from the enclosure and the number of delayed cracks that had occurred was recorded. The number of cracks that occurred during air and hydrogen exposure of drawn cups from Alloy 1 and Alloy 6 are shown in Table 20 and Table 21, respectively. An example of the cups from Alloy 1 drawn with draw ratio of 1.78 at different drawing speed and exposure to hydrogen for 45 min is shown in FIG. 30.

TABLE 20

| Delayed Cracking Response of Alloy 1 after 45 min Exposure | | |
|---|---|---|
| | Number of Cracks After 45 Minutes | |
| Drawing Speed | Air Exposure | Hydrogen Exposure |
| 0.8 | 19 | 25 |
| 2.5 | 0 | 26 |
| 5 | 0 | 15 |
| 9.5 | 0 | 7 |
| 19 | 0 | 0 |
| 38 | 0 | 0 |
| 76 | 0 | 0 |
| 203 | 0 | 0 |

TABLE 21

| Delayed Cracking Response of Alloy 6 after 45 min Exposure | | |
|---|---|---|
| | Number of Cracks After 45 Minutes | |
| Drawing Speed | Air Exposure | Hydrogen Exposure |
| 0.8 | 1 | 13 |
| 2.5 | 0 | 6 |
| 5 | 0 | 7 |

TABLE 21-continued

Delayed Cracking Response of Alloy 6 after 45 min Exposure

| Drawing Speed | Number of Cracks After 45 Minutes: Air Exposure | Hydrogen Exposure |
|---|---|---|
| 9.5 | 0 | 0 |
| 19 | 0 | 0 |
| 38 | 0 | 0 |
| 76 | 0 | 0 |
| 203 | 0 | 0 |

Figure 31:
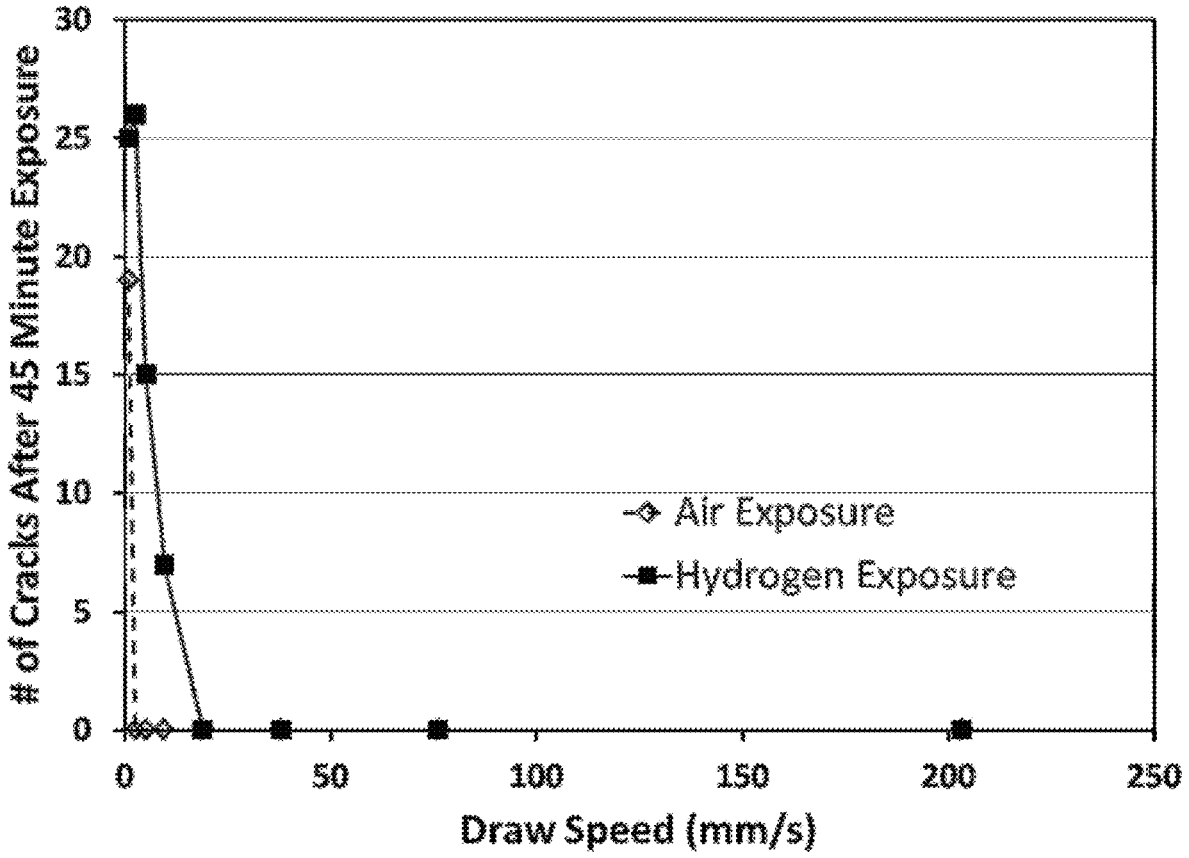
FIG. 31 Draw speed dependence of delayed cracking in drawn cups from Alloy 1 in hydrogen. Note the decrease to zero cracks at 19 mm/s draw speed after 45 minutes in 100% hydrogen atmosphere.
Figure 32:
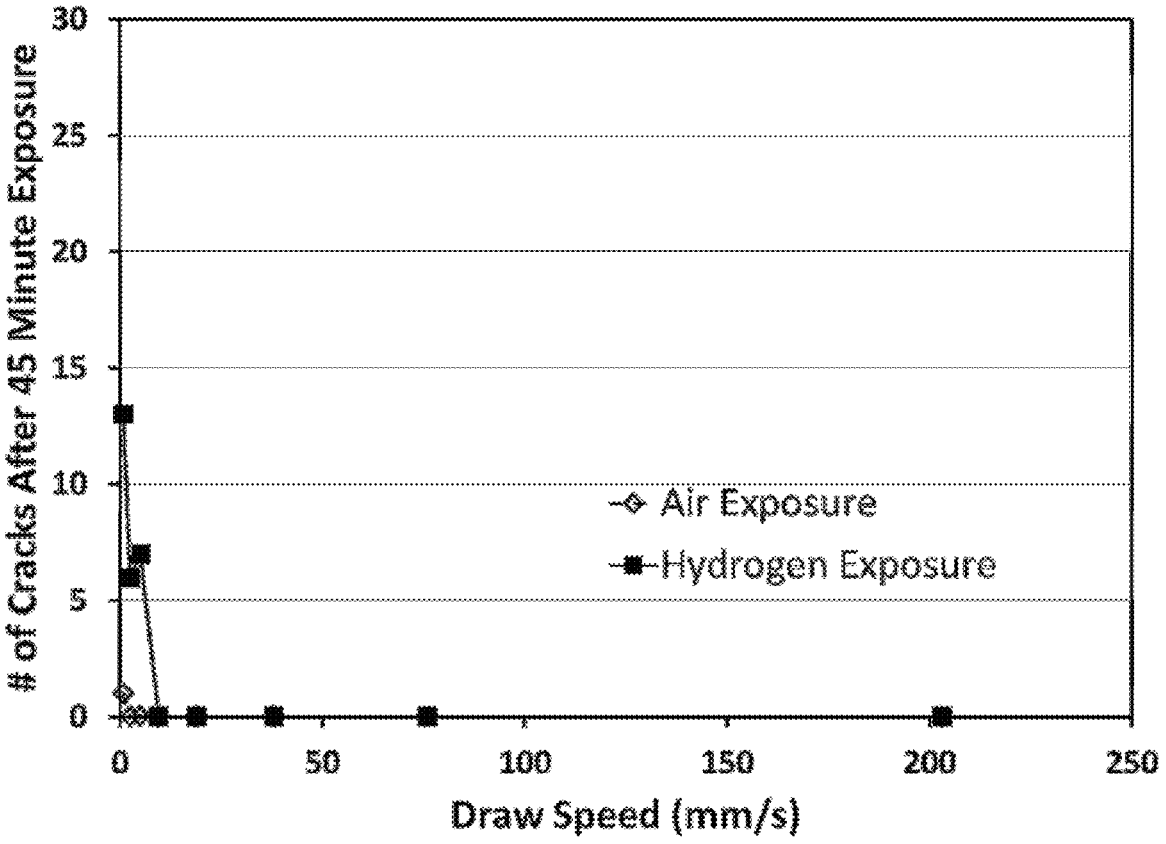
FIG. 32 Draw speed dependence of delayed cracking in drawn cups from Alloy 6 in hydrogen. Note the decrease to zero cracks at 9.5 mm/s draw speed after 45 minutes in 100% hydrogen atmosphere.

As it can be seen, with increasing draw speed, the number of cracks in drawn cups from both Alloy 1 and Alloy 6 decreases and goes to zero after both hydrogen and air exposure. The results for Alloy 1 and Alloy 6 are also presented in FIG. 31 and FIG. 32, respectively. For all alloys tested, no delayed cracking was observed at draw speeds of 19 mm/s or greater after 45 minutes of exposure to 100% hydrogen atmosphere.

This Case Example demonstrates that for the alloys herein, a clear dependence of delayed cracking on drawing speed is present and no cracking observed at drawing speed higher than that of the critical threshold value ($S_{CR}$), which depends on alloy chemistry.

Case Example #10 Structural Transformation During Cup Drawing at High Speed

Drawing speed is shown to affect structural transformation as well as performance of drawn cups in terms of hydrogen assisted delayed cracking. In this Case Example, structural analysis was performed for cups drawn from Alloy 1 and Alloy 6 sheet at high speed. The slabs from both alloys were processed by hot rolling, cold rolling and annealing at 850° C. for 10 min as described in the Main Body section of the current application. Resultant sheet with final thickness of 1.0 mm and the Recrystallized Modal Structure was used for cup drawing at different speeds as described in Case Example #8. Microstructure in the walls and bottoms of the cups drawn at 203 mm/s were analyzed by TEM. For the purpose of comparison, the wall of cups and the bottom of cups were studied as shown in FIG. 19.

To prepare TEM specimens, the samples were first cut with EDM, and then thinned by grinding with pads of reduced grit size every time. Further thinning to make foils of 60 to 70 μm thickness was done by polishing with 9 μm, 3 μm and down to 1 μm diamond suspension solutions. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens may be ion-milled using a Gatan Precision Ion Polishing System (PIPS). The ion-milling usually is done at 4.5 keV, and the inclination angle is reduced from 4° to 2° to open up the thin area. The TEM studies were done using a JEOL 2100 high-resolution microscope operated at 200 kV.

Figure 33A:
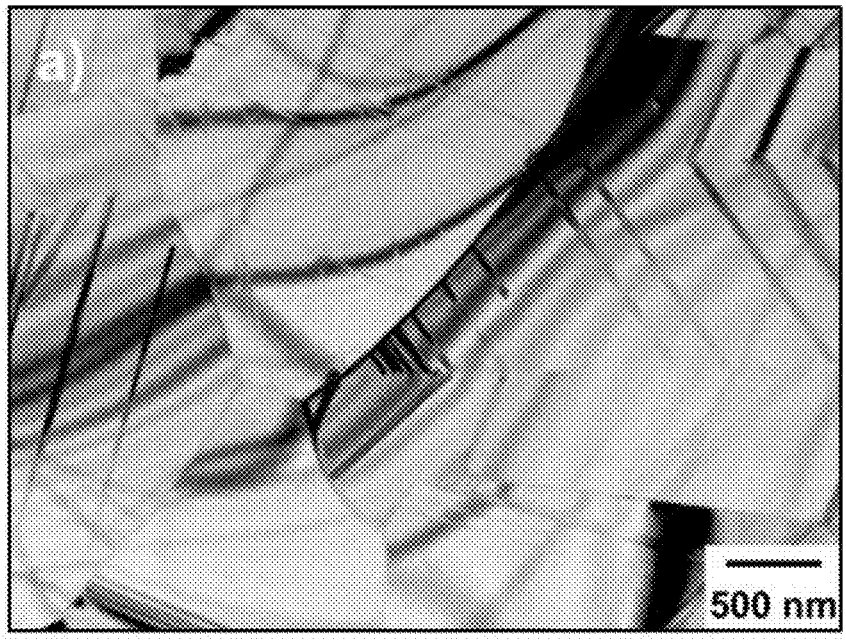
FIGS. 33A and 33B Bright-field TEM micrographs of microstructure in the bottom of the cup drawn at 203 mm/s from Alloy 1: a) Low magnification image; b) High magnification image.
Figure 33B:
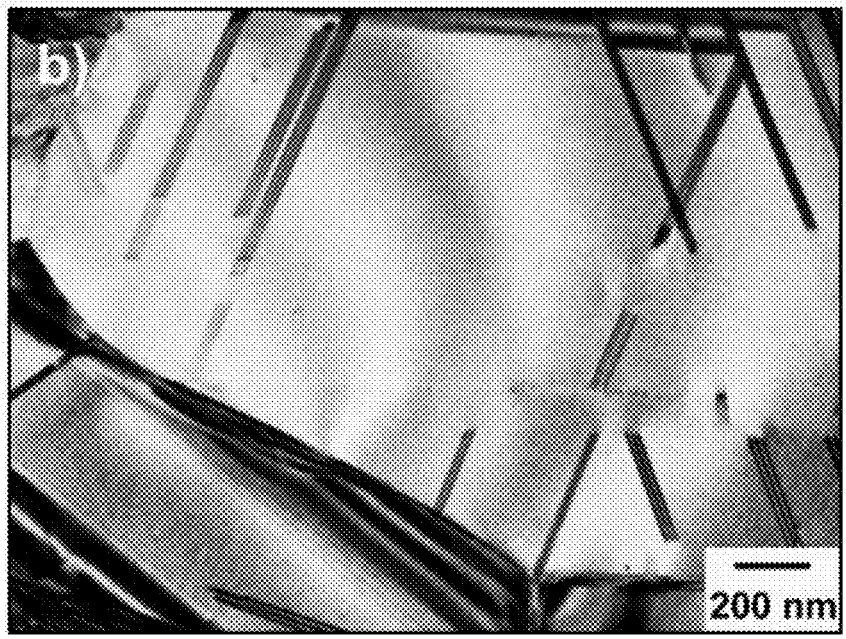

At fast drawing speed of 203 mm/s, the bottom of cup shows a microstructure similar to the Recrystallized Modal Structure. As shown in FIG. 33, the grains are clean with just few dislocations, and the grain boundaries are straight and sharp which is typical for recrystallized structure. Stacking faults are seen in the grains as well, indicative of the austenite phase (gamma-Fe). Since the sheet prior to cup drawing was recrystallized through annealing at 850° C. for 10 min, the microstructure shown in FIG. 33 suggests that bottom of cup experienced very limited plastic deformation during the cup drawing. At slow speed (0.8 mm/s), the microstructure of the bottom of the cup from Alloy 1 (FIG. 20) shows in general a similar structure to the one at fast speed, i.e., the straight grain boundaries and presence of stacking faults which is not unexpected since minimal deformation occurred on the cup bottoms.

Figure 34A:
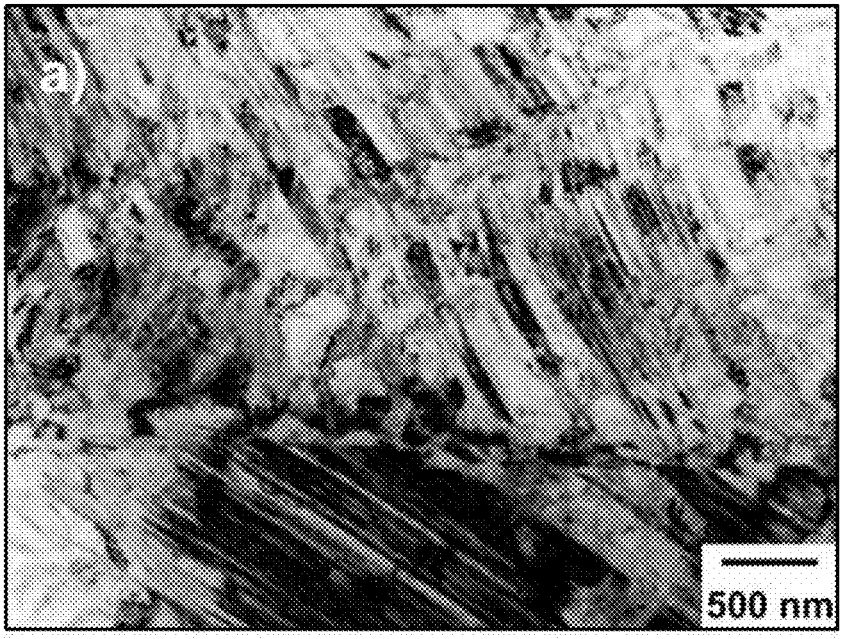
FIGS. 34A and 34B Bright-field TEM micrographs of microstructure in the wall of the cup drawn at 203 mm/s from Alloy 1: a) Low magnification image; b) High magnification image.
Figure 34B:
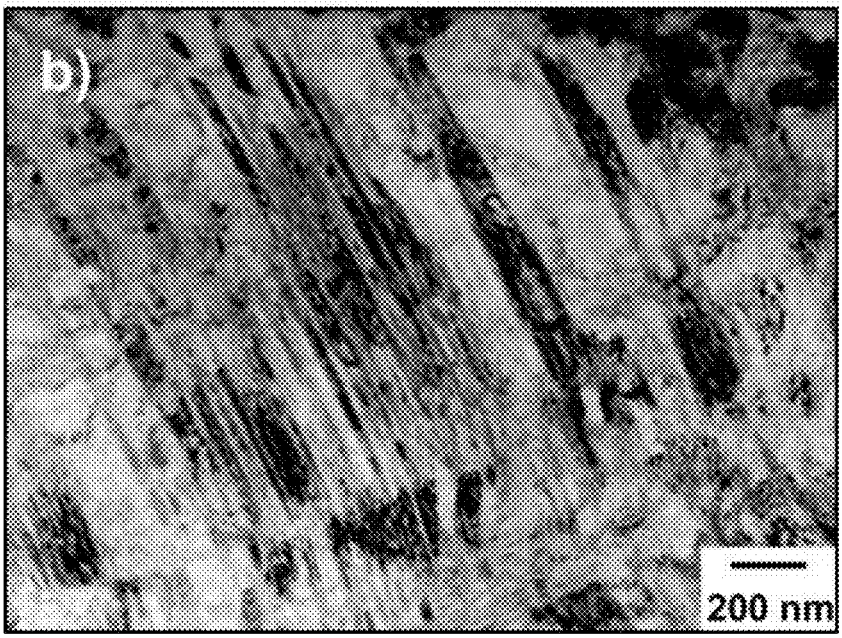

By contrast, the walls of cups drawn at fast speed are highly deformed as compared to the bottoms as it was seen in the cups drawn at slow speed. However, different deformation pathways are revealed in the cups drawn at different speeds. As shown in FIG. 34, the wall of fast drawn cup shows high fraction of deformation twins in addition to dislocations within austenitic matrix grains. In a case of drawing at slow speed of 0.8 mm/s (FIG. 21), the microstructure in the cup wall does not show evidence of deformation twins. Structural appearance is typical for that of the Mixed Microconstituent Structure (Structure #2, FIG. 2 and FIG. 3). Although phase transformation is resulted from the accumulation of high density of dislocations in both cases, and refined structure is generated in randomly distributed structural areas, the activity of dislocations is less pronounced in this fast drawing case due to active deformation by twinning leading to a less extent of phase transformation.

Figure 35A:
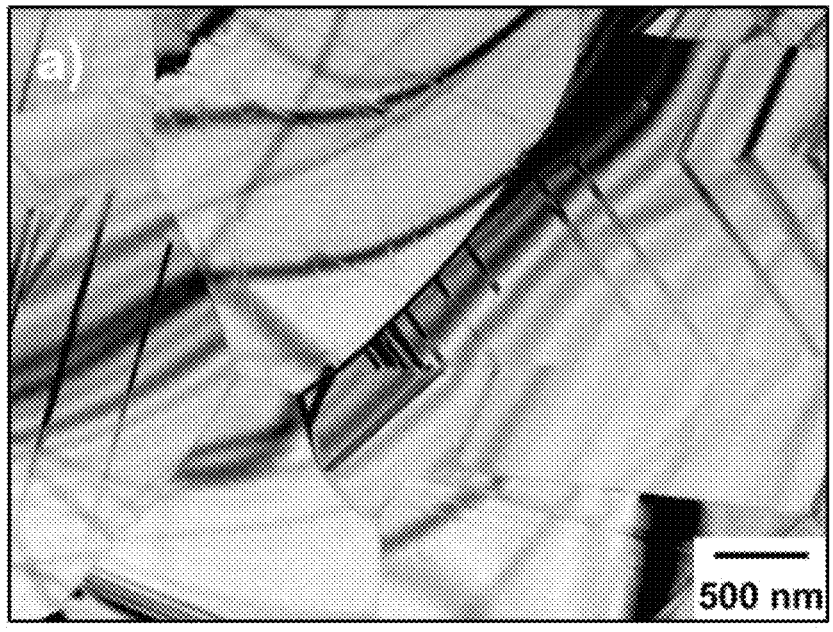
FIGS. 35A and 35B Bright-field TEM micrographs of microstructure in the bottom of the cup drawn at 203 mm/s from Alloy 6: a) Low magnification image; b) High magnification image.
Figure 35B:
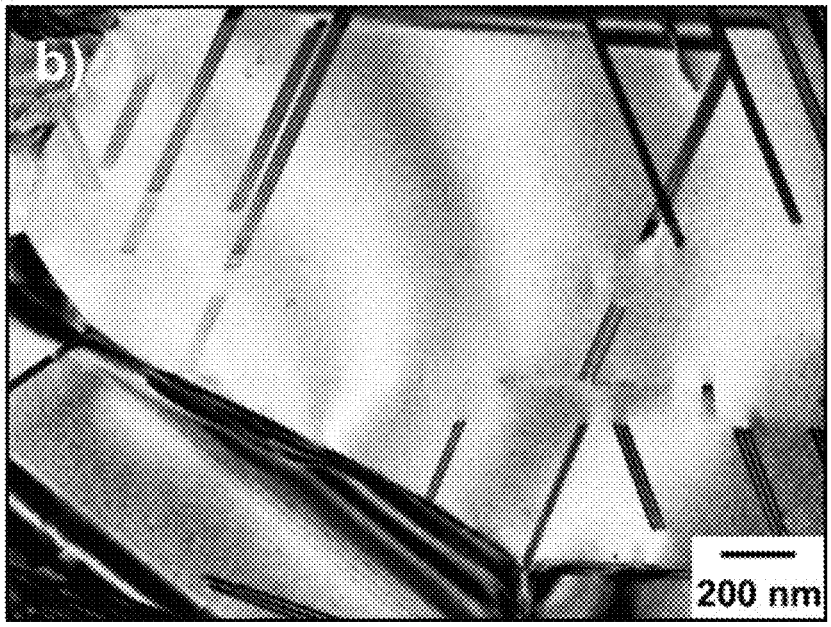
Figure 36A:
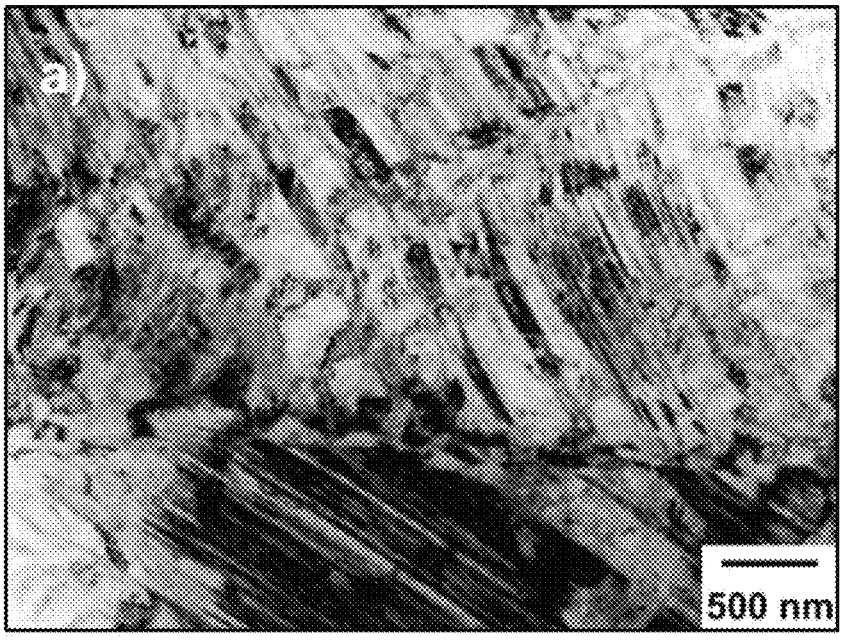
FIGS. 36A and 36B Bright-field TEM micrographs of microstructure in the wall of the cup from Alloy 6 drawn at 203 mm/s: a) Low magnification image; b) High magnification image.
Figure 36B:
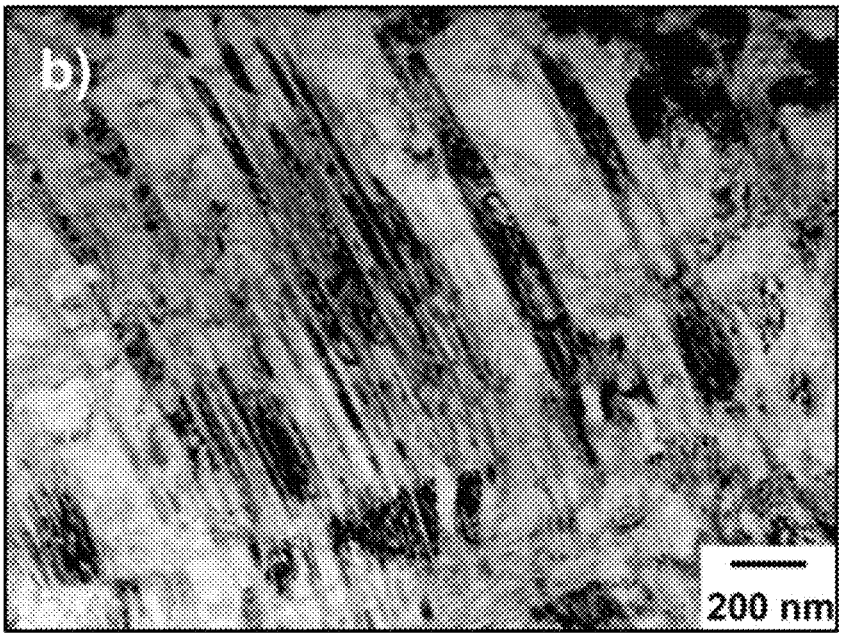

FIG. 35 and FIG. 36 show the microstructures in the bottom and in the wall of the cup drawn at fast speed of 203 mm/s from Alloy 6. Similar to Alloy 1, there is the Recrystallized Modal Structure in the cup bottom and twinning is dominating the deformation of the cup walls. In the cups after slow drawing, at a speed of 0.8 mm/s, no twins but rather dislocations are found in the walls of the cups from Alloy 6 (FIG. 23).

Figure 37:
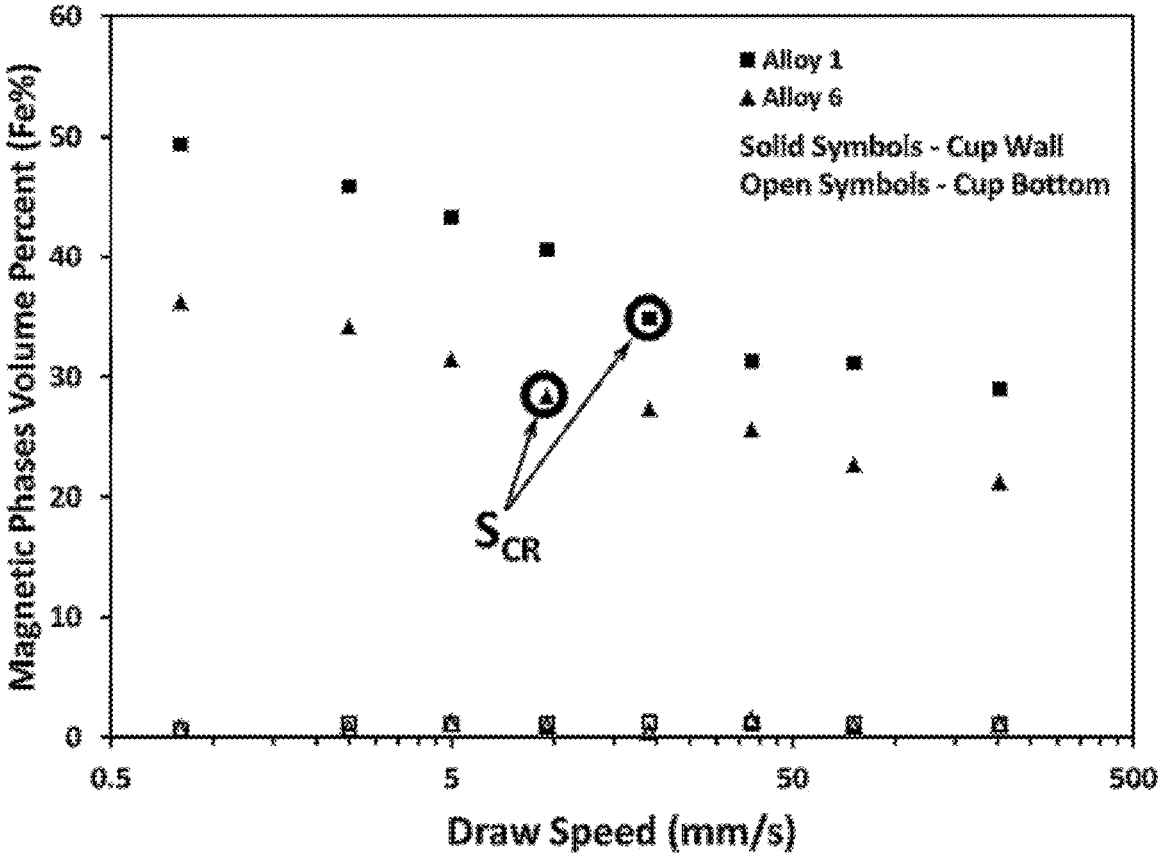
FIG. 37 Feritscope magnetic measurements on walls and bottoms of draw cups from Alloy 1 and Alloy 6 drawn at different speed.

FIG. 37 shows the Feritscope measurements on the cups from Alloy 1 and Alloy 6. It can be seen that the microstructure in the bottoms of both slow drawn and fast drawn cups is predominantly austenite. Since very little to no stress occurs at the bottom of the cup during cup drawing, structural changes are minimal and this is then represented by the baseline measurement (Fe %) of the starting Recrystallized Modal Structure (i.e. Structure #4 in FIG. 2). Feritscope measurements at the cup bottoms are represented by open symbols in FIG. 37 showing no changes in magnetic phase volume fraction at any draw speed in both alloys herein. However, in contrast, the walls of cups for both alloys shows that the amount of magnetic phases related to phase transformation at deformation is decreasing with increasing drawing speed (solid symbols in FIG. 37), which is in agreement with the TEM studies. Cup walls undergo an extensive deformation at drawing leading to structural changes towards Mixed Microconstituent Structure formation. As it can be seen, the volume fraction of the magnetic phases representing Microconstituent 2 decreases with increasing draw speed (FIG. 37). Note the critical speed ($S_{CR}$) is provided for each alloy based on where cracking is directly observed. For Alloy 1 $S_{CR}$ was determined to be 19 mm/s and for Alloy 6 $S_{CR}$ was determined to be 9.5 mm/s as shown by the number of cracks present in FIG. 31 and FIG. 32 respectively.

This Case Example demonstrates that increasing drawing speed during cup drawing of the alloys herein results in a change of deformation pathway with domination by deformation twinning leading to suppression of austenite transformation into the Refined High Strength Nanomodal Structure and lowering of magnetic phase volume percent.

Case Example #11 Conventional AHSS Cup Drawing at Different Speed

Commercially produced and processed Dual Phase 980 (DP980) steel sheet with thickness of 1 mm was purchased and used for cup drawing tests in as received condition. Blanks of 85.85 mm in diameter were cut from the cold rolled sheet by wire EDM. After cutting, the edges of the blanks were lightly ground using 240 grit silicon carbide polishing papers to remove any large asperities and then polished using a nylon belt. Resultant sheet blanks were used for cup drawing at 3 different speeds specified in Table 17.

Resultant blanks from each alloy with final thickness of 1.0 mm and the Recrystallized Modal Structure were used for drawing tests. Drawing occurred by pushing the blanks up into the die and the ram was moved continually upward into the die until a full cup was drawn (i.e. no flanging material). Cups were drawn at a variety of drawing speeds as indicated in Table 22. The resultant draw ratio for the blanks tested was 1.78.

TABLE 22

Drawing Speeds Utilized

| # | Draw Speed (mm/s) |
|---|---|
| 1 | 0.8 |
| 2 | 76 |
| 3 | 203 |

Figure 38:
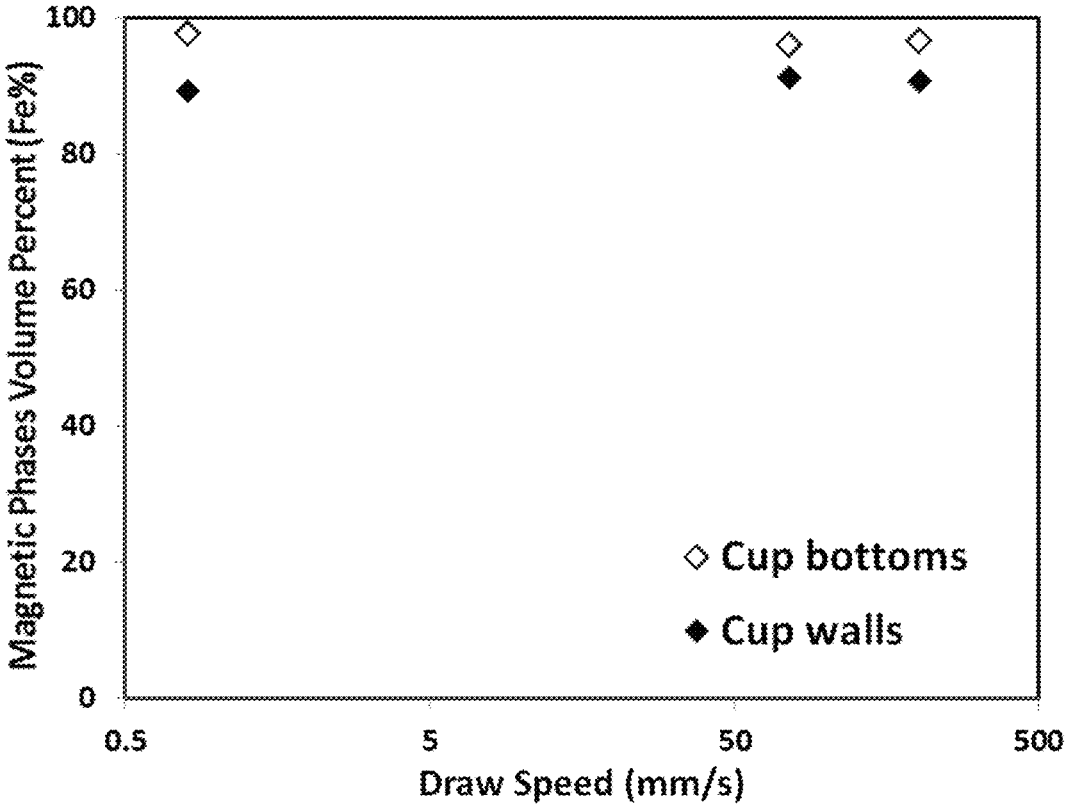
FIG. 38 Feritscope magnetic measurements on walls and bottoms of draw cups from commercial DP980 steel drawn at different speed.

After drawing, Feritscope measurements were done on the cup walls and bottoms. Results of the measurements are shown in FIG. 38. As it can be seen, volume fraction of the magnetic phases does not change with increasing drawing speed and remains constant over entire speed range applied.

This Case Example demonstrates that increasing drawing speed at cup drawing of a conventional AHSS does not affect structural phase composition or change the deformation pathway.

Case Example #12 Drawing Limit Ratio

Blanks from Alloy 6 and Alloy 14 according to the atomic ratios provided in Table 1 were cut with the diameters listed in Table 23 from 1.0 mm thick cold rolled sheet from both alloys by wire EDM. After cutting, the edges of the blanks were lightly ground using 240 grit silicon carbide polishing papers to remove any large asperities and then polished using a nylon belt. The blanks were then annealed for 10 minutes at 850° C. as described herein. Resultant sheet blanks from each alloy with final thickness of 1.0 mm and the Recrystallized Modal Structure were used for cup drawing at ratios specified in Table 23. In initial state, Feritscope measurement show Fe % at 0.94 for Alloy 6 and 0.67 for Alloy 14.

TABLE 23

Starting Blank Sizes and Resulting Full Cup Draw Ratios

| Blank Diameter (mm) | Draw Ratio |
|---|---|
| 60.781 | 1.9 |
| 63.980 | 2.0 |
| 67.179 | 2.1 |

TABLE 23-continued

Starting Blank Sizes and Resulting Full Cup Draw Ratios

| Blank Diameter (mm) | Draw Ratio |
|---|---|
| 70.378 | 2.2 |
| 73.577 | 2.3 |
| 76.776 | 2.4 |
| 79.975 | 2.5 |

Testing was completed on an Interlaken SP 225 machine using the small diameter punch (31.99 mm) and with die diameter of 36.31 mm. Drawing occurred by pushing the blanks up into the die and the ram was moved continually upward into the die until a full cup was drawn (i.e. no flanging material). Cups were drawn at a ram speed of 0.85 mm/s that is typically used for this type of testing and at 25 mm/s. Blanks of different sizes were drawn with identical drawing parameters.

Figures 39A, 39B, 39C, 39D, 39E, 39F:
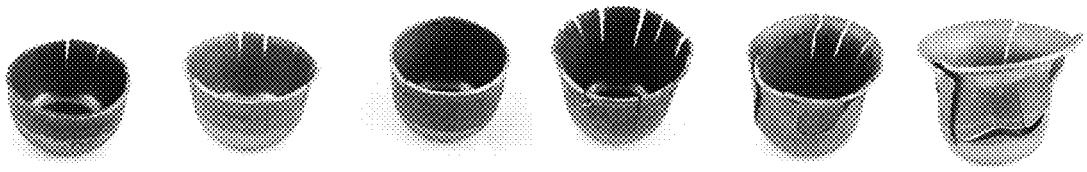
FIGS. 39A-39L A view of the cups from Alloy 6 after drawing with different draw ratios at; a) 0.85 mm/s; b) 25 mm/s.
Figures 39G, 39H, 39I, 39J, 39K, 39L:
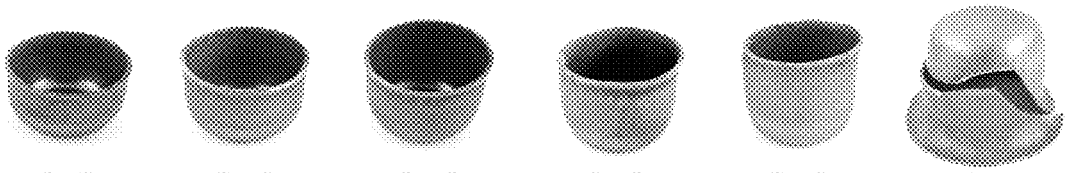
Figures 4G, 40A, 40B, 40C, 40D, 40E, 40F:
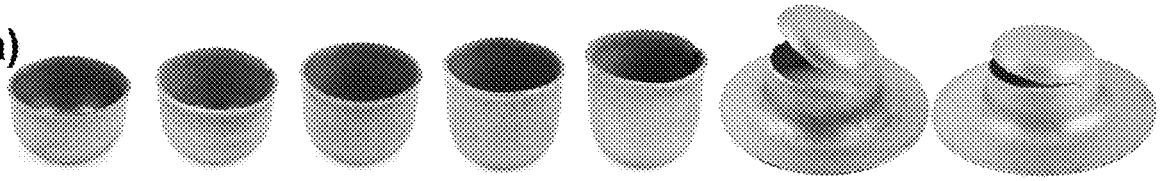
FIGS. 40A-40N A view of the cups from Alloy 14 after drawing with different draw ratios at; a) 0.85 mm/s; b) 25 mm/s.
Figures 40H, 40I, 40J, 40K, 40L, 40M, 40N:
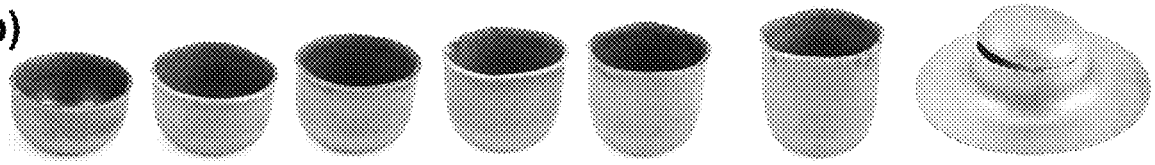
Figure 41:
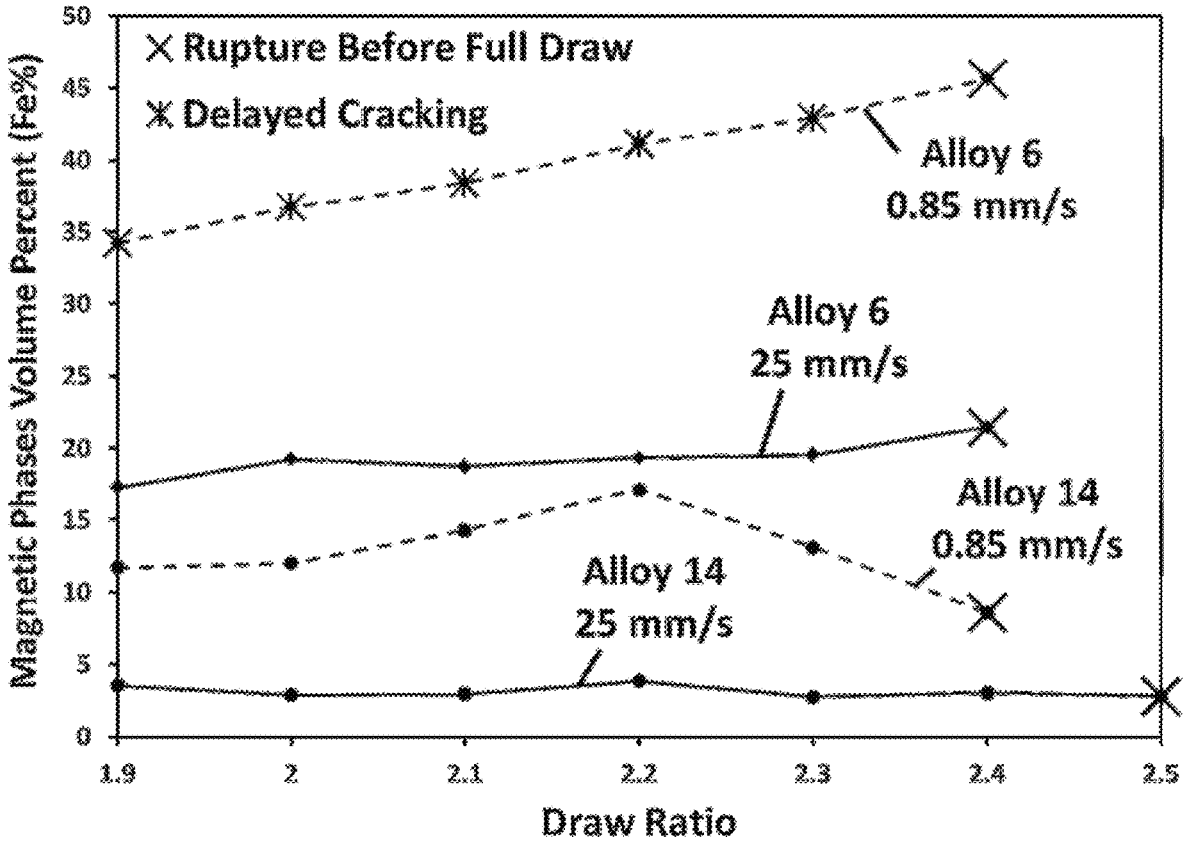
FIG. 41 Draw test results with Feritscope measurements showing suppression of delayed cracking in Alloy 6 cups and increase in Drawing Limit Ratio in Alloy 14 when drawing speed increased from 0.85 mm/s to 25 mm/s.

Examples of the cups from Alloy 6 and Alloy 14 drawn with different draw ratios are shown in FIG. 39 and FIG. 40, respectively. Note that the drawing parameters were not optimized so some earing at the tops and dimples on the side walls were observed in the cup samples. This occurs for example when the clamping force or lubricant is not optimized so that some drawing defects are present. After drawing, cups were inspected for delayed cracking and/or rupture. Results of the testing including Feritscope measurements on the cup walls after drawing are shown in FIG. 41. As it can be seen, at slow drawing speed of 0.85 mm/s amount of magnetic phases is continuously increased to in the walls of the cups from Alloy 6 from 34 Fe % at 1.9 draw ratio to 46% at 2.4 draw ratio. Delayed fracture occurred at all draw ratios with rupture of the cup at draw ratio of 2.4. Increase in drawing speed to 25 mm/s results in lower Fe % at all draw ratios with maximum of 21.5 Fe % at 2.4 draw ratio. The cup rupture occurred at the same draw ratio of 2.4. In the walls of the cups from Alloy 14 the amount of magnetic phases is comparatively lower at all test conditions herein. Delayed cracking was not observed in any cups from this alloy and in the case of higher speed testing (25 mm/s), the rupture occurred at higher draw ratio of 2.5. The limiting draw ratio (LDR) for Alloy 6 was determined to be 2.3 and for Alloy 14 was determined to be 2.4. LDR is defined as the ratio of the maximum diameter of the blank that can be successfully drawn under the given punch diameter.

This Case Example demonstrates that increasing drawing speed during cup drawing of the alloys herein results in a suppression of the delayed fracture as shown on Alloy6 example and increase draw ratio before rupture that defined Drawing Limit Ratio (DLR) as shown on Alloy 14 example. Increase in drawing speed results in diminishing phase transformation into the Refined High Strength Nanomodal Structure significantly lowering the amount of the magnetic phases after deformation that are susceptible to hydrogen embrittlement.

What is claimed is:

1. A method for improving resistance for delayed cracking in a metallic alloy, comprising:

(a) supplying a metal alloy comprising at least 50 atomic % iron and at least four or more elements selected from Si, Mn, B, Cr, Ni, Cu, Al or C and melting said alloy and cooling at a rate of ≤250 K/s or solidifying to a thickness of ≥2.0 mm and forming an alloy having a $T_m$ and matrix grains of 2 to 10,000 μm;

(b) processing said alloy into sheet with thickness ≤10 mm by heating said alloy to a temperature of ≥650° C. and below the $T_m$ of said alloy and stressing of said alloy at a strain rate of $10^{-6}$ to $10^4$ and cooling said alloy to ambient temperature;

(c) stressing said alloy at a strain rate of $10^{-6}$ to $10^4$ and heating said alloy to a temperature of at least 600° C. and below $T_m$ and forming said alloy in a sheet form with thickness ≤3 mm having a tensile strength of 720 to 1490 MPa and an elongation of 10.6 to 91.6% and with a magnetic phases volume % (Fe %) from 0 to 10%;

wherein said alloy formed in step (c) indicates critical draw ratio ($D_{CR}$) wherein drawing said alloy at draw ratio greater than $D_{CR}$ results a first magnetic phase volume V1 and wherein drawing said alloy at a draw ratio less than or equal to $D_{CR}$ results in a second magnetic phase volume V2, where V2<V1.

2. The method of claim 1 wherein V1 is greater than 10% to 60%.

3. The method of claim 1 wherein V2 is 1% to 40%.

4. The method of claim 1 wherein in step (a), thickness is in the range from 2.0 mm to 500 mm.

5. The method of claim 1 wherein the alloy formed in step (b) has a thickness from 1.0 mm to 10 mm.

6. The method of claim 1 wherein the alloy formed in step (c) has a thickness from 0.4 mm to 3 mm.

7. The method of claim 1 wherein said alloy comprises Fe and at least five or more elements selected from Si, Mn, B, Cr, Ni, Cu, Al or C.

8. The method of claim 1 wherein said alloy comprises Fe and at least six or more elements selected from Si, Mn, B, Cr, Ni, Cu, Al or C.

9. The method of claim 1 wherein said alloy comprises Fe and at least seven or more elements selected from Si, Mn, B, Cr, Ni, Cu, Al or C.

10. The method of claim 1 wherein said alloy comprises, in atomic percent, Fe (61.30 to 80.19), Si (0.20 to 7.02), Mn (0 to 15.86), B (0 to 6.09), Cr (0 to 18.90), Ni (0 to 6.80), Cu (0 to 3.66), C (0 to 3.72), Al (0 to 5.12).

11. The method of claim 1, wherein the drawing at a draw ratio less than or equal to $D_{CR}$ provides an alloy that indicates a crack free drawn area after exposure to air for 24 hours and/or after exposure to 100% hydrogen for 45 minutes.

12. The method of claim 1, wherein said alloy is positioned in a vehicle.

13. The method of claim 1 wherein said alloy is part of a vehicular frame, vehicular chassis, or vehicular panel.

* * * * *